US006440556B2

(12) United States Patent
Matsui et al.

(10) Patent No.: US 6,440,556 B2
(45) Date of Patent: Aug. 27, 2002

(54) SPONTANEOUSLY DEGRADABLE FIBERS AND GOODS MADE THEREOF

(75) Inventors: Masao Matsui; Eiichi Ozeki, both of Kyoto; Yoshikazu Kondo; Hiroshi Kajiyama, both of Hofu, all of (JP)

(73) Assignees: Shimadzu Corporation, Kyoto; Kanebo, Ltd., Tokyo, both of (JP)

( * ) Notice: Subject to any disclaimer, the term of this patent is extended or adjusted under 35 U.S.C. 154(b) by 0 days.

(21) Appl. No.: 09/938,578

(22) Filed: Aug. 27, 2001

Related U.S. Application Data

(63) Continuation of application No. 09/713,033, filed on Nov. 16, 2000, now Pat. No. 6,322,887, which is a continuation of application No. 09/180,628, filed as application No. PCT/JP97/01588 on May 12, 1997, now Pat. No. 6,174,602.

(30) Foreign Application Priority Data

| | | |
|---|---|---|
| May 21, 1996 | (JP) | 8-125998 |
| May 21, 1996 | (JP) | 8-125999 |
| May 14, 1996 | (JP) | 8-119245 |
| May 14, 1996 | (JP) | 8-119246 |
| May 14, 1996 | (JP) | 8-119247 |
| Jun. 7, 1996 | (JP) | 8-145408 |
| Sep. 9, 1996 | (JP) | 8-238114 |
| Sep. 9, 1996 | (JP) | 8-238115 |
| Sep. 27, 1996 | (JP) | 8-256625 |

(51) Int. Cl.[7] ..... D01F 6/00

(52) U.S. Cl. ..... 428/370; 428/373; 428/374; 428/395

(58) Field of Search ..... 428/370, 373, 428/374, 395

(56) References Cited

U.S. PATENT DOCUMENTS

| | | | | |
|---|---|---|---|---|
| 5,254,616 | A | 10/1993 | Benko et al. | |
| 5,593,778 | A | 1/1997 | Kondo et al. | 428/373 |
| 5,688,582 | A | 11/1997 | Nagaoka et al. | 428/374 |

FOREIGN PATENT DOCUMENTS

| | | | |
|---|---|---|---|
| JP | 7-34369 | | 2/1995 |
| JP | 7-133511 | | 5/1995 |
| JP | 7-310236 | | 11/1995 |
| JP | 9-41223 | | 2/1997 |
| JP | 10088425 A | * | 4/1998 |

* cited by examiner

*Primary Examiner*—N. Edwards
(74) *Attorney, Agent, or Firm*—Armstrong, Westerman & Hattori, LLP

(57) ABSTRACT

A spontaneously degradable fiber excellent in bulkiness, softness, stretchability and feeling, which comprises (A) a low heat-shrinkable fiber component comprising a high crystalline aliphatic polyester and (B) a high heat-shrinkable fiber component comprising an aliphatic polyester, e.g., a low crystalline or non-crystalline aliphatic polyester, and a block copolymer or a mixture the main component of which is an aliphatic polyester and which comprises a high-melting component and a low-melting component. Further, fibers excellent in self-crimpability or self-adhesion property and dividable fibers are obtained by suitably combining the fiber components (A) and (B) to form conjugated fibers or composite yarns.

4 Claims, 5 Drawing Sheets

SPONTANEOUSLY DEGRADABLE FIBERS AND GOODS MADE THEREOF

This application is a divisional of prior application Ser. No. 09/713,033, filed Nov. 16, 2000, now U.S. Pat. No 6,322,887, which is a Divisional of Ser. No. 09/180,628, filed Nov. 13, 1998, now U.S. Pat. No. 6,174,602, which is a 371 of PCT/JP97/01588, filed May 12, 1997, and which are hereby incorporated by reference.

TECHNICAL FIELD

The present invention relates to fibers which are spontaneously degradable and are capable of providing textile goods having excellent properties such as bulkiness, softness and feeling, and goods made thereof, and more particularly to spontaneously degradable fibers comprising aliphatic polyesters having different thermal characteristics, and goods made thereof.

BACKGROUND ART

Conventional synthetic fibers made of synthetic resins are slow in rate of degradation under natural environment and generate a large amount of heat at burning and, therefore, have to be reconsidered from the viewpoint of environmental protection. For such a reason, spontaneously degradable fibers made of aliphatic polyesters are being developed, and their contributions to environmental protection have been expected. However, these spontaneously degradable aliphatic polyester fibers are not satisfactory in bulkiness, softness, feeling and so on, and an improvement thereof has been desired.

Conventionally it is known that goods such as knitted and woven fabrics having excellent bulkiness and softness are obtained if fibers having a different shrinkability are combined in usual inter-fiber composites (blends of fibers). However, as to aliphatic polyester fibers having a spontaneous degradability, a manner of controlling the shrinkability has been scarcely known so far and, of course, it is not known at all to conjugate fibers having a different shrinkability and to improve the quality of knitted fabrics and woven fabrics by using it.

Also, in order to obtain a fiber having a high softness and various functions based on a special shape of section and a large surface area, it has been conventionally practiced to divide a dividable conjugated fiber. By this method, there have been developed and widely used knitted and woven fabrics, non-woven fabric, artificial leather, artificial suede, high performance wiping cloth, high performance filter and so on. However, in the field of degradable fibers in natural environment, no dividable conjugated fiber has been proposed. The reason is that combination of spinning materials (polymers) suitable for division and how to divide have not yet been known.

A self-adhesive (melt-adhesive) fiber that a part of a fiber melts by heating to adhere fibers to each other, has been widely used in the field of synthetic fibers. Melt-adhesive fibers using an aliphatic polyester are proposed in Japanese Patent Publications Kokai No. 6-207320 and Kokai No. 6-207324. However, in working examples thereof, a conjugated fiber composed of a sheath (adhesive component) of a polyethylene succinate having a melting point of 102° C. and a core (strength-retaining component) of a polybutylene succinate having a melting point of 118° C. is only disclosed, and the adhesive strength thereof is not so strong. The reason is that the difference in melting point between both components is as small as only 16° C. and the strength-retaining component is softened and deteriorated by heating for adhesion. Also, the optimum temperature for adhesion treatment of this fiber is limited within a very narrow range, so it is very difficult to exhibit desired adhesive force and strength. It is also very difficult to alter the adhesive strength in a wide range according to the purposes, so the uses are limited. In general, a low-melting component has been used for the adhesive component of melt-adhesive fibers. However, if a low-melting aliphatic polyester having a melting point of not more than 120° C. is used, the glass transition temperature is lower than ordinary temperature, so the solidifying rate is slow and, therefore, there arise many problems in practical use such that fibers are easy to stick to each other at the time of melt-spinning, so not only production at a high speed is difficult, but also the heat resistance in use is low.

An object of the present invention is to provide a spontaneously degradable fiber excellent in bulkiness, softness, feeling and stretchability, and textile goods prepared therefrom.

A further object of the present invention is to provide a spontaneously degradable fiber having a self-crimpability.

A still further object of the present invention is to provide a self-crimpable fiber which is spontaneously degradable, which reveals an excellent crimp by heating or the like so as to be able to provide goods excellent in softness, bulkiness and stretchability and, moreover, which can be easily prepared in high efficiency.

Another object of the present invention is to provide a conjugated fiber which is spontaneously degradable, which has an improved dividability and which can provide fibers and fiber structures having an excellent softness and a large surface area.

A still another object of the present invention is to provide a self-adhesive fiber which is spontaneously degradable, which exhibits an excellent adhesion property by heat treatment for adhesion and, moreover, has an excellent strength because of less deterioration of a strength-retaining component, which can be prepared by melt-spinning at a high velocity, and which can easily produce adhesive fiber structures having an excellent heat resistance, and to provide a fiber structure using it.

A further object of the present invention is to provide a self-adhesive fiber which is spontaneously degradable and which can be subjected to adhesion treatment within a wide temperature range and can widely alter the adhesive strength according to the purposes.

A still further object of the present invention is to provide a fibrous bulk material which is spontaneously degradable and is composed of a mixture of a plurality of fibers which show a different shrinkability by heating or the like, thus producing a difference in length between the fibers by heating, and accordingly which can provide goods excellent in bulkiness, softness and feeling.

DISCLOSURE OF THE INVENTION

As a result of repeating intensive study, the present inventors have found that the above objects can be achieved by combining spontaneously degradable aliphatic polyesters having different thermal properties such as heat absorption amount in melting (the heat of fusion), melting point and the like, thus having accomplished the present invention.

Thus, the present invention provides a fiber comprising (A) a fiber component comprising an aliphatic polyester having a melting point of at least 100° C. and a heat of fusion of at least 30 J/g and (B) a fiber component comprising an aliphatic polyester having a melting point of at least 100° C. and a heat of fusion lower than that of said polyester (A) by at least 5 J/g. In the present invention, the fiber comprising the fiber components (A) and (B) may be in the form of a conjugated fiber wherein the components (A) and (B) are conjugated in a single filament, or in the form of a composite yarn wherein fibers of respective components are blended. Since this fiber comprises (A) high crystalline component having a high heat of fusion and (B) low crystalline component having a low heat of fusion, it has excellent bulkiness, softness and feeling based on a difference in heat shrinkability and, in particular, the fiber formed in the form of a conjugated fiber exhibits an excellent self-crimpability and provides a fiber excellent in stretchability.

Further, the present invention provides a fiber comprising (A) a fiber component comprising a crystalline aliphatic polyester having a melting point of at least 140° C. and (B) a fiber component comprising a combination of (H) a component comprising a crystalline aliphatic polyester having a melting point of at least 110° C. and (S) a component comprising a crystalline aliphatic polyester having a melting point which is not more than 120° C. and is lower than that of said polyester (A) by at least 10° C. or a non-crystalline aliphatic polyester having a glass transition temperature of at most 30° C. The aliphatic polyester components (H) and (S) in the fiber component (B) of this fiber may be in the form of a block copolymer of the both components or a mixture of the both components. This fiber has excellent bulkiness, softness and feeling, since it comprises the fiber component (A) comprising a high-melting polymer having a low heat shrinkability and the fiber component (B) containing a low-melting or non-crystalline component (S) which greatly contributes to heat shrinkability. In particular, a conjugated fiber wherein (A) a crystalline aliphatic polyester having a melting point of at least 140° C. and a heat of fusion of at least 20 J/g is eccentrically conjugated in a single filament with (B) a block copolymer and/or mixture of at least two crystalline aliphatic polyesters (H) and (S), the difference in melting point between them being at least 20° C., which contains 90 to 10% by weight of the high-melting component (H) having a melting point of at least 130° C. and a heat of fusion of at least 3 J/g and 10 to 90% by weight of the low-melting component (S) having a melting point of 40 to 120° C. and a heat of fusion of at least 3 J/g, has an excellent self-crimpability. Also, the conjugated fiber wherein the component (B) is conjugated so as to form at least a part of the surface of the fiber, has an excellent self-adhesive property. Further, a spontaneously degradable conjugated fiber which is easily degradable is obtained by conjugating (A) a crystalline aliphatic polyester having a melting point of at least 140° C. with (B) a block copolymer and/or mixture of a crystalline aliphatic polyester component (H) having a melting point of at least 140° C. and an aliphatic polyester component (S) having a melting point of at most 120° C. and a glass transition temperature of at most 30° C. in a single filament into a dividable shape. Also, in case that the fiber component (B) is a block copolymer, the crystalline aliphatic polyester component (H) having a melting point of at least 110° C. may contain urethane bonds.

Also, the present invention provides a conjugated fiber wherein (A) a crystalline aliphatic polyester having a melting point of at least 140° C. is conjugated in a single filament with (B) a composition comprising an aliphatic polyester and 1 to 50% by weight of at least one compound selected from the group consisting of a polyether having a $C_2$ to $C_4$ alkylene group, its derivatives, an organic compound having a sulfo group, an organic compound having sulfate group, an organic compound having carboxyl group, an organic compound having phosphate group and an organic compound having amino group and/or amido group, and in the cross section thereof the composition (B) divides the polymer (A) into at least two portions. This conjugated fiber is subject to hydrolysis and can be easily divided, since the component (B) contains a specific hydrophilic compound.

Further, the present invention provides a yarn, a staple, a cotton, a tow, a web, a knitted fabric, a woven fabric, a non-woven fabric and a fibrous bulk material analogous thereto wherein (X) a core-sheath conjugated fiber having a sheath of (A) a crystalline aliphatic polyester having a melting point of at least 140° C. and a core of (C) a polymer containing at least 10% by weight of (B) an aliphatic polyester having a melting point lower than that of the polymer (A) by at least 20° C. is blended with (Y) a spontaneously degradable fiber other than the fiber (X).

BRIEF DESCRIPTION OF DRAWINGS

FIG. 1 is cross sectional views showing various embodiments of a conjugated fiber according to the present invention, wherein

FIG. 2 is cross sectional views showing various embodiments of a composite yarn comprising two kinds of fibers according to the present invention, wherein

FIG. 3 is cross sectional views showing various embodiments of a dividable conjugated fiber according to the present invention, wherein FIG. 31 shows a hollow radial type conjugated fiber.

FIG. 4 is cross sectional views showing various embodiments of a self-adhesive conjugated fiber according to the present invention, wherein

FIG. 5 is cross sectional views of a core-sheath conjugated fiber which constitutes a fibrous bulk material of the present invention, wherein

FIG. 6 is cross sectional views of a yarn composed of a mixture of plural kinds of filaments having different shrinkabilities, which is an embodiment of a fibrous bulk material of the present invention, wherein

BEST MODE FOR CARRYING OUT THE INVENTION

Herein the aliphatic polyester is those containing, as a main component, namely in an amount of at least 50% by weight (preferably at least 60% by weight, more preferably at least 70% by weight), components derived from the raw materials of the aliphatic polyester, e.g., (1) a hydroxyalkyl carboxylic acid such as glycolic acid, lactic acid or hydroxybutyl carboxylic acid, (2) an aliphatic lactone such as glycolide, lactide, butyrolactone or caprolactone, (3) an aliphatic diol such as ethylene glycol, propylene glycol, butanediol or hexanediol, (4) a polyalkylene glycol such as an oligomer of a polyalkylene ether such as diethyelene glycol, triethylene glycol, ethylene/propylene glycol or dihydroxyethylbutane, polyethylene glycol, polypropylene glycol or polybutylene glycol, (5) a polyalkylene carbonate glycol such as polypropylene carbonate, polybutylene carbonate, polyhexane carbonate, polyoctane carbonate or polydecane carbonate, and oligomers thereof, and (6) an aliphatic dicarboxylic acid such as succinic acid, adipic acid, suberic acid, azelaic acid, sebacic acid or decanedicarboxylic acid, and it encompasses all of homopolymers of an aliphatic polyester, block or random copolymers of aliphatic polyesters, and block or random copolymers of or mixtures of aliphatic polyesters and at most 50% by weight of other components such as an aromatic polyester, a polyether, a polycarbonate, a polyamide, a polyurea, a polyurethane and a polyorganosiloxane.

The modification of the aliphatic polyester by copolymerization or mixing is conducted for the purpose of decreasing the crystallinity and the melting point (decreasing the polymerization temperature or molding temperature), improvement of friction coefficient, softness or elasticity restoration, decreasing or increasing of heat resistance, glass transition temperature or heat shrinkability, improvement of dyability, hydrophilicity or water repellency, improvement or control of degradability and the like.

Figure 7:
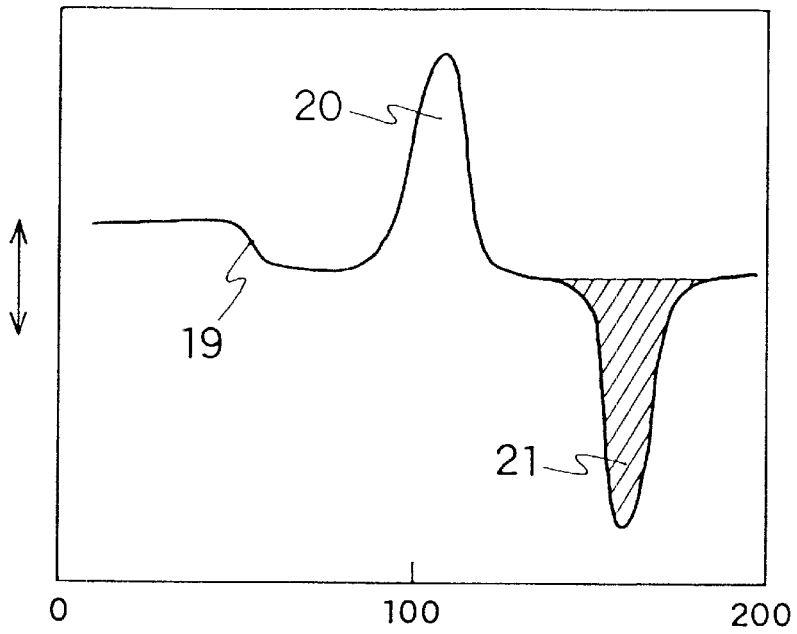
FIG. 7 is a fusion curve (DSC curve) showing heat exhaustion and heat absorption of a polymer at the temperature elevation, obtained by a differential scanning calorimeter (DSC)

Herein, the amount of heat absorption in melting (heat of fusion) is a value measured by a differential scanning calorimeter (hereinafter referred to as DSC) in a nitrogen at a temperature elevation rate of 10° C./minute with respect to about 10 mg of a sample of thoroughly drawn, heat treated and dried yarm. A typical DSC curve is shown in FIG. 7. The figure shows an example of measurement of a sample which is scarcely crystallized, and numeral 19 shows a change of base line by glass transition, numeral 20 shows a peak of heat exhaustion owing to crystallization by heating at the time of the measurement, and numeral 21 shows a peak of heat absorption owing to fusion of crystals. In case of a sufficiently crystallized sample, the heat generation peak 20 disappears and is not observed. In the present invention, the temperature corresponding to the minimum value (central value) of the heat absorption peak 21 based on fusion of crystals is defined as the melting point, and the total heat absorption amount (integral value, proportional to the area of the oblique line area in FIG. 7) of the heat absorption peak 21 is defined as the heat of fusion. The unit of the heat of fusion is J/g. In case that a plurality of melting points are present with respect to a mixture, a block copolymer and the like, the highest temperature is defined as the melting point (in the present invention), provided that if the heat of fusion of a peak for the highest temperature is negligibly small, e.g., about 2 J/g or less, and a main peak of a large heat of fusion, e.g., 20 J/g or more, is present on the lower temperature side, there is a case that substantial melting point (temperature at which a polymer is extremely softened and starts to flow) is regarded as being based on that main peak. Also, the heat of fusion is defined as the total of all heat absorption peaks.

Firstly, an explanation is made with respect to a fiber (I) comprising (A) a fiber component comprising an aliphatic polyester having a melting point of not less than 100° C. and a heat of fusion of not less than 30 J/g and (B) a fiber component comprising an aliphatic polyester having a melting point of not less than 100° C. and a heat of fusion lower than that of the polyester (A) by at least 5 J/g.

The fiber (I) may be in the form of a conjugated fiber wherein the components (A) and (B) are conjugated in a single filament, or may be in the form of a composite yarn wherein a fiber of the component (A) and a fiber of the component (B) are mixed.

In the conjugated fiber (I) of the present invention, two constituent polymers of a polymer (A1) having a large heat of fusion and a polymer (B1) having a small heat of fusion are conjugated.

The polymer (A1) is a component having a high crystallinity and a low heat shrinkability. As the polymer (A1) are preferred crystalline homopolymers and those incorporated with a second component, a third component and the like in such a small amount that the crystallinity is not so impaired (for example, at most about 40% by weight, especially at most 30% by weight) by means of copolymerization and/or mixing. From the viewpoints of crimpability, strength and heat resistance of the fiber of the present invention, it is necessary that the heat of fusion of the polymer (A1) is not less than 30 J/g, and it is preferably not less than 35 J/g, more preferably not less than 40 J/g. In many cases, the heat of fusion of crystalline aliphatic polyester homopolymers is around 50 J/g. Similarly, from the viewpoint of practical use, it is necessary that the melting point of the polymer (A1) is not less than 100° C., preferably the melting point is not less than 110° C., especially not less than 130° C., more especially not less than 140° C., most especially not less than 150° C.

Preferable examples of the polymer (A1) are homopolymers such as polybutylene succinate (melting point about 116° C.), poly-L-lactic acid (m.p. 175° C.), poly-D-lactic acid (m.p. 175° C.), polyhydroxybutyrate (m.p. 180° C.) and polyglycolic acid (m.p. 230° C.), copolymers or mixtures thereof with a small amount of other component, and mixtures thereof. In case of the block copolymers, the changes in crystallinity and melting point are mild, so preferably the content of the comonomer component is at most 50%, especially 1 to 40%, and in many cases, 1 to 30%. In case of the random copolymers, the changes in crystallinity and melting point are marked, so preferably the content of the comonomer component is from 0.5 to 10%, especially 1 to 5%. Of course, since the changes in crystallinity and melting point by copolymerization vary depending on the kinds of comonomer component, it is necessary to pay attention to the heat of fusion of crystals and the melting point based on DSC. The changes in crystallinity and melting point by mixing with other component also vary depending on the kinds of component incorporated and the mixing ratio, but generally it is not so marked as the random copolymerization. The amount of the other components used for copolymerization or mixing is selected within the above-mentioned ranges so as not to impair the objects of the present invention. Examples of the other components are, for instance, aliphatic polyesters, e.g., polycaprolactones and polyesters derived from an aliphatic glycol such as ethylene glycol or octanediol and an aliphatic dicarboxylic acid such as succinic acid or decanedicarboxylic acid, aromatic polyesters, polyethers, polycarbonates, polyamides, polyureas, polyurethanes, polyorganosiloxanes, and raw materials for these polymers.

The polymer (B1) is a component having a low crystallinity and a high heat shrinkability. As the polymers suitable for the polymer (B1), there are mentioned aliphatic polyesters modified to lower the heat of fusion of crystals by means of copolymerization or mixing. It is necessary that the difference in heat of fusion between the polymer (A1) and the polymer (B1) is at least 5 J/g, and for high crimp, preferably the difference is at least 10 J/g, especially at least 15 J/g. The heat of fusion of 5 J/g corresponds to about 10% of the heat of fusion of crystalline aliphatic homopolyesters. That is to say, the degree of crystallinity of the polymer (B1) is approximately 90% or less of that of the polymer (A1).

In general, a strong crimp is preferred for knitted goods which require a high stretchability, but there are cases that a crimp controlled to some extent is preferred for imparting softness, bulkiness and desired feeling to woven fabric. Thus, the polymer (B1) can be selected according to the purposes. Also, from the viewpoint of practical use, it is necessary that the melting point of the polymer (B1) is not less than 100° C., and preferably the melting point is not less than 110° C., especially not less than 130° C., more especially not less than 135° C. Such polymers having a relatively high melting point are, for instance, mixtures and copolymers (block copolymers and random copolymers) containing the above-mentioned homopolymers with high melting point as the main component (not less than 50% by weight). The component used for the copolymerization or mixing with the homopolymers with high melting point such as polybutylene succinate, polylactic acid, polyhydroxybutyrate and polyglycolic acid can be suitably selected from the raw materials for the preparation of the above-mentioned aliphatic polyesters.

Preferable examples of the component used for the block copolymerization or mixing with the homopolymers are aliphatic polyesters having a glass transition temperature of not more than ordinary temperature, especially not more than 0° C., for example, a polycaprolactone; and a polyester produced from a combination of at least one aliphatic glycol such as ethylene glycol, propylene glycol, butanediol, hexanediol, octanediol, diethylene glycol or triethylene glycol and at least one aliphatic dicarboxylic acid such as succinic acid, adipic acid, sebacic acid, octanedicarboxylic acid or decanedicarboxylic acid, e.g., polyethylene succinate, polybutylene succinate, polyethylene adipate, polybutylene adipate, polyethylene sebacate or polybutylene sebacate.

The polymer (B1) is required to be low crystalline as mentioned above. The most effective manner of decreasing the crystallinity is random copolymerization. Examples of the cases that random copolymerization can be easily made are mixing of optical isomers, different hydroxycarboxylic acids, or different lactones, e.g., L-lactic acid/D-lactic acid, L-lactide (LL-lactide)/D-lactide (DD-lactide, DL-lactide), lactic acid/glycolic acid, lactide/glycolide, and lactide/caprolactone; and copolymerization of at least two of a hydroxycarboxylic acid, a glycol, a dicarboxylic acid and the like. Further, mixtures of the random copolymers with the above-mentioned block copolymers or different kinds of polymers are also preferable. The different kinds of polymers include, for instance, aromatic polyesters, polyethers, polycarbonates, polyamides, polyureas, polyurethanes, polyorganosiloxanes and so on.

The polymer (B1) must not be crystalline. In case of being non-crystalline, the melting point denotes the temperature at which the melt viscosity becomes 100,000 poises.

The conjugated structure of the polymers (A1) and (B1) must be eccentric. The eccentric means a relationship that, in the cross section, the center of gravity of the polymer (A1) does not coincide with that of the polymer (B1). The larger the distance between the both centers of gravity, the higher the eccentricity and the higher the crimpability. Various eccentric conjugated structures can be selected according to the desired crimpability.

Figure 1A:
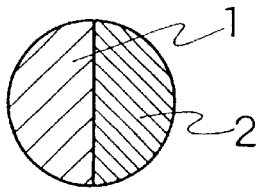
FIG. 1A shows a parallel type conjugated fiber.
Figure 1B:
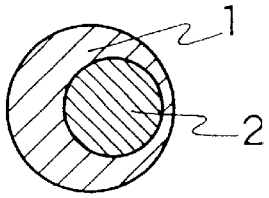
FIG. 1B shows an eccentric core-sheath type conjugated fiber.
Figure 1C:
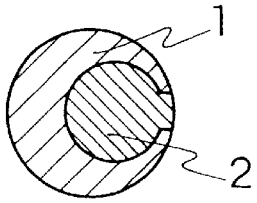
FIG. 1C shows a key hole type conjugated fiber.
Figure 1D:
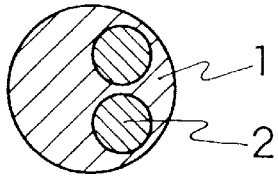
FIG. 1D shows an eccentric double core type core-sheath conjugated fiber.
Figure 1E:
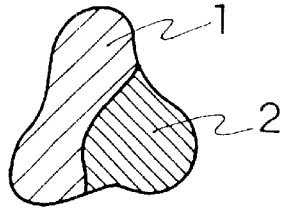
FIG. 1E shows a non-circular parallel type conjugated fiber.
Figure 1F:
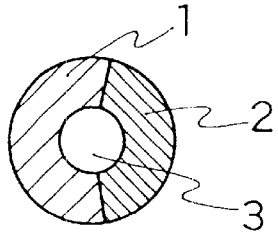
FIG. 1F shows a hollow parallel type conjugated fiber.
Figure 1G:
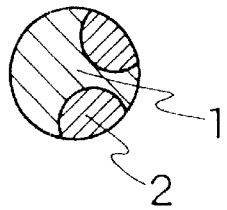
FIG. 1G shows a three-layered parallel type conjugated fiber.

FIGS. 1A to 1G are cross sectional views of conjugated fibers showing preferable embodiments of the conjugation structure according to the present invention. In the figures, 1 denotes the polymer (A1), 2 denotes the polymer (B1), and 3 denotes a hollow portion. FIG. 1A shows a parallel type conjugated fiber and an example of high eccentricity. FIG. 1B shows an eccentric core-sheath type conjugated fiber and an example of low eccentricity. FIG. 1C shows a key hole type conjugated fiber, FIG. 1D shows an eccentric double core type conjugated fiber, FIG. 1E shows a non-circular parallel type conjugated fiber, FIG. 1F shows a hollow parallel type conjugated fiber, and FIG. 1G shows a three-layered parallel type conjugated fiber. Any other conjugation structures than FIGS. 1A to 1G are applicable to the present invention so long as the both components are eccentrically disposed. Also, the polymers (A1) and (B1) can be conjugated with a third component. For example, a third polymer component may be disposed in the hollow portion shown in FIG. 1F.

The conjugated ratio (sectional area ratio) of the polymer (A1) and the polymer (B1) is not particularly limited, and is suitably selected according to the purposes. In general, the crimpability is the highest when the conjugated ratio is 1/1, and it decreases as the conjugated ratio departs from 1/1. In many cases, it is preferable that the conjugated ratio is from 1/10 to 10/1, especially from 1/5 to 5/1, more especially from 1/3 to 3/1.

The difference in shrinkage (%) between the polymer (A1) and the polymer (B1) when formed into a fiber is not particularly limited, but usually the difference is at least 3%, preferably 5 to 70%, more preferably about 10 to about 50%.

The polymers (A1) and (B1) are often desired to have a high mutual adhesion property, but even if they are poor in the adhesion property, separation thereof can be prevented when formed into a core-sheath type. For example, it is also possible to obtain articles of a fine and soft fiber having a non-circular section by conjugating components having a weak adhesion into a parallel type and, after forming into knitted or woven fabrics, separating the both components. In this case, too, the effect of combining different kinds of filaments based on the difference in shrinkability between the both components imparts a desirable feeling to the articles. The shape of the section of the conjugated fiber (I) of the present invention can be suitably selected, e.g., circle, ellipse, gourd shape, polygon, multi-blade, alphabet shapes, and other various non-circular shapes (modified sections) and hollow shapes. Similarly, the fineness is suitably selected according to the purposes. In case of the fibers for usual clothes, the fineness of a filament is from about 0.1 to about 50 deniers (d), preferably from 0.5 to 30 d. The thinner or thicker fibers are adaptable for non-woven fabrics, leathers and materials.

The conjugated fiber of the present invention can be prepared by multi-component fiber spinning of the polymers (A1) and (B1) such as melt spinning, wet spinning, dry spinning, dry-wet spinning and other methods. Melt spinning is particularly preferred since the efficiency is high. The melt spinning can be performed by a low speed spinning at a taking-up speed of 500 to 2,000 m/minute, a high speed spinning at a taking-up speed of 2,000 to 5,000 m/minute, and a ultra-high speed spinning at a taking-up speed of not less than 5,000 m/minute. As occasion demands, drawing and heat treatment can be conducted. In general, the drawing is conducted at a drawing ratio of about 3 to about 6 in a low speed spinning, and at a drawing ratio of about 1.5 to about 2.5 in a high speed spinning, and the drawing is not conducted or is conducted at a drawing ratio of about 2 or less in a ultra-high speed spinning. A so-called spin-draw method wherein the spinning and the drawing are conducted continuously (one step spinning and drawing method) is also suitably adoptable.

Also are adoptable methods such as a melt blown method wherein formation of non-woven fabric is conducted simultaneously with spinning out polymers (A1) and (B1) from an orifice, a flash spinning method and a Spun-Bond method.

The conjugated fiber of the present invention can be formed into a suitable form according to the purposes, such as continuous filament, mono-filament, multi-filament, staple and the like. Also, during steps for the preparation of fibers or yarns, or after forming into fiber structures such as knitted fabrics, woven fabrics and non-woven fabrics, it is possible to perform self-crimping by shrinking through heating or swelling. Of course, after mechanically imparting a crimpability by false twist method or staffing box method, as occasion demands, it is possible to perform self-crimping by heating. For example, the self-crimping can be widely performed in the dyeing step. The heating is carried out by dry heating, wet heating, infrared rays and other suitable means. In general, self-crimping is carried out under relaxation, but it is possible to control the crimping by applying an excess tension. The required strength of crimp is varied depending on the purposes and, therefore, is not particularly limited. In many cases, the crimp elongation is preferably at least 50%, more preferably at least 100%, most preferably at least 150%, and a range of about 100 to about 600% is widely adopted.

The composite yarn (I) of the present invention is an inter-fiber composite wherein a fiber (A) comprising a polymer (A1) having a large heat of fusion and a fiber (B) comprising a polymer (B1) having a small heat of fusion are blended.

Representative examples of the composite yarn of the present invention are a mixed filament (hereinafter referred to as "combined filament yarn"), a long/short composite yarn wherein a continuous filament and a staple are combined, and a blended yarn wherein plural kinds of staples are blended and spun. In these inter-fiber composites (fiber blends), it is known that goods such as knitted and woven fabrics excellent in bulkiness and softness are obtained if fibers having a different shrinkability are combined. However, as to aliphatic polyester fibers, a manner of controlling the shrinkability has been scarcely known so far and, of course, it is not known at all to conjugate fibers having a different shrinkability and to improve the quality of knitted fabrics and woven fabrics by using it. As a result of making intensive study about improvement in quality of knitted and woven fabrics of aliphatic polyester fibers, the present inventors have found that a fiber (A) comprising a polymer (A1) having a large heat of fusion is able to make the heat shrinkability small, and a fiber (B) comprising a polymer (B1) having a small heat of fusion is able to make the heat shrinkability large, thus excellent fiber structures can be obtained by combining the both fibers. In particular, goods having an excellent feeling are obtained based on difference in shrinkability between the fiber (A) and the fiber (B).

The polymer constituting the fiber (A) of the composite yarn (I) is a component having a large heat of fusion and a small heat shrinkability, and the same polymers as the above-mentioned polymer (A1) are used therefor.

The polymer constituting the fiber (B) of the composite yarn (I) is a low-crystalline component having a small heat of fusion and a large heat shrinkability, and the same polymers as the above-mentioned polymer (B1) are used therefor. The difference in heat of fusion between the polymer (A1) and the polymer (B1) is required to be at least 5 J/g for obtaining articles having a good feeling based on a sufficient difference in shrinkability. The difference is preferably at least 10 J/g, more preferably at least 15 J/g, most preferably at least 20 J/g. In general, a combination of fibers a difference in shrinkability of which is large (e.g., 20 to 50%), is preferred for knitted and woven fabrics which require high bulkiness, stretchability and softness, but there are cases that a smaller difference in shrinkability (5 to 20%) is preferred for imparting a bulkiness controlled to some extent and a desirable feeling. Thus, the polymer (B1) can be selected according to the purposes. Also, from the viewpoint of practical use, the melting point of the polymer (B1) is required to be not less than 100° C., and the melting point is preferably not less than 110° C., more preferably not less than 130° C., most preferably not less than 135° C.

The polymers (A1) and (B1) are separately formed into fibers and, if necessary, are subjected to molecular orientation through drawing, heat treatment or the like, thus giving the fibers (A) and (B). The fibers (A) and (B) are blended by various means to give the composite yarn (blended fiber product) of the present invention. The blending manner is not particularly limited, but in the case that the fibers (A) and (B) both are filaments, there are preferably adopted spinning blending wherein filaments are simultaneously spun from a single or adjacent spinnerets and taken-up, air blending wherein filaments are separately spun and an air nozzle is applied thereto, and simple yarn doubling, doubling and twisting, combined filament false twist (composite false twist), and the like. In case that one of the fibers (A) and (B) is a filament and the other is a staple, a so-called core spinning method wherein a filament is fed to a spinning step is applicable. In case that the fibers (A) and (B) both are a staple, a blended yarn is easily obtained by usual method such as fiber blending, sliver blending or web blending.

Figure 2A:
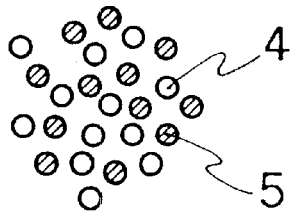
FIG. 2A shows a composite yarn that two kinds of fibers having a circular section are uniformly mixed.
Figure 2D:
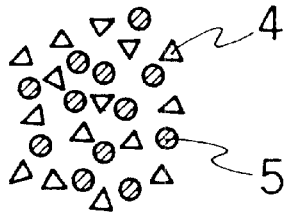
FIG. 2D shows a composite yarn that a fiber having a triangular section and a fiber having a circular section are uniformly mixed.
Figure 2B:
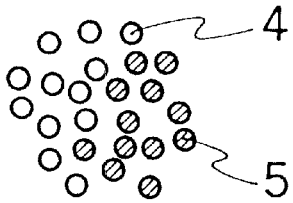
FIG. 2B shows a composite yarn that two kinds of fibers having a circular section are eccentrically non-uniformly mixed.
Figure 2E:
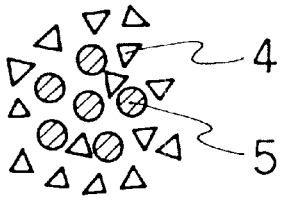
FIG. 2E shows a composite yarn that a fiber having triangular section and a fiber having a circular section are concentrically non-uniformly mixed.
Figure 2C:
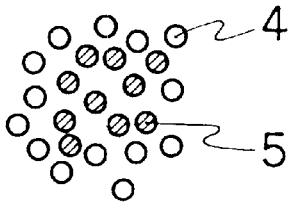
FIG. 2C shows a composite yarn that two kinds of fibers having a circular section are concentrically non-uniformly mixed.
Figure 2F:
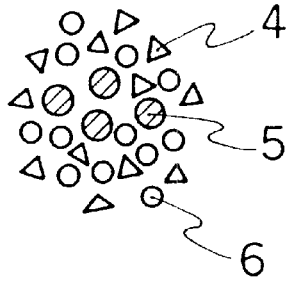
FIG. 2F shows a composite yarn that a fiber having a triangular section, a fiber having a circular section and a third fiber are mixed.

FIGS. 2A to 2F are cross sectional views showing examples of a combined filament yarn, core-spun yarn (long fiber/short fiber composite yarn) and a blended yarn. In the figures, 4 denotes the fiber (A), 5 denotes the fiber (B), and 6 denotes other fiber (C). FIG. 2A shows an example that 12 filaments of the fiber (A) having a circular cross section and 12 filaments of the fiber (B) having a circular cross section are relatively uniformly blended. FIG. 2B shows an example that 12 filaments of the fiber (A) having a circular cross section and 12 filaments of the fiber (B) having a circular cross section are disposed eccentrically (in the state that the respective centers of gravity are apart). FIG. 2C shows an example that 10 filaments of the fiber (B) having a circular cross section are disposed inside and 14 filaments of the fiber (A) having a circular cross section are concentrically disposed outside the fiber (B). FIG. 2D shows an example that 12 filaments of the fiber (B) having a circular cross section and 15 filaments of the fiber (A) having a triangular cross section are almost uniformly disposed. FIG. 2E shows an example that 6 filaments of relatively thick fiber (B) and 15 filaments of relatively thin fiber (A) having a triangular cross section are disposed in a core-sheath fashion. FIG. 2F shows an example that 4 filaments of relatively thick fiber (B) and 12 filaments of thin fiber (A) having a triangular cross section are blended with 12 filaments of other fiber (C) having a circular cross section. In the present invention, the cross sectional shape of fiber, fineness, blending ratio (by weight) of the fibers (A) and (B) and the like can be suitably selected without particular restriction. The blending ratio of the fibers (A) and (B) is selected according to the desired articles, but is from 10/1 to 1/10, preferably 5/1 to 1/5, more preferably 3/1 to 1/3, most preferably 2/1 to 1/2. The state of composite (blending) of the fibers (A) and (B) is not particularly limited, but the following three are basic and are often preferred and widely used, i.e., uniform and random disposition of the fibers (A) and (B) as shown in FIG. 2A, eccentric disposition as shown in FIG. 2B, and core-sheath or concentric disposition as shown in FIG. 2C. Also, other fiber (C) may be blended as shown in FIG. 2F. As the other fiber (C) are particularly preferred spontaneously degradable wool, cotton and aliphatic polyesters. In case of dress, blouse, under wear, lining cloth, coat and other light weight or medium weight woven and knitted fabrics which particularly require a softness, a process for weight reduction by alkali treatment has been conventionally carried out in a dye finishing step by treating a cloth of a polyester fiber with a strong alkali (aqueous solution of sodium hydroxide) to degrade and remove a part (e.g., 5 to 50%, especially 10 to 30%) of the polymer. The alkali weight reduction processing is also applicable to aliphatic polyester fibers. However, in general the aliphatic polyester fibers are very sensitive to an alkali, and the weight reduction processing is carried out under milder conditions (low alkali concentration, low pH, low temperature and the like) than conventional aromatic polyester fibers. In case of the alkali weight reduction processing of knitted and woven fabrics of the composite yarns of the present invention, the fiber (B) tends to have a higher speed of alkali weight reduction than the fiber (A). Therefore, if an alkali weight reduction is planned, it is desirable to make the filament (average) fineness of the fiber (B) larger than the fiber (A) in accordance with the weight reduction speeds, for example, by at least 10%, especially about 20 to about 400% (5 times). Another method for this purpose is to form the fibers such that the fiber (B) is formed to have a circular or analogous cross section so as to have a small surface area per unit weight, whereas the fiber (A) is formed into a polygonal or multi-blade shape having a lager surface area than the fiber (B) by at least 10%, especially about 20 to about 400% (5 times). Thus, it is desirable to pay attention so that the fibers (A) and (B) after the alkali weight reduction processing have adequate fineness and blending ratio. Of course, the above two methods may be combined. The aliphatic polyester fibers have the great advantage that a bad influence of the alkali weight reduction processing on environment is very small, since the consumption of an alkali is small and the resulting degradation products (lactic acid, etc.) can be easily degraded by microorganisms.

Difference in boiling water shrinkage percentage (when treated for 10 minutes in boiling water under unloaded condition followed by air drying at room temperature) between the fiber (A) and the fiber (B) is not particularly limited, but the difference is usually at least 3% and preferably from about 5 to about 50%, and a difference within the range of about 10 to 40% is the most widely used. Thus, the boiling water shrinkage percentage of the fiber (A) is preferably at most 15%, more preferably at most 10%. On the other hand, the boiling water shrinkage percentage of the fiber (B) is preferably at least 15%, more preferably at least 20%, and is often selected within the range of about 30 to about 60%.

The shape of the cross section of the fibers (A) and (B) can be suitably selected, e.g., circle, ellipse, gourd shape, polygon, multi-blade, alphabet shapes, other various non-circular shapes (modified cross sections) and hollow shapes. Similarly, the fineness is suitably selected according to the purposes. In case of the fibers for usual clothes, the fineness of a filament is from about 0.1 to about 50 d, preferably from 0.5 to 30 d, and the fineness within the range of 1 to 20 d is widely used. The thinner or thicker fibers are adaptable for non-woven fabrics, leathers and materials. Each of the fibers (A) and (B) may be a mixture of two or more fibers having different cross section, fineness and shrinkage percentage.

The composite yarn (I) of the present invention can be prepared, using the polymer (A1) and the polymer (B1), by spinning in a manner such as melt spinning, wet spinning, dry spinning, dry-wet spinning and others. Melt spinning is particularly preferred since the efficiency is high. In case of the melt spinning, low speed spinning at a taking-up speed of 500 to 2,000 m/minute, a high speed spinning at a taking-up speed of 2,000 to 5,000 m/minute and a ultra-high speed spinning at a taking-up speed of not less than 5,000 m/minute are possible. As occasion demands, drawing and heat treatment can be further conducted. In general, the drawing is conducted at a drawing ratio of about 3 to about 8 in a low speed spinning, and at a drawing ratio of about 1.5 to about 3 in a high speed spinning, and the drawing is not conducted or is conducted at a drawing ratio of about 2 or less in a ultra-high speed spinning. A so-called spin-draw method wherein the spinning and the drawing is conducted simultaneously is also suitably adoptable. A unique self-extendable yarn that is a fiber prepared at a relatively low drawing ratio and heat-treated at a low temperature and that the fiber whose crystallization and orientation have proceeded extends when heated later at a high temperature, can also be preferably used as the fiber (A).

The composite yarn of the present invention can be formed into a suitable form according to the purposes, such as continuous filament combined yarn, doubling and twisting yarn, composite false twist yarn, blended yarn and analogous yarns, and by using them, knitted fabrics, woven fabrics, non-woven fabrics and other fiber structures can be prepared. During the preparation steps and processing steps thereof or after the preparation, it is possible to produce a difference in shrinkage percentage by suitably heating or swelling the fibers, thereby imparting desirable bulkiness, softness and feeling to articles. The heating can be conducted in a suitable manner such as dry heating, wet heating, infrared rays and a combination thereof. For the swelling, a solvent, swelling agent or water is used. Of course, it is also possible to conduct the heat shrinking after mechanically imparting a crimpability by false twisting or thrusting in the form of yarn. The heat shrinking is also widely conducted, for example, in the dye finishing step of woven and knitted fabrics. In general, the shrinking treatment is conducted in a relaxation state, but it is possible to control the shrinkage by applying an adequate tension.

Next, an explanation is made with respect to a fiber (II) comprising (A) a fiber component comprising a crystalline aliphatic polyester having a melting point of not less than 140° C. and (B) a fiber component comprising a combination of (H) a component comprising a crystalline aliphatic polyester having a melting point of not less than 110° C. and (S) a component comprising a crystalline aliphatic polyester having a melting point which is not more than 120° C. and is lower than that of said polyester (A) by at least 10° C. or a non-crystalline aliphatic polyester having a glass transition temperature of not more than 30° C.

The fiber (II) may be in the form of a conjugated fiber wherein the components (A) and (B) are conjugated in a single filament, or may be in the form of a composite yarn wherein molecular-oriented fibers (A) and (B) of the respective components are blended. Also, the aliphatic polyester components (H) and (S) in the fiber component (B) may be in the form of a block copolymer of the both components bonded or in the form of a mixture of the both components.

The fiber component (A) in the fiber (II) is a component having a low heat shrinkability, and the crystalline aliphatic polyester (A2) used in the fiber component (A) is required to have a melting point of not less than 140° C. The melting point is preferably not less than 150° C., more preferably not less than 160° C., most preferably not less than 170° C. The heat of fusion of the polyester (A2) is desired to be large, and is preferably not less than 20 J/g, more preferably not less than 30 J/g, most preferably not less than 40 J/g. Examples of such high crystalline, high melting aliphatic polyester are homopolymers such as poly-L-lactic acid (melting point about 175° C.), poly-D-lactic acid (m.p. about 175° C.), poly-3-hydroxybutyrate (m.p. 180° C.) and polyglycolic acid (m.p. 230° C.), and copolymers or mixtures thereof with a small amount (at most 50% by weight, especially at most 40% by weight, more especially at most 30% by weight) of other component. The average molecular weight of the polymer (A2) is not particularly limited, but from the practical point of view, it is preferable that the average molecular weight is at least 50,000, especially 70,000 to 300,000, more especially 80,000 to 300,000, still more especially 80,000 to 200,000, most especially 100,000 to 200,000.

In general, in case of block copolymers, the changes in crystallinity and melting point are mild, and accordingly the content of the comonomer component in the polymer (A2) can be from 1 to 50% by weight, especially to 40% by weight, more especially 1 to 30% by weight. In case of random copolymers, the changes in crystallinity and melting point are marked, and accordingly it is generally preferable that the content of the comonomer component is from 0.5 to 20% by weight, especially 0.5 to 10% by weight, more especially 1 to 10% by weight, still more especially 1 to 5% by weight. Of course, since the changes in crystallinity and melting point by copolymerization greatly vary depending on the kind of the comonomer component, it is necessary to pay attention to the heat of fusion of crystals and the melting point based on DSC. The changes in crystallinity and melting point by mixing with other component also vary to a large extent depending on the kind of component incorporated and the mixing ratio, but generally it is not so marked as the random copolymerization. Examples of the other components used in the copolymerization or mixing with the above-mentioned homopolymers are, for instance, aliphatic polyesters as mentioned above, e.g., polycaprolactones and polyesters derived from an aliphatic glycol such as ethylene glycol or octanediol and an aliphatic dicarboxylic acid such as succinic acid or decanedicarboxylic acid, raw materials for these polyesters, aromatic polyesters, polyethers, polycarbonates, polyamides, polyureas, polyurethanes, and polyorganosiloxanes.

One of preferable embodiments of the fiber (II) is a fiber (IIa) comprising (A2) a fiber component comprising a crystalline aliphatic polyester having a melting point of not less than 140° C. and a heat of fusion of not less than 20 J/g and (B2) a fiber component comprising a block copolymer and/or mixture of at least two aliphatic polyesters, the difference in melting point between them being at least 10° C., wherein the block copolymer and/or mixture contains 95 to 10% by weight of a high-melting component (H) having a melting point of not less than 110° C. and a heat of fusion of at least 3 J/g and 5 to 90% by weight of a low-melting component (S) having a melting point of 40 to 120° C. and a heat of fusion of at least 3 J/g.

This fiber (IIa) may be in the form of a conjugated fiber wherein the components (A2) and (B2) are conjugated in a single filament, or may be in the form of a composite yarn wherein fibers (A2) and (B2) of the respective components are blended. An explanation is firstly given below with respect to the preparation of the composite yarn.

The composite yarn (IIa) of the present invention is an inter-fiber composite wherein a low-shrinkable fiber (A2) comprising a high crystalline aliphatic polyester (A2) having a melting point of not less than 140° C. and a heat of fusion of not less than 20 J/g and a high-shrinkable fiber (B2) comprising an aliphatic polyester (B2) containing a high-melting component (H) having a melting point of not less than 110° C. and a low-melting component (S) having a melting point of 40 to 120° C. are blended. Representative examples of the composite yarn of the present invention are a mixed filament (combined filament yarn), a long/short composite yarn wherein a continuous filament and a staple are combined, and a blended yarn wherein plural kinds of staples are blended and spun.

In the composite yarn (IIa), the polymer (A2) is a component which has a high melting point and a high heat of fusion and accordingly has a low heat shrinkability. Preferable examples of the polymer (A2) are crystalline homopolymers, and copolymers and/or mixtures thereof with a second component, a third component and so on in such a small amount (e.g., at most 40% by weight, especially at most 30% by weight) that the crystallinity is not so impaired. From the viewpoints of strength, heat resistance and feeling of goods of the fiber blend (IIa) of the present invention, the polymer (A2) is required to have a heat of fusion of at least 20 J/g, and the heat of fusion is preferably at least 30 J/g, more preferably at least 40 J/g. In general, the heat of fusion of crystalline aliphatic polyester homopolymers is about 50 J/g or more.

The aliphatic polyester (B2) is a block copolymer and/or mixture of at least two aliphatic polyesters (H) and (S) having melting points different from each other by at least 10° C., and contains 95 to 10% by weight of the high-melting component (H) having a melting point of not less than 110° C. and 5 to 90% by weight of the low-melting component (S) having a melting point of 40 to 120° C. The component (H) is a component to maintain the heat resistance of the aliphatic polyester (B2) and is required to have a melting point of not less than 110° C., preferably not less than 120° C., more preferably not less than 140° C. The proportion of the component (H) is from 95 to 10% by weight, preferably 85 to 20% by weight, more preferably 75 to 30% by weight. The component (H) in the aliphatic polyester (B2) is required to have a heat of fusion of at least 3 J/g, and the heat of fusion is preferably at least 5 J/g, more preferably at least 10 J/g, most preferably from 10 to 50 J/g.

The component (S) in the aliphatic polyester (B2) greatly contributes to the heat shrinkability of the fiber (B2) comprising the polyester (B2). The melting point thereof is required to be 40 to 120° C., and is preferably 50 to 110° C., more preferably 60 to 100° C. The proportion of the component (S) in the polyester (B2) is from 5 to 90% by weight, preferably 15 to 80% by weight, more preferably 25 to 70% by weight.

The melting point of the component (S) is required to be lower than the melting point of the component (H) by at least 10° C., and the difference in melting point between them is preferably at least 20° C., more preferably at least 30° C. For example, a fiber of a block copolymer or mixture comprising a combination of the component (H) having a melting point of 160° C. and the component (S) having a melting point of 80° C. greatly shrinks, if treated in boiling water of 100° C., since the component (S) is melted, but the fiber as a whole maintains its shape without being melted since the high-melting component (H) is present. Therefore, the melting points and the proportion of the components (H) and (S) which constitute the polyester (B2) are selected according to the required heat treatment temperature, heat shrinkability and heat resistance. In general, the low-melting component (S) may be low-crystalline, but if the crystallinity is too low, the color fastness of the fiber may be lowered or an adhesive property may generate by heating. Therefore, in general, it is preferable that the component (S) can melt at a temperature of the heat treating step to shrink the fiber (e.g., 80 to 120° C.), but it is in a sufficiently crystallized state at a temperature of use (e.g., below 40° C.). That is to say, in many cases, it is preferable that the component (S) is crystalline and has a melting point of 50 to 110° C., especially 60 to 100° C. The component (S) in the aliphatic polyester (B2) is required to have a heat of fusion of at least 3 J/g, preferably at least 5 J/g, more preferably from 10 to 40 J/g.

The aliphatic polyester (B2) is a block copolymer or a mixture of the main constituent components (H) and (S). An aliphatic polyester having terminal hydroxyl group easily causes an addition reaction (polymerization) thereto of a lactone such as caprolactone, lactide or glycolide in the molten state to produce a block copolymer. It is also possible to react a difunctional compound, e.g., a diisocyanate such as hexanediisocyanate, a dicarboxylic acid anhydride such as phthalic anhydride and a dicarboxylic acid halide such as terephthaloyl chloride, with a mixture of two or more kinds of aliphatic polyesters having terminal hydroxyl group to produce a block copolymer. Further, it is possible to obtain a block copolymer through transesterification by melt-mixing a plurality of aliphatic polyesters. However, a sufficient care is necessary, since if the melt-mixing is conducted in the presence of a catalyst at a too high temperature for a long time, the transesterification reaction excessively proceeds to result in production of a random copolymer.

The mixing of the components (H) and (S) can be performed, for example, by mixing the pellets thereof and then melt-mixing them in a screw extruder, or by mixing separately molten both components in one or a combination of apparatuses such as a twin-screw extruder, other agitation apparatuses and a static mixer wherein separation and confluence of a flow are repeated in multi-stages. In this case too, a care should be paid so as not to make the transesterification reaction excessively proceed. If the mixture or the reaction product is analyzed by DSC and no decrease of melting point and heat of fusion is found, it can be judged that random copolymerization does not so proceed. In order to stably conduct the mixing of the components (H) and (S), it is desirable that the affinity between the both is high. The affinity between the both can be improved, for example, by partially introducing the component (S) into the molecule of the component (H) by means of block copolymerization or the like, or by introducing the component (H) into the component (S), or by incorporating a mixture of the components (H) and (S) with a block copolymer of the both components as an affinity improver (surface active agent).

The aliphatic polyester (B2) is mainly composed of the aliphatic polyester components (H) and (S), but may contain, as a secondary component (at most 50% by weight, especially at most 30% by weight), other components such as aromatic component, polyether component, polycarbonate component, polyurethane component, polyamide component, polyorganosiloxane component and so on. The introduction of these other components can be conducted by means of copolymerization or mixing.

The molecular weight of the aliphatic polyester (B2) is not particularly limited, but preferably it is not less than 50,000, especially 80,000 to 300,000, and it is widely adopted within the range of 100,000 to 200,000.

Examples of the aliphatic polyester suitable for the high-melting component (H) are those exemplified above for the polymer (A2), polybutylene succinate (melting point 116° C.), polyhexamethylene fumarate (melting point 117° C.), and the like.

Examples of the polyester suitable for the low-melting component (S) are, for example, in addition to an aliphatic polylactone such as polycaprolactone (melting point about 59° C.) or polypropiolactone (m.p. 95° C.), polyesters obtained from combinations of at least one aliphatic glycol such as ethylene glycol, propylene glycol, butandiol, hexanediol, octanediol, diethylene glycol or triethylene glycol and at least one aliphatic dicarboxylic acid such as succinic acid, adipic acid, azelaic acid, sebacic acid, octane dicarboxylic acid or decane dicarboxylic acid, e.g., polyethylene adipate (melting point about 49° C.), polyethylene suberate (m.p. 65° C.), polyethylene azelate (m.p. 52° C.), polyethylene sebacate (m.p. 75° C.), polybutylene succinate (m.p. 116° C.), polybutylene adipate (m.p. 72° C.), polybutylene sebacate (m.p. 66° C.), polyhexane sebacate (m.p. 74° C.) and other homopolymers, and block or random copolymers comprising them as the constituent components.

The fiber (A2) and the fiber (B2) are prepared by separately forming the polymer (A2) and the polymer (B2) into fibers, and optionally subjecting to drawing and heat treatment for performing molecular orientation and crystallization. The preparation method of the composite yarn (IIa) from the fibers (A2) and (B2), processing method, requirements of the respective fibers, cross sectional shape of the composite yarn and the other requirements for the yarn (IIa) are the same as the case of the composite yarn (I).

An explanation is given below with respect to a conjugated fiber that, in the fiber (IIa), the components (A2) and (B2) are conjugated in a single filament.

In case of preparing the conjugated fiber (IIa), as the fiber component (B2) to be conjugated with the fiber component (A2) is preferably used a block copolymer and/or a mixture which contains at least two kinds of crystalline aliphatic polyesters (H) and (S), the difference in the melting point of the polyesters (H) and (S) being at least 20° C., and which contains 90 to 10% by weight of a high-melting component (H) having a melting point of not less than 130° C. and a heat of fusion of at least 3 J/g and 10 to 90% by weight of a low-melting component (S) having a melting point of 40 to 120° C. and a heat of fusion of at least 3 J/g. Such components (H) and (S) are selected from the above-mentioned components (H) and (S).

If the fiber components (A2) and (B2) are eccentrically conjugated in a single filament, a conjugated fiber (IIa) excellent in self-crimpability is obtained. If the fiber components (A2) and (B2) are concentrically conjugated in a single filament so that the fiber component (B2) forms a part of the surface of conjugated fiber, a conjugated fiber (IIa) excellent in self-adhesion property is obtained.

Figure 8:
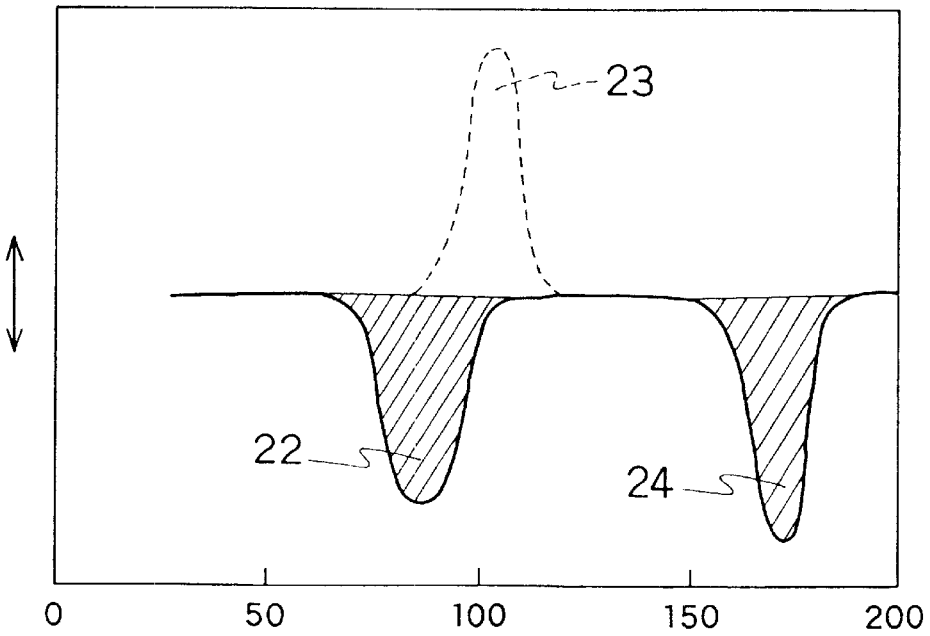
FIG. 8 is a fusion curve (DSC curve) showing heat exhaustion and heat absorption of a block copolymer or mixture of two kinds of crystalline aliphatic polyesters having different melting points at the temperature elevation, obtained by a differential scanning calorimeter (DSC).

FIG. 8 typically shows a DSC curve of an aliphatic polyester (B2) that a plurality of aliphatic polyesters having a melting point difference of at least 20° C. are mixed and/or copolymerized. In the figure, 22 denotes a heat absorption peak based on fusion of the low-melting component (S), and 24 denotes a heat absorption peak based on fusion of the high-melting component (H). Peak 23 (dotted line) is a heat exhaustion peak based on crystallization which is observed when the high-melting component (H) is not sufficiently crystallized. Since the heat absorption peak 22 of the low-melting component (S) cannot be exactly recognized if the heat exhaustion peak 23 overlaps the heat absorption peak 22, it is necessary that the high-melting component (H) has been sufficiently crystallized.

In the present invention, the temperature corresponding to the minimum value of each heat absorption peak (22 and 24 in the figure) based on the fusion of the crystals is defined as the melting point, and the total heat absorption amount (integral value, proportional to the area of the oblique line portion in the figure) of each heat absorption peak is defined as the heat of fusion. The unit of the heat of fusion is J/g. In case that a plurality of melting points (peaks) are present, the highest temperature is defined as the representative value of the melting point. However, if the heat of fusion of a peak for the highest temperature is negligibly small, e.g., about 3 J/g or less, the highest melting point among main peaks having a large heat of fusion is regarded as the representative value.

In general, there are many cases that in DSC curves of mixtures or block copolymers of a plurality of crystalline aliphatic polyesters, heat absorption peaks corresponding to the melting points of respective components are fairly clearly observed. However, in case of block copolymers of a plurality of polymers, there is a case that complicated phenomena such that the respective melting points (temperatures) change, the width of the heat absorption peak increases, or a shoulder or double peaks appear, are observed. If they are not clearly recognized as plural separate peaks, they are regarded as a single peak and the melting point is the value for that peak.

A self-crimpable conjugated fiber (IIa) of the present invention is a fiber wherein (A2) an aliphatic polyester which has a melting point of not less than 140° C. and a heat of fusion of at least 20 J/g and has a high crystallinity is conjugated with (B2) an aliphatic polyester which contains a component (H) with high melting point having a melting point of not less than 130° C. and a component (S) with low melting point having a melting point of 40 to 120° C. The fiber component (A2) is a low-shrinkable component, and the fiber component (B2) is a high-shrinkable component. The components (A2) and (B2) reveals a crimp, since a difference in length between them generates when heated or swelled.

A large feature of this self-crimpable fiber (IIa) resides in that a block copolymer and/or a mixture of at least two kinds of crystalline aliphatic polyesters, the difference in melting point between which is at least 20° C., preferably at least 30° C., is used as the high-shrinkable component (B2). In this fiber (IIa), the component (S) with low melting point which constitutes such an aliphatic polyester strongly shrinks by melting or softening, and the fiber component (B2) as a whole shrinks without melting if heated at a temperature at which the component (H) with high melting point is not melted or softened, thus the fiber (IIa) is crimped. Therefore, the higher the melting point of the component (H) with high melting point in the component (B2), the more preferable, and the melting point is required to be not less than 130° C. and is preferably not less than 140° C., more preferably not less than 150° C., most preferably not less than 160° C. The component (S) with low melting point is in a crystallized state at ordinary temperature and can be melted by an adequate heating (e.g., at a temperature of 50 to 120° C.). The melting point thereof is within the range of 40 to 120° C. In general, polymers with low melting point are slow in solidification velocity in melt spinning and there is a tendency that taken-up yarn sticks to each other, thus spinning becomes difficult. However, in case of the aliphatic polyester (B2), the stickiness is greatly improved as a result of the introduction of the high-melting component (H), so the production becomes easy.

The crimpability of the conjugated fiber can be controlled within a very wide range by changing the proportion of the component (H) with high melting point and the component (S) with low melting point which constitute the aliphatic polyester (B2), the melting point of the component (S) with low melting point, the conjugation ratio of the components (A2) and (B2), the conjugation form, the heating temperature and the like, and an adequate crimp can be selected according to the objects and the uses. That is to say, the conjugated fiber of the present invention has large features that it can be prepared in a high efficiency by a melt spinning method and the crimpability can be controlled and adjusted within a very wide range.

The shrinkage percentage in boiling water of a fiber made of the polymer (A2) alone which is a low-shrinkable component is preferably at most 20%, especially at most 15%, more especially at most 10%, most especially at most 8%. For this purpose, polymers that the degree of modification by copolymerization or mixing is low, are particularly preferred as the polymer (A2), thus preferable are homopolymers and those approximate thereto, e.g., those containing a component incorporated by copolymerization or mixing in an amount of at most 10%, especially at most 6%, more especially at most 3%.

The aliphatic polyester (B2) is a block copolymer and/or a mixture of at least two kinds of crystalline aliphatic polyesters, the difference in melting point between which is at least 20° C., and contains 90 to 10% by weight of a high-melting aliphatic polyester component (H) having a melting point of not less than 130° C. and 10 to 90% by weight of a low-melting aliphatic polyester component (S) having a melting point of 40 to 120° C. The component (S) with low melting point is a component to reveal a shrinkability by heating, and is required to have a melting point of 40 to 120° C. Preferably the melting point is from 50 to 120° C., especially from 60 to 120° C. The weight ratio of the component (H) with high melting point to the component (S) with low melting point in the aliphatic polyester (B2) must be from 9/1 to 1/9 and, in many cases, preferably the weight ratio is from 8/2 to 2/8, especially from 7/3 to 3/7. The heat of fusion of each of the component (H) with high melting point and the component (S) with low melting point in the aliphatic polyester (B2) must be at least 3 J/g, and preferably the heat of fusion is at least 5 J/g, especially at least 10 J/g, more especially from about 10 to about 30 J/g. The reason is that from the viewpoint of prevention of sticking in melt spinning, the aliphatic polyester (B2) is desired to be crystalline.

The difference in melting point between the component (H) with high melting point and the component (S) with low melting point in the aliphatic polyester (B2) is at least 20° C., preferably at least 30° C., more preferably at least 40° C. For example, a block copolymer or mixture comprising a combination of the component (H) having a melting point of 160° C. and the component (S) having a melting point of 80° C. greatly shrinks, if treated at 100° C., since the component (S) is melted, but the fiber component (B2) as a whole maintains its shape without being melted since the crystallized component (H) with high melting point is present.

The shrinkage percentage in boiling water of a fiber made of the polymer (B2) alone is preferably at least 20%, especially from 30 to 60%. The difference in shrinkage percentage between a fiber of the aliphatic polyester (B2) and a fiber of the above-mentioned polymer (A2) is preferably at least 5%, more preferably at least 10%, and is widely adopted within the range of 20 to 50%.

A self-adhesive conjugated fiber (IIa) of the present invention is a fiber wherein an aliphatic polyester (A2) which has a melting point of not less than 140° C. and a heat of fusion of at least 20 J/g and has a high crystallinity is conjugated with an aliphatic polyester (B2) which contains a high-melting component (H) having a melting point of not less than 130° C. and a low-melting component (S) having a melting point of 40 to 120° C. The fiber component (A2) is a strength-retaining component, and the fiber component (B2) is an adhesive (melt-adhesive) component.

A large feature of this self-adhesive fiber (IIa) resides in that a block copolymer and/or a mixture of at least two kinds of crystalline aliphatic polyesters, the difference in melting point between which is at least 20° C., preferably at least 30° C., is used as the adhesive component (B2). In this fiber (IIa), if heated to a temperature at which the component with low melting point which constitutes such an aliphatic polyester (B2) adheres but the component with high melting point does not adhere, articles which are relatively low in density of adhering points and adhesive strength and, on the other hand, if heated to a temperature at which the all components which constitutes the aliphatic polyester (B2) are melted, the highest adhesive strength and the highest density of adhering points are obtained. Also, sticking in melt spinning caused by a component having a low melting point and a low glass transition temperature is greatly improved by introduction of the high-melting point component into the aliphatic polyester (B2). Further, the solidifying property in melt spinning and the adhesive strength and density of adhering points in heat adhesion can be changed in a wide range by changing the proportion of the high-melting and low-melting components of the aliphatic polyester (B2). As a result, the fiber (IIa) of the present invention shows large features that the production is possible in a high efficiency and the control and adjustment of adhesive strength is possible within a very wide range.

The aliphatic polyester (B2) is a block copolymer and/or a mixture of at least two kinds of crystalline aliphatic polyesters, the difference in melting point between which is at least 20° C., and contains 90 to 10% by weight of a high-melting aliphatic polyester component (H) having a melting point of not less than 130° C. and 10 to 90% by weight of a low-melting aliphatic polyester component (S) having melting point of 40 to 120° C. The component (H) with high melting point is a component to maintain the heat resistance of the component (B2) and to prevent sticking in melt spinning, and is required to have a melting point of not less than 130° C., preferably not less than 140° C., more preferably not less than 150° C., most preferably not less than 160° C. The component (S) with low melting point with low melting point is a component to reveal an adhesion property by heating, and is required to have a melting point of 40 to 120° C., preferably 50 to 120° C., more preferably 60 to 120° C. The heat adhesion temperature, adhesion density and adhesive strength can be widely changed by changing the melting points and mixing or copolymerization ratio of the component (H) with high melting point and the component (S) with low melting point, and they can be suitably selected according to the purposes. The weight ratio of the component (H) with high melting point to the component (S) with low melting point in the aliphatic polyester (B2) must be from 9/1 to 1/9 and, in many cases, preferably the weight ratio is from 8/2 to 2/8, especially from 7/3 to 3/7. The heat of fusion of each of the component (H) with high melting point and the component (S) with low melting point in the aliphatic polyester (B2) must be at least 3 J/g, and preferably the heat of fusion is at least 5 J/g, especially at least 10 J/g, more especially from about 10 to about 30 J/g. The reason is that the aliphatic polyester (B2) is desired to be crystalline from the viewpoint of prevention of sticking in melt spinning.

The difference in melting point between the component (H) with high melting point and the component (S) with low melting point in the aliphatic polyester (B2) is at least 20° C., preferably at least 30° C., more preferably at least 40° C. For example, a block copolymer or mixture comprising a combination of the component (H) having a melting point of 160° C. and the component (S) having a melting point of 80° C. strongly adheres, if treated for example at 100° C., since the component (S) is melted, but the fiber component (B2) as a whole maintains its shape to some extent without being melted since the component (H) with high melting point is present. Therefore, the melting points and proportion of the components (H) and (S) which constitute the aliphatic polyester (B2), are selected according to the required adhesion treatment temperature and others such as pressure, adhesive strength, heat resistance and temperature of use.

In the self-crimpable and self-adhesive conjugated fibers (IIa), the aliphatic polyester (B2) is a mixture of the components (H) and (S) and/or a block copolymer of the components (H) and (S). Any mixing methods are applicable, e.g., usual melt-mixing and mixing in a solvent.

Mixing devices may be a mechanically agitating machine, a static mixer wherein separation and confluence of a flow are repeated in multi-stages, or a combination thereof. It is acceptable that the both components partially react during the melt-mixing to form a block copolymer, provided that formation of completely random copolymer (disappearance of melting point, becoming amorphous) by excessive reaction must be avoided. That is to say, it is desirable to maintain the melting point and heat of fusion of the both components within desirable ranges by analyzing the molten mixture by DSC. On the other hand, the block copolymer of the both components is obtained, for example, by conducting in a molten state an addition reaction (polymerization) of a cyclic lactone which is a raw material of the high-melting component (H), such as lactide or glycolide onto a low-melting aliphatic polyester (S) having terminal hydroxyl group. The block copolymer can also be obtained by reacting a mixture of the components (H) and (S) having terminal hydroxyl group with a polyfunctional compound (chain extender), e.g., a diisocyanate such as hexanediisocyanate, a dicarboxylic acid anhydride such as phthalic anhydride, or a dicarboxylic acid halide such as terephthaloyl chloride to combine them. In order to improve the heat shrinkability and the elasticity restoration property after shrinking, it is also preferable to impart a branched structure or a crosslinked structure to the polymers which constitute the component (B). For example, compounds having a tri- or more functional group such as trimellitic acid, glycerol or triisocyanate can be used.

In order to stably conduct the mixing of the components (H) and (S), it is desirable that the affinity between the both is high. The improvement in affinity between the both can be performed by the above-mentioned methods. In the conjugated fiber (IIa), the polymers (A2) and (B2) are desired to have a high mutual adhesion property. For this purpose, it is preferable that the both polymers have a common component. For example, it is particularly preferable that the polymer (A2) and the component (H) with high melting point of the polymer (B2) is the same component (e.g., polylactic acid). Similarly, it is also preferable that they are analogous components (e.g., polylactic acid and a copolymer composed mainly of polylactic acid).

The aliphatic polyester (B2) is mainly composed of the aliphatic polyester components (H) and (S), but may contain, as a secondary component (at most 50% by weight, especially at most 30% by weight), other components such as aromatic component, polyether component, polycarbonate component, polyurethane component, polyamide component, polyorganosiloxane component and the like. The molecular weight of the aliphatic polyester (B2) is not particularly limited, but preferably it is not less than 50,000, especially 80,000 to 300,000, and it is widely adopted within the range of 100,000 to 200,000.

In the conjugated fiber (IIa), examples of the polyester suitable for the low-melting component (S) are, in addition to an aliphatic polylactone such as polycaprolactone (melting point about 59° C.) or polypropiolactone (m.p. 95° C.), polyesters obtained from combinations of at least one aliphatic glycol such as ethylene glycol, propylene glycol, butandiol, hexanediol, octanediol, diethylene glycol or triethylene glycol and at least one aliphatic dicarboxylic acid such as succinic acid, adipic acid, azelaic acid, sebacic acid, octanedicarboxylic acid or decanedicarboxylic acid, e.g., polyethylene succinate (melting point about 102° C.), polyethylene adipate (m.p. 49° C.), polyethylene suberate (m.p. 65° C.), polyethylene azelate (m.p. 52° C.), polyethylene sebacate (m.p. 75° C.), polybutylene succinate (m.p. 116° C.), polybutylene adipate (m.p. 72° C.), polybutylene sebacate (m.p. 66° C.), polyhexane sebacate (m.p. 74° C.) and other homopolymers, and crystalline block or random copolymers comprising them as the constituent components. In case of dyeing and using an adhered fiber structure obtained from the self-adhesive conjugated fiber (IIa), for example, as clothes, the melting point of the low melting component (S) is preferably not less than 100° C., especially not less than 110° C.

In multi-component fiber melt spinning, the conjugated fiber (IIa) of the present invention is prepared according to a usual method by separately melting and metering the polymer (A2) and the polymer (B2), conjugating them in a spinneret, spinning out from an orifice, cooling and oiling the fiber, and optionally drawing and heat-treating it for molecular orientation and crystallization. The conjugated fiber of the present invention is also prepared by separately dissolving the polymer (A2) and the polymer (B2), and subjecting the resultants to multi-component fiber spinning by a wet, dry or dry-wet method. The multi-component fiber melt spinning method is preferable because of high efficiency. The melt spinning can be conducted by a low speed spinning at a taking-up speed of not more than 2,000 m/minute, a high speed spinning at a taking-up speed of 2,000 to 5,000 m/minute, or a ultra-high speed spinning at a taking-up speed of not less than 5,000 m/minute. In case of the low speed spinning and the high speed spinning, adoptable are a method wherein the spinning and the drawing are separately conducted, and a method wherein the spinning and the drawing are continuously conducted at the same time. In general, the drawing is conducted at a drawing ratio of about 3 to about 8 in the low speed spinning, and at a drawing ratio of about 1.5 to about 3 in the high velocity spinning, and the drawing is not conducted or is conducted at a drawing ratio of not more than about 2.

The conjugated fiber (IIa) of the present invention can be formed into an arbitrary form such as continuous multi-filament, continuous mono-filament or staple, and after optionally blending it with other fibers by various means, it is used in the form of yarn, knitted fabric, woven fabric, non-woven fabric, felt, a composite body with paper or film, or in the form of other analogous fiber structures.

In general, the adhesion of the self-adhesive conjugated fiber (IIa) is conducted by heating or compressing a fibrous structure. The heating can be conducted by dry heating, wet heating, infrared rays, high frequency and other methods. In general, the higher the pressure, the adhesion is possible at a lower temperature.

The self-crimpable conjugated fiber (IIa) reveals a crimp by heating. Wet heating, dry heating, infrared rays and other methods are applicable to the heating. It is possible to control or adjust the crimping by changing the heating temperature, heating time or degree of tension (such as tensile force). The revelation of crimp can be conducted in the form of filament, tow, staple, yarn, knitted fabric, woven fabric, non-woven fabric, web and other suitable forms. In many cases, the crimping is conducted by heating yarn, tow, web, knitted fabric, woven fabric, non-woven fabric or the like under no tension or low tension. The crimping is also often conducted before or during a finishing step such as dyeing. A crimp is also revealed by shrinkage based on swelling. For example, acetone, methyl ethyl ketone or a mixture thereof with water can be used as a swelling agent. Other known solvents which are diluted with water or formed into an aqueous dispersion, can also be used as a swelling agent.

The self-crimpable conjugated fiber (IIa) of the present invention can have cross sectional shapes, for example, as shown in FIGS. 1A to 1G. In the figures, 1 denotes the low-shrinkable component (A2), 2 denotes the high-shrinkable component (B2), and these may be replaced with each other. The components (A2) and (B2) must be conjugated eccentrically. Being eccentric means that the locations of the respective centers of gravity for the both components are different. The higher the eccentricity, the higher the crimpability of the conjugated fiber. FIG. 1A shows an example of the highest eccentricity, and FIG. 1B shows an example of a low eccentricity.

The conjugation ratio (sectional area ratio) of the fiber component (A2) and the fiber component (B2) in the self-crimpable conjugated fiber (IIa) is not particularly limited. Preferably the conjugated ratio is from 10/1 to 1/10, especially 5/1 to 1/5, more especially 2/1 to 1/2. The crimpability decreases as the conjugated ratio departs from 1/1.

Figure 4A:
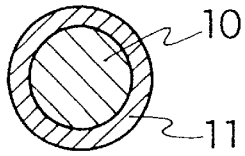
FIG. 4A shows a core-sheath type conjugated fiber having a circular section.
Figure 4B:
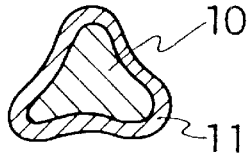
FIG. 4B shows a core-sheath type conjugated fiber having a none-circular section.
Figure 4C:
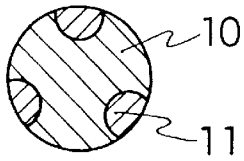
FIG. 4C shows a rotation symmetry type conjugated fiber.
Figure 4D:
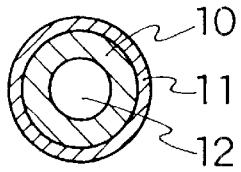
FIG. 4D shows a hollow type core-sheath conjugated fiber.

FIGS. 4A to 4D are cross sectional views of a fiber showing some examples of the self-adhesive conjugated fiber (IIa) of the present invention. In the figures, 10 is a polymer (A2) for retaining strength, and 11 is an adhesive component (B2). FIG. 4A shows a concentric type circular conjugated fiber, FIG. 4B shows a concentric type conjugated fiber having a triangular section, FIG. 4C shows a rotation symmetry type conjugated fiber, and FIG. 4D shows a concentric type hollow conjugated fiber. In FIG. 4D, 12 is a hollow portion, but a third polymer may be contained therein. The aliphatic polyester (B2) which is an adhesive component must occupy at least a part of the surface of a fiber. FIGS. 4A, 4B and 4D show examples that the component (B2) occupies the whole surface, and FIG. 4C show an example that the component (B2) occupies a part of the surface. The higher the surface occupation percentage of the component (B2), the larger the adhesion force. The conjugation ratio (sectional area ratio) of the fiber component (A2) and the fiber component (B2) in the self-adhesive conjugated fiber (IIa) is not particularly limited, but is from 20/1 to 1/20, preferably 10/1 to 1/10, more preferably 5/1 to 1/5, still more preferably 2/1 to 1/2. The conjugation state is required to be concentric with respect to the fiber component (A2) and the fiber component (B2). That is to say, it is necessary that the respective centers of gravity approximately coincide with each other.

Similarly to the case of the conjugated fiber (I), the cross sectional shape of the conjugated fiber (IIa) is not particularly limited, and the fiber can have various shapes such as circle, non-circle, polygon, multi-blade, hollow shape and others. Similarly, the fineness of the conjugated fiber (IIa) is suitably selected according to the purposes. In case of usual clothes, the fineness of a filament is from about 0.1 to about 50 d, preferably 0.5 to 30 d, and the fineness within the range of 1 to 20 d is widely used. The thinner or thicker fibers are adaptable for non-woven fabrics, leathers and materials. If required, a crimp can be mechanically imparted to the conjugated fiber of the present invention by a false twisting method or a staffing box method. It is desirable that sticking of the fiber does not occur by the heating applied during such a crimping step. From this point of view, it is preferable that the melting point of a component having the lowest melting point among the aliphatic polyester (B2) is not less than 60° C., especially not less than 80° C., more especially not less than 90° C.

Similarly to the case of the conjugated fiber (I), the conjugated fiber (IIa) may contain various additives, and also it can be used alone or in combination with other fibers in the production of yarn, braid or cord, rope, knitted fabric, woven fabric, non-woven fabric, paper, composite materials and other structures.

Another preferable embodiment of the fiber (II) is a dividable, spontaneously degradable conjugated fiber (IIb) comprising (A2) a crystalline aliphatic polyester having a melting point of not less than 140° C. and (B2) a block copolymer or mixture containing (H) a crystalline aliphatic polyester having a melting point of not less than 140° C. and (S) an aliphatic polyester having a melting point of not more than 120° C. and a glass transition temperature of not more than 30° C., wherein at least one of the components (A2) and (B2) contains not less than 0.05% by weight of a polyorganosiloxane component and, in the cross section of the fiber, the components (A2) and (B2) are conjugated in a single filament so that the component (B2) divides the component (A2) into at least two portions and the both components (A2) and (B2) form a part of the surface of the fiber.

In the dividable conjugated fiber (IIb), the polymer (A2) is a component which is highly crystalline and has a low heat-shrinkability. Polymers suitable as the polymer (A2) include the above-mentioned homopolymers, and copolymers and/or mixtures thereof with a second component, a third component and the like incorporated in such a small amount that the crystallinity is not so impaired (for example, at most 30% by weight, preferably at most 20% by weight, more preferably at most 10% by weight). From the viewpoints of strength and heat resistance of the obtained articles from fiber (IIb), preferably the heat of fusion of the polymer (A2) is at least 20 J/g, especially at least 30 J/g, more especially at least 40 J/g. From the viewpoint of practical use, the polymer (A2) is required to have a melting point of not less than 140° C., and preferably the melting point is not less than 150° C., especially not less than 160° C., more especially not less than 170° C.

The aliphatic polyester (B2) may be a block copolymer of (H) a segment of a crystalline aliphatic polyester having a melting point of not less than 140° C. (hereinafter often referred to as "hard segment") and (S) a segment of an aliphatic polyester having a melting point of not more than 120° C. and a glass transition temperature of not more than 30° C. (hereinafter often referred to as "soft segment"), or may be a mixture of the above-mentioned crystalline aliphatic polyester (H) and the above-mentioned aliphatic polyester (S). Since the aliphatic polyester (B2) is composed of the components (H) and (S), it greatly shrinks when heated and consequently the polyester (A2) and the polyester (B2) are easily separated into divided thin fibers. For achieving a high shrinkability, it is preferable that the high-melting polyester component (H) is strong, and it is necessary that the melting point thereof is not less than 140° C. Preferably the melting point is not less than 150° C., especially not less than 160° C., more especially not less than 170° C. On the other hand, as to the low-melting polyester component (S), the softer, the larger the heat shrinkability and the more preferable. In case of crystalline polymers, the component (S) is required to have a melting point of not more than 120° C., and preferably the melting point is not more than 1000° C., especially not more than 90° C., more especially not more than 80° C. or being non-crystalline (amorphous). For example, when treated in a 100° C. hot water, the fiber component (B2) shrinks strongly if the low-melting polyester component (S) has a melting point of not more than 100° C. However, since the high-melting polyester component (H) has a melting point of not less than 140° C., the fiber component (B2) shrinks, but does not melt. Similarly, for achieving a high shrinkability, it is preferable that the glass transition temperature of the low-melting polyester component (S) is not more than 20° C., especially not more than 0° C. In case that the low-melting polyester component (S) is completely amorphous, the melting point is regarded as being the same as the glass transition temperature.

Examples of polyesters having a melting point of not more than 120° C. and a glass transition temperature of not more than 0° C. suitable for use in the low-melting polyester component (S) of the aliphatic polyester (B2) in the dividable conjugated fiber (IIb) are, in addition to polycaprolactone, polyesters of an aliphatic alkylene glycol having a linear or branched alkylene group with 2 to about 20 carbon atoms and an aliphatic dicarboxylic acid having 4 to about 22 carbon atoms, e.g., polyethylene succinate, polyethylene adipate, polyethylene sebacate, polyethylene azelate, polyethylene decanate, polypropylene succinate, polypropylene adipate, polypropylene sebacate, polypropylene azelate, polypropylene decanate, polybutylene succinate, polybutylene adipate, polybutylene sebacate, polybutylene azelate, polybutylene decanate, polyhexane succinate, polyhexane adipate, polyhexane sebacate, polyhexane azelate or polyhexane decanate, and (random and block) copolymers containing these polyesters as a component. In addition thereto, polyester-ethers derived from a combination of an aliphatic dicarboxylic acid and an alkylene glycol oligomer such as diethylene glycol, triethylene glycol or ethylene/propylene glycol are also suitable as the polyester component (S) with low melting point.

In many cases, homopolymers are generally crystalline, but it is possible to decrease the crystallinity of the polyester component (S) with low melting point or to make it amorphous by means of copolymerization (random or block) of two or more homopolymers. Also, in case of using a mixture of the components (H) and (S) as the fiber component (B2), a block copolymer of a polyester with low melting point and a crystalline high-melting polyester has a high affinity with the polyester (H) with high melting point and can be easily and uniformly mixed therewith and, therefore, is particularly preferred as the polyester (S) with low melting point. The molecular weight of the polyester component (S) with low melting point in the aliphatic polyester (B2) is not particularly limited. However, in many cases, as to the block copolymer the molecular weight of the soft segment (S) is, for example, from 1,000 to 150,000, preferably 2,000 to 100,000, more preferably 5,000 to 50,000, and as to the polymer blend the molecular weight of the polyester (S) with low melting point is, for example, from 10,000 to 300,000, preferably 20,000 to 250,000, more preferably 50,000 to 200,000. Further, in order to raise the stretchability of the fiber component (B2), a plasticizer may be added thereto.

Examples of the polyester component (H) with high melting point which is a crystalline aliphatic polyester in the aliphatic polyester (B2) are as mentioned above. In order to strengthen this portion, it is necessary that the crystallinity is high, and homopolymers are the most preferable in keeping the crystallinity. In case of the modification by means of copolymerization or mixing, too, it is preferable to control the amount of the secondary component, for example, to at most 20% by weight, especially at most 10% by weight, more especially at most 5% by weight. In case of using a polymer blend as the fiber component (B2), a high-melting polyester block-copolymerized with a low-melting polyester is preferred as the high-melting polyester component (H), since it has a high compatibility with a low-melting polyester component (S). The molecular weight of the high-melting polyester component (H) is not particularly limited. However, in many cases, as to the block copolymer the molecular weight of the hard segment (H) is, for example, from 5,000 to 200,000, preferably 8,000 to 100,000, more preferably 10,000 to 50,000, and as to the polymer blend the molecular weight of the high-melting polyester (H) is, for example, from 50,000 to 300,000, preferably 80,000 to 250,000, more preferably 100,000 to 200,000.

In case that the aliphatic polyester (B2) is a mixture of the polyester (H) with high melting point and the polyester (S) with low melting point, the mixing state is not particularly limited, but it is preferable that the both components are finely and uniformly mixed. In order to achieve fine and uniform mixing, it is preferable that the mutual affinity is high and accordingly either one or both are a block copolymer containing a component to be mixed therewith in an amount of, for example, at most 50% by weight, especially about 5 to about 30% by weight, more especially 10 to 20% by weight. Also, in order to raise the compatibility of the both components, a secondary component, e.g., a material having a function to serve as a surfactant or a compatibilizer, may be added. The weight ratio of the high-melting polyester (H) and the low-melting polyester (S) varies depending on the properties of the respective components used, but in order to obtain desirable strength, elasticity, heat resistance and heat shrinkability of fibers, the weight ratio is from1/9 to 9/1, preferably 2/8 to 8/2, more preferably 3/7 to 7/3. The higher the crystallinity and melting point of the high-melting polyester (H), thus the stronger the polyester (H), or the lower the crystallinity and melting point of the low-melting polyester (S), thus the softer the polyester (S), the higher effect is obtained respectively even in the use in a small amount.

The molecular weight of the polymer blend (B2) is not particularly limited, but in performing a blended fiber melt spinning with the polymer (A2), it is desirable that the melt viscosities of the components (A2) and (B2) are almost same and it is also preferable that the weight average molecular weight of the polymer blend (B2) as a whole is close to that of the polymer (A2). That is to say, it is preferable that the weight average molecular weight of the polymer blend (B2) is at least 50,000, especially from 70,000 to 300,000, more especially from 80,000 to 200,000.

The polymer blend (B2) is obtained by mixing the high-melting polyester (H) and the low-melting polyester (S). The mixing manner is not particularly limited. For example, the mixing may be carried out by mixing pellets of the both polymers in a predetermined ratio and then melt-mixing the mixture in a screw extruder, a twin-screw extruding kneader or other mixing machines, or by separately melting the both polymers and then mixing them in a mechanical agitating machine, a static mixing device wherein separation and confluence of a polymer flow are repeated by a flow guide device, or a combination of a mechanical agitating machine and a static mixing device. In case of melt-mixing, there is a case that the high-melting polyester (H) and the low-melting polyester (S) react to form a copolymer. If it is required to prevent lowering of the melting point, deterioration of heat resistance and the like owing to copolymerization, it is preferable to conduct the melt-mixing in a short time, for example, in 30 minutes, especially in 20 minutes. Similarly, in order to prevent a reaction of the both components, it is also possible to block the molecular terminals of the polymers by means of esterification or the like. The both components may be dissolved in a solvent and mixed.

In case that the aliphatic polyester (B2) is a block copolymer wherein the hard segment (H) and the soft segment (S) are bonded, the bonding manner is not particularly limited and usual chemical bonding is adaptable, e.g., ester bond, amido bond, urethane bond, urea bond and others. For example, lactide or glycolide may be reacted (polymerized) to form a hard segment onto a low-melting aliphatic polyester having terminal hydroxyl group which is suitable as the soft segment. Also, a terminal hydroxyl group-containing polyester for the soft segment and a terminal hydroxyl group-containing polyester for the hard segment may be reacted with a dicarboxylic anhydride or halide to bond them. In these cases, the segments are bonded through ester bonds. Also, the segments can be bonded through urethane bonds by reacting the terminal hydroxyl groups with a diisocyanate. The weight ratio of the hard segments (H) and the soft segments (S) varies depending on the properties of the respective components used. In obtaining desirable strength, elasticity, heat resistance and heat shrinkability, the weight ratio is from 2/8 to 8/2, preferably 3/7 to 7/3, more preferably 4/6 to 6/4. The stronger the hard segment (H) or the softer the soft segment (S), the higher effect is obtained respectively even in the use in a small amount.

The weight average molecular weight of the block copolymer (B2) is not particularly limited, but in many cases, it is at least 50,000, especially from 80,000 to 300,000, more especially from 100,000 to 200,000.

The first reason why the conjugated fiber (IIb) of the present invention is relatively easily dividable (peelable) is that the difference in heat shrinking force or shrinkage percentage between the above-mentioned polymer (A2) and polymer (B2) is large. Preferably the shrinkage percentage in boiling water of the polymer (A2) is at most 20%, especially at most 15%, more especially at most 10%. Also, preferably the shrinkage percentage in boiling water of the polymer (B2) is at least 20%, especially at least 30%, more especially at least 40%. Preferably the difference in shrinkage percentage between the polymer (A2) and the polymer (B2) is at least 10%, especially at least 20%, more especially at least 30%. In general, the higher the content of the low-melting polyester component (S) in the polymer (B2), there is a tendency that the larger the shrinkability. A sufficient difference in shrinkage percentage can be easily achieved by selecting the polymer (A2) and the polymer (B2) according to the above explanation.

The second reason why the conjugated fiber (IIb) of the present invention is relatively easily dividable is that the mutual adhesion property is low, since either or both of the polymers (A2) and (B2) contain a polyorganosiloxane component. The polyorganosiloxane is those having a side chain of alkyl and/or aryl group, and includes, for instance, polydimethylsiloxane, polymethylethylsiloxane, polydiethylsiloxane, polymethylphenylsiloxane, polydiphenylsiloxane and the like. In many cases, polydimethylsiloxane is the most preferred. The higher the content of the polyorganosiloxane in the component (A2) or (B2), the adhesion between the components (A2) and (B2) is more lowered and the peeling becomes easier. The content of the polyorganosiloxane in at least one of the components (A2) and (B2) is at least 0.05% by weight, preferably at least 0.1% by weight, more preferably from 0.3 to 8% by weight, still more preferably from 0.5 to 5% by weight. In particular, it is preferable to incorporate the polyorganosiloxane component into the component (B2) in a larger amount than the component (A2) or into only the component (B2).

The incorporation of the polyorganosiloxane component into the component (A2) or (B2) is conducted by means of copolymerization or mixing. The copolymerization method may be conducted, for example, by reacting (polymerizing) a raw material for producing an aliphatic polyester, e.g., lactide or glycolide, to a polyorganosiloxane having terminal hydroxyl group, or by mixing a polyorganosiloxane having terminal hydroxyl group with an aliphatic polyester having terminal hydroxyl group and reacting them with a dicarboxylic anhydride, a dicarboxylic halide, a diisocyanate or the like to bond them. For example, it is possible to mix and react an aliphatic polyester having hydroxyl group with a prepolymer (having an isocyanate group) obtained by a reaction of an equimolar amount of a diisocyanate with the hydroxyl group of a polysiloxane.

In the mixing method, an aliphatic polyester is mixed with a polyorganosiloxane. The both are poor in mutual affinity and it is fairly difficult to uniformly mix them. One method to improve the affinity is using a surface active agent. Another method is using a block copolymer of an aliphatic polyester and a polyorganosiloxane. The method for preparing the block copolymer of an aliphatic polyester and a polyorganosiloxane is as mentioned above. It is relatively easy to uniformly mix a separately prepared block copolymer with an aliphatic polyester and is the most practical. Since the amount of this block copolymer required is small, usual apparatus and method such as strongly agitating apparatus, ultrasonic device or surface active agent the prepration is applicable to the separate preparation of the block copolymer and the preparation is relatively easy. The polyorganosiloxane content in the aliphatic polyester-polyorganosiloxane block copolymer to be mixed with aliphatic polyesters is from 5 to 95% by weight, preferably 10 to 90% by weight, more preferably 20 to 80% by weight. This block copolymer is also usable as a dispersing agent (surface active agent) for dispersing (mixing) a polyorganosiloxane into aliphatic polyesters. Thus, the fields of application thereof are wide, and the block copolymer is particularly useful for the present invention.

In the cross section of the conjugated fiber (IIb), it is required that the polymer (B2) divides the polymer (A2) into at least two portions (hereinafter the portion being sometimes referred to as a layer) and the both components occupy a part of the surface of the fiber. By having such a conjugation structure, the conjugated fiber (IIb) becomes dividable into a plurality of filaments, thus providing fibers having a small fineness and a special cross section. The more the number of layers of the polymer (A2) in a single filament, thinner fibers having a larger specific surface area are obtained. The number of divisions is required to be at least 2, and is widely used within the range of 3 to about 20. The fiber having a number of divisions of 3 to about 10 is suitable for use in dress, blouse, women's under wear and the like, and the fiber having a number of divisions of 4 to 20 is suitable as ultra-fine fiber for use in ultra-high-density knitted and woven fabrics, non-woven fabric, artificial suede, artificial leather, filter, wiping cloth and so on.

Figure 3A:
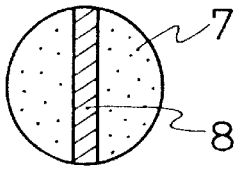
FIG. 3A shows a three-layered parallel type conjugated fiber.
Figure 3B:
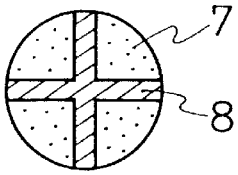
FIG. 3B shows a five-layered radial type conjugated fiber.
Figure 3C:
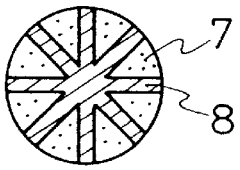
FIG. 3C shows a nine-layered radial type conjugated fiber.
Figure 3D:
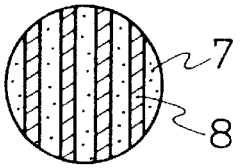
FIG. 3D shows a nine-layered parallel type conjugated fiber.
Figure 3E:
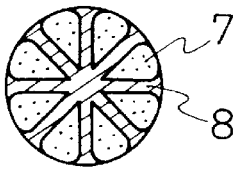
FIG. 3E shows a petal-shaped radial type conjugated fiber.
Figure 3F:
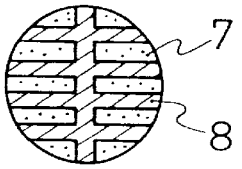
FIG. 3F shows a parallel-radial combination type conjugated fiber.
Figure 3G:
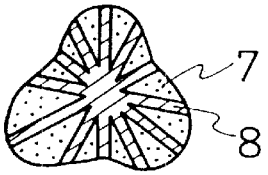
FIG. 3G shows a non-circular radial type conjugated fiber.
Figure 3H:
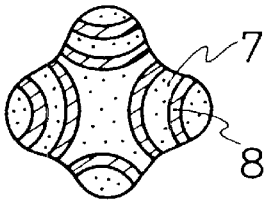
FIG. 3H shows a non-circular parallel type conjugated fiber.
Figure 3I:
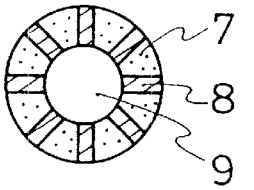
Figure 3J:
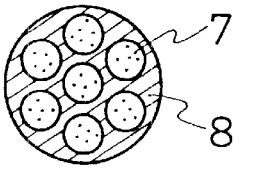
FIG. 3J shows a core-sheath type conjugated fiber having seven cores.
Figure 3K:
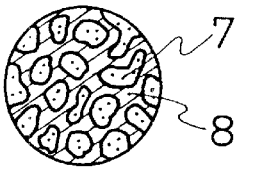
FIG. 3K shows a sea-islands type conjugated fiber.

The cross sectional structures of conjugated fiber (IIb) suitable for the present invention are shown in FIGS. 3A to 3I, wherein 7 is a polymer (A2), 8 is a polymer (B2) and 9 is a hollow portion. FIG. 3A shows an example of a three-layered parallel type and accordingly a three dividable type. The parallel type means a structure wherein both components are alternately disposed. FIG. 3B shows an example that the polymer (A2) is divided into 4 segments by a radial layer of the polymer (B2). The radial type indicates a fiber wherein one of the components, e.g., polymer (B2), is in a radial form. FIG. 3C shows a nine-layered radial type conjugated fiber, FIG. 3D shows a nine-layered parallel type conjugated fiber, FIG. 3E shows a petal-shaped nine-layered radial type conjugated fiber, FIG. 3F shows a multi-layered parallel-radial combination type conjugated fiber, FIG. 3G shows a non-circular radial type conjugated fiber, FIG. 3H shows a deformed multi-layered parallel type conjugated fiber, and FIG. 3I shows a hollow radial type conjugated fiber. Besides FIGS. 3A to 3I, various conjugation modes are adoptable according to the present invention. The polymers (A2) and (B2) may be further conjugated with a third component. For example, a third polymer may be disposed in the hollow portion shown in FIG. 3I. A conjugation structure wherein one of the components occupies the whole surface of a fiber, e.g., core-sheath structure and sea-islands structure as shown in FIGS. 3J and 3K, is not applicable to the conjugated fiber (IIb).

The conjugated ratio (sectional area ratio) of the polymer (A2) and the polymer (B2) is not particularly limited, and is suitably selected according to the purposes. In many cases, the conjugated ratio is preferably 20/1 to 1/5, more preferably 10/1 to 1/2. That is to say, in many cases, it is preferable that the proportion of the low-shrinkable component (A2) is larger than that of the high-shrinkable component (B2). A (A2)/(B2) conjugated ratio within the range of 10/1 to 1/1 is the most preferable.

The sectional shape of the conjugated fiber (IIb) can be suitably selected. Similarly, the filament fineness (before division) can be suitably selected according to the purposes, but is usually from 0.5 to 50 deniers, preferably from 1 to 30 deniers, more preferably from 1.5 to 20 deniers.

The method for preparing the conjugated fiber (IIb) from the polymers (A2) and (B2) is the same as the case of the conjugated fiber (I).

The conjugated fiber (IIb) of the present invention can be formed into a suitable form such as continuous filament, mono-filament, multi-filament and staple according to the purposes. Among the conjugated fibers IIb), a fiber prepared so as to have a mutual adhesion between the components particularly weakened by using a large amount of a silicone component may cause peeling or cracking only by drawing. If heating or swelling is applied, peeling and division further proceed. When the peelability is low, a mechanical means such as false twisting, crumpling or beating may be applied, as occasion demands, as well as heating and swelling. A method of the division by dissolving and removing the polymer (B2) is also applicable, but the peeling method is preferred because of no weight loss. In general, it is preferable that the peeling is restrained to the extent of latently occurring during the preparation of the fiber and during the processing into knitted and woven fabrics, and complete peeling-division is performed after preparing knitted and woven fabrics, for example, in a dye finishing step. The reason is that fine fibers and ultra-fine fibers are easy to be cut by friction or the like during preparation and processing steps, thus often causing trouble.

Still another preferable embodiment of the fiber (II) is a fiber (IIc) comprising (A2) a fiber component comprising a crystalline aliphatic polyester having a melting point of not less than 140° C. and a heat of fusion of at least 20 J/g, and (B2) a fiber component comprising a block copolymer wherein a soft segment (S) having a glass transition temperature of not more than 40° C. which contains an aliphatic polyester as a main component and is substantially non-crystalline is bonded with a hard segment (H) comprising a crystalline segment of an aliphatic polyester having a melting point of not less than 110° C. and/or a segment containing a urethane bond.

The fiber (IIc) may be in the form of a conjugated fiber wherein the fiber components (A2) and (B2) are conjugated in a single filament, or may be in the form of a composite yarn wherein fibers (A2) and (B2) of the respective components are blended. The fiber (IIc) has excellent bulkiness, softness and feeling based on the heat-shrinkability of the fiber component (B2). The conjugated fiber wherein the fiber components (A2) and (B2) are eccentrically conjugated, further exhibits an excellent self-crimpability, and the crimped fiber is also excellent in stretchability.

In the fiber (IIc), the polymer (A2) is a component having a low heat shrinkability. Preferable examples of the polymer (A2) are crystalline homopolymers, and copolymers and/or mixtures thereof with a second component, a third component and so on in such a small amount (e.g., at most 40% by weight, especially at most 30% by weight, more especially at most 20% by weight) that the crystallinity is not so impaired. From the viewpoints of crimpability, strength, heat resistance and feeling of the fiber, the polymer (A2) is required to have a heat of fusion of at least 20 J/g, and preferably the heat of fusion is at least 30 J g, especially at least 40 J/g. From the viewpoint of practical use, the polymer (A2) is required to have a melting point of not less than 140° C., and preferably the melting point is not less than 150° C., especially not less than 160° C., more especially not less than 165° C.

The polymer (B2) is a block copolymer comprising a soft segment (S) which is substantially non-crystalline (amorphous) and contains as a main component an aliphatic polyester having a glass transition temperature of not more than 40° C., and a specific hard segment (H). The polymer (B2) encompasses such a block copolymer which further contains a small amount (at most 50% by weight, preferably at most 40% by weight, more preferably at most 30% by weight) of other components introduced by means of copolymerization or mixing. Herein the segment means a part of a molecular chain of polymer, and is also referred to as a block.

Based on the above-mentioned peculiar structure, the polymer (B2) shows a so-called elastomeric behavior, so it is excellent in restoration from the elongated state and when it is formed into a fiber, it shows a high heat shrinkability. For achieving a high heat shrinkability, the soft segment (S) is required to have a glass transition temperature of not more than 40° C., and preferably the glass transition temperature is not more than 20° C., especially not more than 0° C. In case of preparing a conjugated fiber, it is preferable that the glass transition temperature of the soft segment is not more than 20° C., especially not more than 0° C. The glass transition temperature can be measured by DSC as shown in FIG. 7, but the maximal value temperature for the main dispersion of loss tan δ by the viscoelastic measurement (for example, measurement at 1 to 60 Hz) is more exact. The term "substantially non-crystalline (amorphous)" means that the heat of fusion in a DSC curve is less than 5 J/g, and it is preferable that the heat of fusion is less than 3 J/g.

Preferable examples of the soft segment (S) are aliphatic polyesters which have been modified by means of copolymerization or mixing to the extent that the crystallinity disappears or it becomes substantially amorphous. For achieving this modification, in general the copolymerization ratio of two components is preferably 1/1 by weight or around it, namely within the range of about 2/1 to 1/2 by weight.

Examples of aliphatic polyesters having a glass transition temperature of not more than 0° C. suitable as the soft segment (S) are polyesters having a linear or branched alkylene group with 2 to about 20 carbon atoms, such as polycaprolactone, polyethylene succinate, polyethylene adipate, polyethylene sebacate, polyethylene azelate, polyethylene decanate, polypropylene succinate, polypropylene adipate, polypropylene sebacate, polypropylene azelate, polypropylene decanate, polybutylene succinate, polybutylene adipate, polybutylene sebacate, polybutylene azelate, polybutylene decanate, polyhexane succinate, polyhexane adipate, polyhexane sebacate, polyhexcane azelate, polyhexane decanate, and the like. In addition thereto, polyetheresters derived from a combination of an aliphatic dicarboxylic acid and an alkylene glycol oligomer such as diethylene glycol, triethylene glycol or ethylene/propylene glycol are also suitable as the soft segment component. Homopolymers of these polyesters are generally crystalline and, therefore, it is necessary to modify them by means of mixing or copolymerization (random and/or block copolymerization) of at least two kinds of them so that the crystallinity substantially disappears. The molecular weight of the soft segment is not particularly limited, but in general, it is from 1,000 to 200,000, preferably from 1,500 to 150,000, more preferably from 2,000 to 100,000, most preferably from 5,000 to 50,000.

The soft segment (S) of the polymer (B2) contains as a main component a substantially non-crystalline (amorphous) aliphatic polyester. Amorphous aliphatic polyesters are easily obtained, as mentioned above, by subjecting a plurality of aliphatic polyesters or their raw materials to random or block copolymerization. For example, if raw materials for polyethylene adipate and polypropylene adipate are mixed and polymerized in a molar ratio of about 1/3 to about 3/1, especially 1/2 to 2/1, a low crystalline or amorphous aliphatic polyester is obtained. Also, for example, if 40 parts by weight of a mixture of polyethylene adipate having terminal hydroxyl group and polypropylene sebacate having terminal hydroxyl group in a ratio of 1/1 by weight and 60 parts by weight of lactide are melt-polymerized, a mixed polymer of a polylactic acid/polyethylene adipate block copolymer and a polylactic acid/polypropylene sebacate block copolymer is obtained. In this mixed polymer, polyethylene adipate segments and polypropylene sebacate segments form an amorphous soft segment, and polylactic acid segments form a crystalline hard segment. That is to say, the soft segment can be easily made amorphous by means of random copolymerization, block copolymerization or mixing of a plurality of components. In case of binary copolymer or mixture, it is generally preferable that the copolymerization or mixing ratio of the components is from 1/2 to 2/1 by weight. Whether the polyester is substantially amorphous can be determined by whether the heat of fusion measured by DSC is less than 5 J/g, especially less than 3 J/g.

The hard segment (H) of the polymer (B2) can be two types and a combination thereof, namely three types in total.

The hard segment (H) of the first type is a crystalline aliphatic polyester having a melting point of not less than 110° C., preferably not less than 120° C., more preferably not less than 140° C. Examples of such a high-melting crystalline aliphatic polyester are as described above. Homopolymers are preferred for keeping such a high melting point. Even if the modification is made by means of copolymerization or the like, the amount of the secondary component should be restricted, for example, to at most 20% by weight, preferably at most 10% by weight, more preferably at most 5% by weight. The molecular weight of the crystalline hard segment is not particularly limited, but in general it is preferable for crystallizing at a sufficiently high melting point that the molecular weight is from 5,000 to 200,000, especially 10,000 to 100,000, more especially 10,000 to 50,000.

The hard segment (H) of the second type is an aliphatic polyester containing a urethane bond, which is for example formed by reacting the above-mentioned aliphatic polyester having a terminal hydroxyl group for soft segment with an isocyanate, preferably a diisocyanate. Examples of the diisocyanate are aliphatic and aromatic diisocyanates such as butylene diisocyanate, hexane diisocyanate, octane diisocyanate, phenylene diisocyanate, tolylene diisocyanate, xylene diisocyanate and diphenylmethane diisocyanate. Further, the hard segment can be made more strong by adding as a chain extender a diol such as ethylene glycol, propanediol, butanediol, neopentyl glycol or hexanediol and using, as occasion demands, a diisocyanate in slightly excess, thereby increasing the molecular weight of the hard segment or the number of urethane bonds. However, if urea bonds are introduced (in a high density) by using a large amount of a diamine as a chain extender, the melting point becomes too high (e.g., not less than 230° C.), so the melt spinning becomes difficult, thus undesirable. If an aromatic diisocyanate is used, the product tends to be discolored and to be inferior in biodegradability though being superior in elastic properties, and on the other hand, an aliphatic diisocyanate has an opposite tendency. Therefore, they are selected according to the purposes. It is also possible to introduce a branch structure or a crosslinked structure by using a small amount (e.g., at most 5% by mole) of a trifunctional compound as the chain extender or the isocyanate compound.

The hard segment (H) of the third type is a combination of the above two types and, for example, it can be obtained by reacting the terminal hydroxyl groups of the polyester for crystalline hard segment and the terminal hydroxyl groups of the polyester for amorphous hard segment with a diisocyanate, thereby bonding the both polyesters. In that case, urethane bond portions capable of hydrogen bonding are produced around the crystals of the polymer, thus hard segments are reinforced.

The proportion of the hard segment (H) and the soft segment (S) in the polymer (B2) and the elastic properties thereof are not particularly limited, and are suitably selected according to the properties of the hard and soft segments used and the objects and uses of the articles. In case of the composite yarn, in general, there is a tendency that the more the hard segment, the harder the fiber and the more superior the heat resistance, and that the more the soft segment, the more superior the softness of the fiber. With respect to the elastic properties of the fiber (B2), it is possible to prepare a wide range of fibers from fibers having a very high elasticity restoration percentage like so-called Spundex (elastic yarn) to fibers wherein the molecular orientation is set to some extent by spinning, drawing and heat treatment and the fibers are shrinkable by a later heat treatment at various shrinkage percentages and shrinking forces. However, for achieving the objects of the present invention, there are generally used the fibers that the molecular orientation is set to some extent by spinning, drawing and heat treatment and the shrinkage percentage in 100° C. boiling water is from 15 to 80%, preferably 20 to 70%, more preferably 30 to 60%. For this purpose, in case of the composite yarn, it is preferable that the content of the hard segment (H) in the polymer (B2) is from 10 to 90% by weight, especially 20 to 80% by weight, more especially 30 to 70% by weight.

In case of the conjugated fiber, it is preferable that the weight ratio of the hard segment (H) and the soft segment (S) in the polymer (B2) is from 20/80 to 80/20, especially 25/75 to 75/25, more especially 30/70 to 70/30. In general, the stronger and the harder the structure of the hard segment, and the lower the glass transition temperature of the soft segment and therefore it is amorphous and is high in degree of freedom of the heat mobility and has a softer structure, the more excellent the elastic properties of the fiber component (B2) and the conjugated fiber has a higher crimpability. Also, a stronger hard segment is effective even if used in a small amount, and similarly a soft segment having a glass transition temperature of not more than 0° C. is effective even if used in a small amount.

The molecular weight of the block copolymer (B2) is not particularly limited, but preferably it is from 50,000 to 300,000, especially 80,000 to 200,000.

The preparation method and processing method the composite yarn (IIc), the boiling water shrinkage percentage, sectional shape, fineness, blending ratio and others of the fibers (A2) and (B2), and the preparation method and processing method the conjugated fiber (IIc), the sectional shape, fineness, crimping processing, difference in heat shrinkage percentage of the fibers (A2) and (B2), conjugated ratio and others are the same as the cases of the composite yarn (I) and the conjugated fiber (I) and, therefore, explanations thereof are omitted.

The present inventors have found that when an aliphatic polyester which is relatively subject to an alkali hydrolysis is incorporated with a hydrophilic compound and it is conjugated in a single filament with a crystalline aliphatic polyester having a melting point of not less than 140° C., a conjugated fiber which is easily dividable by a chemical treatment is obtained. Thus, the present invention further provides a conjugated fiber (III) comprising (A3) a crystalline aliphatic polyester having a melting point of not less than 140° C., and (B3) a composition comprising an aliphatic polyester and 1 to 50% by weight of at least one compound selected from the group consisting of a polyether having a $C_2$ to $C_4$ alkylene group, its derivatives, an organic compound having a sulfo group, an organic compound having a sulfate group, an organic compound having a carboxyl group, an organic compound having a phosphate group and an organic compound having an amino group and/or an amido group, wherein the polyester (A3) and the composition (B3) are conjugated in a single filament and, in the cross section thereof, the composition (B3) divides the polymer (A3) into at least two portions.

In the conjugated fiber (III) of the present invention, the crystalline aliphatic polyester (A3) having a melting point of not less than 140° C. is conjugated with the aliphatic polyester composition (B3) containing a specific hydrophilic component. Since the hydrolysis property by an aqueous alkali solution of the composition (B3) is higher than that of the polymer (A3), this conjugated fiber can be easily divided by a treatment with an aqueous alkali solution.

The polymer (A3) is a polyester relatively low in hydrolysis property by an aqueous alkali solution. Preferable examples of the polymer (A3) are homopolymers such as poly-L-lactic acid (melting point 175° C.), poly-D-lactic acid (m.p. 175° C.), poly-3-hydroxybutylate (m.p. 180° C.) and polyglycolic acid (m.p. 230° C.), and copolymers and/or mixtures thereof with a small amount of other components. In case of the block copolymers, the lowering in crystallinity and melting point are mild, so preferably the content of the comonomer component is at most 50% by weight, especially 1 to 40% by weight, and in many cases, 1 to 30% by weight. In case of the random copolymers, the changes in crystallinity and melting point are marked, so preferably the content of the comonomer component is from 0.5 to 20% by weight, especially 1 to 10% by weight.

In order to restrain the alkali hydrolysis property, a water repellent component may be introduced by means of mixing or copolymerizatioin into the polymer (A3). Examples of the water repellent component are a fatty acid and an aliphatic alcohol which have an alkyl group having 10 or more carbon atoms, especially 15 or more carbon atoms, their esters and amides, a wax, polyethylene and its derivatives, and a polyorganosiloxane (e.g., polydimethylsiloxane) and its derivatives, and the like. The content of the water repellent component in the polymer (A3) is not particularly limited, but, in many cases, preferably it is from 0.1 to 20% by weight, especially about 0.5 to about 10% by weight. The molecular weight of the polymer (A3) is not particularly limited, but, in many cases, preferably it is at least 50,000, especially from 70,000 to 300,000, more especially 80,000 to 200,000.

The polymer (A3) is a component which has a high crystallinity and is low in rate of hydrolysis, but it is further preferable that the polymer has a high heat resistance and a low heat shrinkability. From the viewpoints of strength and heat resistance, the melting point of the polymer (A3) is not less than 140° C., preferably not less than 150° C., more preferably not less than 160° C., still more preferably not less than 170° C. From the viewpoint of practical use, preferably the heat of fusion of the polymer (A3) is at least 20 J/g, especially at least 30 J/g, more especially at least 40 J/g.

The composition (B3) is a mixture of a crystalline or non-crystalline aliphatic polyester with a specific hydrophilic compound, namely at least one compound selected from the group consisting of a polyether having a $C_2$ to $C_4$ alkylene group, its derivatives, an organic compound having a sulfo group, an organic compound having a sulfate group, an organic compound having a carboxyl group, an organic compound having a phosphate group and an organic compound having an amino group and/or an amido group. By this hydrophilic component, the composition (B3) becomes very sensitive to water and an aqueous solution of an alkali metal compound (sodium, potassium, lithium, calcium, magnesium or the like) and is easily hydrolyzed thereby. Consequently, the conjugated fiber (III) of the present invention is easily divided, or when other means, e.g., a division method by mechanical means or chemical swelling, is applied together, the fiber is easily divided. For this purpose, it is preferable that the rate of degradation, namely the weight reduction percentage per unit time, of the composition (B3) in the form of a fiber in an aqueous weak alkaline solution, e.g., a 3% by weight aqueous solution of sodium carbonate, at a temperature of 98 to 100° C. is at least 1.5 times, especially at least 2 times, more especially at least 5 times, still more especially at least 10 times, that of the polymer (A3), and usually it is widely used within the range of about 5 to about 200 times that of the polymer (A3). It is preferable that the hydrophilic compound incorporated into the composition (B3) is able to be melt-blended with aliphatic polyesters and the composition (B3) is able to be melt-multiple-spun.

The first group of the hydrophilic compound includes a polyether having an alkylene group with 2 to 4 carbon atoms and its derivatives. Examples of the polyether are polyethylene glycol, polypropylene glycol, polybutylene glycol and copolymers thereof. Examples of the derivatives of the polyether are a reaction product of the polyether (including oligomer) with other components, e.g., non-ionic surface active agents wherein a polyether and a component having an alkyl group or alkylaryl group are bonded through ester bond or ether bond, a copolymer (especially block copolymer) of a polyether and other polymer, especially an aliphatic polyester, and the like. For example, a block copolymer of polyethylene glycol and aliphatic polyester is preferred since it has a high affinity with an aliphatic polyester used as the matrix component of the composition (B3). In particular, when the aliphatic polyester block (segment) in the block copolymer is the same as the aliphatic polyester of the matrix component, the mutual affinity is the highest and they can be easily and stably mixed. For example, when polylactic acid or a copolymer thereof is used as the matrix polymer of the composition (B3) and a block copolymer of polyethylene glycol and polylactic acid is used as the hydrophilic compound of the composition (B3), this combination is very excellent in mutual affinity and is preferred. Similarly, a combination of polybutylene succinate used as the matrix polymer and a polyethylene glycol-polybutylene succinate block copolymer used as the hydrophilic compound is preferable. A polyether-aliphatic polyester block copolymer is prepared, for example, by reacting a polyether having a terminal hydroxyl group with the raw materials for an aliphatic polyester, or by an addition reaction (polymerization) of an alkylene oxide (such as ethylene oxide) onto an aliphatic polyester having a terminal hydroxyl group. Polybutylene glycol is not necessarily high in hydrophilic property, but a high hydrophilic property is often obtained if it is mixed with other compounds having a polar group. Polymers and non-ionic surfactants containing these polyether components have a high melt-fluidity, and it is also possible to improve its thermal plasticity by mixing with other compounds, e.g., compounds having a polar group.

A second group of the hydrophilic compound includes an organic compound having a sulfo group (particularly alkali metal salt) or a sulfate group. Examples thereof are, for instance, a thermoplastic polymer obtained by polymerizing or copolymerizing a vinyl monomer having sulfo group such as vinyl sulfonate, sulfonated styrene (sodium salt), sodium methallyl sulfonate or sodium 2-acrylamide-2-methylpropane sulfonate, a surfactant such as sodium alkylbenzenesulfonate, sulfuric acid esters (sodium salts) of various higher alcohols, and the like. There is a case that these sulfo group-containing compounds and sulfuric acid esters have no high thermal plasticity, but an excellent melt fluidity is often obtained if they are mixed with a polyether such as the above-mentioned non-ionic surfactant or polyethylene glycol. The sulfo group-containing compounds are the most practical, since they are excellent in heat resistance.

A third group of the hydrophilic compound includes an organic compound having carboxyl group (particularly alkali metal salt or ammonium salt). Examples thereof are various organic carboxylic acids and polycarboxylic acids and, in addition, polymers and copolymers of a carboxyl group-containing vinyl monomer such as acrylic acid, methacrylic acid, maleic acid or fumaric acid. Even in the case of low thermoplasticity, an excellent melt fluidity is often obtained if mixed with non-ionic surfactants, polyethylene glycol or the like as mentioned above.

A fourth group of the hydrophilic compound includes a compound having a phosphate group (particularly alkali metal salt or ammonium salt), e.g., sodium salt and potassium salt of a phosphoric acid monoester or diester. In many cases, if these compounds are mixed with non-ionic surfactants, polyethylene glycol or the like in the same manner as above, an excellent melt-fluidity is obtained.

A fifth group of the hydrophilic compound includes a compound having an amino group and/or an amido group, and in particular the quaternary ammonium salt has a high hydrophilic property. Examples of such a compound are, for instance, an alkylamine, a polyamine, an amide obtained by a reaction of an amine and a carboxylic acid, an amido group-containing polymer obtained by copolymerization of acrylamide, polyethyleneimine, polyvinyl pyrrolidone, an amino group-containing polyether obtained by addition reaction of ethylene oxide or the like onto an amine, and the like.

The content of the hydrophilic compound in the composition (B3) is from 1 to 50% by weight, and in many cases, preferably the ontent is from 3 to 30% by weight, especially 5 to 20% by weight.

The main component (at least 50% by weight) of the composition (B3) is an aliphatic polyester, and those easily hydrolyzable with an alkali are preferred. For this purpose, preferred are those having a low crystallinity, for example, having a heat of fusion of at most 30 J/g, especially at most 20 J/g, and the polyesters may be amorphous.

Also, as the aliphatic polyester which constitutes the composition (B3) are preferred those containing at least 10% by weight, especially at least 20% by weight, of an aliphatic polyester component having a melting point of not more than 120° C., especially not more than 100° C., which has been incorporated by means of copolymerization and/or mixing, and particularly preferred are aliphatic polyesters having a melting point of not more than 120° C., especially not more than 100° C. Similarly, it is preferable that the aliphatic polyester has a glass transition temperature of not more than 30° C., especially not more than 0° C. Aliphatic polyesters having a low melting point or a low glass transition temperature have a high rate of hydrolysis in an aqueous alkali solution below 100° C.

The molecular weight of the aliphatic polyester in the composition (B3) is not particularly limited. However, it is desirable in conducting a multi-component fiber melt spinning with the polymer (A3) that the melt viscosity thereof is approximately equal to that of the polymer (A3) or is close thereto. It is also preferable that the weight average molecular weight of the composition as a whole is close to that of the polymer (A3). That is to say, it is preferable that the average molecular weight of the composition (B3) is at least 50,000, especially from 70,000 to 300,000, more especially 80,000 to 200,000.

The composition (B3) is obtained by mixing the aliphatic polyester and the hydrophilic compound. The mixing manner is not particularly limited and, for example, the mixing may be conducted by mixing the pellets or powders of the both components in a predetermined ratio and melt-mixing in a screw extruder, a twin-screw extruder or other mixing machines, or by mixing separately melted both components in a mechanical agitator, or by mixing in a stationary mixer wherein separation and confluence of a polymer flow are repeated by a flow guide device and which may be used in combination with a mechanical agitating machine. Also, the mixing may be conducted in a polymerization step if it does not hinder the polymerization of the aliphatic polyester. The composition (B3) is often completely degraded and removed during the processing step, so it does not remain in final products. Thus, in many cases, the coloration and color fastness thereof does not raise a serious problem. However, it is preferable that the hydrolysis product thereof is completely degraded, for example, by an activated sludge process. It is easy to select an essentially biodegradable compound as the above-mentioned hydrophilic compound.

In the cross section of the conjugated fiber (III), it is required that the composition (B3) divides the polymer (A3)

into at least two portions (hereinafter being sometimes referred to as "layer"). By having such a conjugated structure, the conjugated fiber (III) becomes dividable into a plurality of filaments by degradation and removal of the composition (B3), thus providing fibers having a small fineness and a special cross section. The more the number of layers of the polymer (A3) in a single filament, thinner fibers having a larger specific surface area are obtained. The number of divisions is required to be at least 2, and is widely used within the range of 3 to about 50, especially 4 to about 30. The fiber having a number of divisions of 3 to about 10 is suitable for use in dress, blouse, women's under wear and the like, and the fiber having a number of divisions of 4 to 30 is suitable as ultra-fine fiber for use in ultra-high-density knitted and woven fabrics, non-woven fabric, artificial suede, artificial leather, filter, wiping cloth and the like.

The cross section, fineness and preparation method of the conjugated fiber (III) are the same as the case of the conjugated fiber (IIb). The conjugated fiber (III) are able to have various sectional structures, for example, as shown in FIGS. 3A to 3K, and may have a core-sheath structure and a sea-islands structure as shown in FIGS. 3J and 3K.

The conjugated ratio (sectional area ratio) of the polymer (A3) and the composition (B3) is not particularly limited, and is suitably selected according to the purposes. In many cases, the conjugation ratio is preferably from 20/1 to 1/2, more preferably 10/1 to 1/1. That is to say, in many cases, it is preferable that the proportion of the polymer (A3) is larger than that of the composition (B3), since the weight loss by alkali hydrolysis is small.

The conjugated fiber (III) of the present invention can be formed into a suitable form such as continuous filament, mono-filament, multi-filament, staple and spun yarn according to the purposes.

The conjugated fiber (III) may contain a polyorganosiloxane, as in the conjugated fiber (IIb), in order to weaken the mutual adhesion property between the components (A3) and (B3).

The alkali treatment for the division can be carried out in an aqueous solution of sodium hydroxide, potassium hydroxide, sodium carbonate or other alkaline compounds at ordinary temperature or under heating. The kind of the alkali compound, concentration thereof, pH and treating time are not limited, but in many cases, preferably the pH is at least 7.5, especially at least 8, more especially at least 9, provided that since the polymer (A3) is also hydrolyzed if the pH is too high, the conditions should be selected under which the polymer (A3) is not so much hydrolyzed or impaired.

On the other hand, when the hydrolyzability and peelability are low, a mechanical means such as false twisting, crumpling or beating may be applied, as occasion demands, in addition to heating or swelling. That is to say, besides the division by means of alkali treatment, division by means of other chemical or mechanical methods is adoptable. Mechanical peeling method has the advantage that the weight loss is smaller than a method of division by completely removing the composition (B3) by means of alkali hydrolysis. In general, it is preferable that the peeling is restrained during the preparation of the fiber and during the processing into knitted and woven fabrics, and complete peeling-division is performed after preparing knitted and woven fabrics, for example, in dye finishing step. The reason is that fine fibers and ultra-fine fibers are easy to be cut by friction or the like during preparation and processing steps, thus often causing trouble.

A conjugated fiber wherein a core of a low-melting aliphatic polyester is conjugated with a sheath of a high-melting aliphatic polyester by utilizing a high shrinkability of the low-melting polyester and a shape retainability of the high-melting polyester, exhibits an excellent high shrinkability and can provide spontaneously degradable fiber products having excellent bulkiness, softness, feeling and so on by blending with other spontaneously degradable fibers. Thus, the present invention also provides a fibrous bulk material comprising (X) a core-sheath conjugated fiber composed of a sheath of (A4) a crystalline aliphatic polyester having a melting point of not less than 140° C. and a core of (C) a polymer containing at least 10% by weight of B4) an aliphatic polyester having a melting point lower than that of the polymer (A4) by at least 20° C., and (Y) a spontaneously degradable fiber other than the fiber (X).

The term "fibrous bulk material" means yarn, staple, cotton, tow, web, knitted fabric, woven fabric, non-woven fabric, and structures analogous thereto.

Examples of the crystalline aliphatic polyester (A4) having a melting point of not less than 140° C. suitable for the sheath are homopolymers such as poly-L-lactic acid (m.p. about 175° C.), poly-D-lactic acid (m.p. 175° C.), poly-3-hydroxybutylate (m.p. 180° C.) and polyglycolic acid (m.p. 230° C.), and copolymers and/or mixtures containing them as a main component (at least 50% by weight, especially at least 70% by weight) with a small amount (at most 50% by weight, especially at most 30% by weight) of other components and having a melting point of not less than 140° C. Examples of the other components are, for instance, an aliphatic polyester as mentioned above, e.g., polycaprolactone, aliphatic polyesters composed of an aliphatic glycol such as ethylene glycol or octanediol and an aliphatic carboxylic acid such as succinic acid or decanedicarboxylic acid, raw materials of these polyesters, aromatic polyesters, polyethers, polycarbonates, polyamides, polyureas, polyurethanes, polyorganosiloxanes and the like.

The polymer (A4) which serves as a heat resistant component is required to have a melting point of not less than 140° C., and preferably the melting point thereof is not less than 150° C., especially not less than 160° C. Preferably the heat of fusion of the polymer (A4) is at least 20 J/g, especially from 20 to 55 J/g. Aliphatic polyester homopolymers are preferably used as the polymer (A4), but mixtures or copolymers thereof with an adequate amount of other components are also preferably used for the purpose of improving the heat shrinking resistance, dyeability and others. The molecular weight of the polymer (A4) is not particularly limited, but from the viewpoint of practical use, preferably the molecular weight is at least 50,000, especially from 80,000 to 300,000, more especially 100,000 to 250,000.

On the other hand, the core is made of an aliphatic polyester (C) containing at least 10% by weight of an aliphatic polyester (B4) having a melting point lower than that of the polymer (A4) by at least 20° C. That is to say, the core is formed from the low-melting aliphatic polyester (B4) alone (100%), or a mixture or a block and/or random copolymer which contains at least 10% by weight of the polyester (B4).

Like this, the polymers used in the core and the sheath can be any of homopolymers, mixtures of a plurality of polymers, and block and/or random copolymers of a plurality of polymers. For example, a mixture or block copolymer of poly-L-lactic acid and polybutylene adipate in a ratio of 90/10 by weight, and a random copolymer of the raw materials of these polymers contain 10% by weight of polybutylene adipate which is a low-melting component, and can be used as the polymer (C) for the core.

A large feature of the above-mentioned conjugated fiber (X) resides in that the sheath is made of a heat resistant component with high melting temperature and the core is made of a high shrinkable component containing a low-melting component. For example, if heated at a temperature at which the low-melting aliphatic polyester component is softened or melted but the high-melting aliphatic polyester component (sheath component A) is not softened or melted, the conjugated fiber strongly shrinks but the fiber as a whole maintains its shape without being softened of melted. This effect is marked when the aliphatic polyester component (B4) with low melting temperature is used alone (100%) or as a main component in the core, and when it is incorporated in the form of a block copolymer or a mixture (melting point being observed clearly). In case of the polymer (C) wherein the low-melting component (B4) is incorporated in a small amount by means of random copolymerization, the melting point based on the low-melting component is not clearly observed, but the effect of increasing the shrinkability is sufficiently found. In all cases, the larger the proportion of the core (C), and the larger the content of the low-melting component (B4) in the core (C), the higher the heat shrinkability of the conjugated fiber (X). By suitably selecting them, it is possible to realize a wide range of the heat shrinking temperature and the shrinkage percentage and to adapt for various purposes.

In general, a low-melting aliphatic polyester has a tendency that the fibers are easy to stick to each other at the time of melt-spinning and an efficient preparation of the fibers by melt-spinning is often very difficult. However, the conjugated fiber (X) is easy to perform melt-spinning although a low-melting component is used in the core, since the core is protected by a sheath of a high-melting polymer. Further, in general, a low-melting component is sensitive to an aqueous alkali solution and so on and is easily and rapidly hydrolyzed. However, although a low-melting component is used in the conjugated fiber (X), it is protected by the sheath of a high-melting component relatively slow in hydrolysis and there is a tendency that the rate of alkali weight reduction is relatively slow and, therefore, the fiber (X) has also the advantage that an alkali weight reduction processing thereof is easy. This advantage is particularly effective when an alkali weight reduction processing is applied, after the fiber is formed with other fibers into knitted or woven fabrics, to remove about 5 to abut 30% of the polymer in the surface of the fiber, thereby imparting an excellent softness to the articles. It is particularly preferred to the alkali weight reduction processing that the core and the sheath are concentrically disposed, that is to say, the both centers of gravity coincide in the cross section, and that the thickness of the sheath is approximately constant.

A first group of polyesters suitable as the low-melting component (B4) are those containing as a main component a low-melting aliphatic polyester having a melting point of not more than 120° C. Examples thereof are, for instance, an aliphatic polylactone such as polycaprolactone (m.p. about 59° C.) or polypropiolactone (m.p. about 95° C.); an aliphatic polyester having a melting point of not more than 120° C. obtained from a combination of at least one aliphatic glycol such as ethylene glycol, propylene gylcol, butanediol, hexanediol, octanediol, diethylene glycol or triethylene glycol and at least one aliphatic dicarboxylic acid such as succinic acid, adipic acid, azelaic acid, sebacic acid, octanedicarboxylic acid or decanedicarboxylic acid, e.g., homopolymers such as polyethylene succinate (m.p. about 102° C.), polyethylene adipate (m.p. about 49° C.), polyethylene sebacate (m.p. about 65° C.), polyethylene azelate (m.p. about 52° C.), polyethylene sebacate (m.p. about 75° C.), polybutylene succinate (m.p. about 116° C.), polybutylene adipate (m.p. about 72° C.), polybutylene sebacate (m.p. about 66° C.) and polyhexane sebacate (m.p. about 74° C.), and block or random copolymers containing them as a main component; and mixtures or copolymers containing these low-melting aliphatic polyesters as a main component (at least 50% by weight) and at most 50% by weight of other components such as a high-melting polyester or raw materials of aromatic polyesters.

A second group of polyesters suitable as the low-melting component (B4) are copolymers and/or mixtures containing as a main component (at least 50% by weight) a high-melting aliphatic polyester having a melting point of not less than 140° C. into which other components have been incorporated to sufficiently lower the melting point and the crystallinity (e.g., by at least 20° C.). For example, if poly-L-lactic acid and at least 3% by mole, especially at least 4% by mole, of D-lactic acid are subjected to random copolymerization, a copolymer having a melting point lower than that of poly-L-lactic acid (homopolymer) by at least 20° C. is easily obtained. Copolymers of optical isomers and copolymers obtained from a combination of different kinds of hydroxycarboxylic acids such as lactic acid/glycolic acid, lactic acid/butyric acid or butyric acid/valeric acid and a combination of these hydroxycarboxylic acids with an aliphatic lactone such as caprolactone or butyrolactone are mentioned.

A combination, for instance, a block copolymer, as mentioned above of a high-melting aliphatic polyester and a low-melting aliphatic polyester composed of an aliphatic dicarboxylic acid and an aliphatic glycol is suitably used as the core component (C) of the conjugated fiber (X) if the content of the low- melting aliphatic polyester is at least 10% by weight. For example, a block copolymer of poly-L-lactic acid/polybutylene adipate in a ratio of 70/30 contains 30% by weight of a low-melting component and accordingly is suitable as the core component (C) of the conjugated fiber (X). With respect to the copolymerization manner, random copolymerization is effective for lowering the melting point and the crystallinity, and block copolymerization has a feature that a low-melting component can be introduced without excessively impairing the crystallinity and the heat resistance, thus they are useful. Similarly, it is also possible to copolymerize the high-melting aliphatic polyester such as polylactic acid or the raw materials thereof with a small amount of raw materials for aromatic polyesters. Also, mixing with a small amount of other components may be adaptable.

The higher the content of the low-melting aliphatic polyester component (B4) in the core component polymer (C), the larger the heat shrinkability of the conjugated fiber (X). The content of the low-melting aliphatic polyester component (B4) is at least 10% by weight, preferably at least 20% by weight, more preferably from 25 to 100% by weight. Further, in order to improve the shrinkability and the elastic restoration property, the core polymer and/or the sheath polymer may contain a small amount (within a range capable of performing melt-polymerization and melt-spinning) of a branched structure or a crosslinked structure. For this purpose, it is possible to use polyester raw materials having a trifunctional group, e.g., trimellitic acid, glycerol and others in a small amount (e.g., at most 5% by mole, especially at most 3% by mole). Also, introduction of 5 to 70% by weight, especially 10 to 60% by weight, of a high-melting component identical or analogous to the sheath component (A4) into the core polymer (C) is often convenient for increasing the adhesion between the core and the sheath, imparting an adequate heat settability, or effectively causing shrinkage when heated later.

The low-melting component (B4) is required to have a melting point lower than that of the sheath component (A4) by at least 20° C. Preferably this temperature difference is at least 30° C., especially within the range of about 40 to about 120° C. For example, when the melting point of the sheath component (A4) is 175° C. and the melting point of the low-melting component (B4) is in the vicinity of 100° C., a sufficient shrinkage percentage is obtained by wet heating or dry heating at a temperature of 90 to 130° C. It is preferable that during the preparation step of the conjugated fiber, the polymer of the core component (C) undergoes temporary setting (heat setting) of molecular orientation produced by drawing, and in a later heat shrinking step, the setting is released to cause shrinking. That is to say, it is preferable that the core component is crystalline or contains a component having a glass transition temperature of not less than ordinary temperature. In many cases, from the viewpoint of elastic restoration property, as the core component (C) are preferred those containing some amount of component having a low glass transition temperature (below ordinary temperature) and being somewhat low crystalline, namely having a heat of fusion of about 5 to about 40 J/g, especially about 10 to about 30 J/g. The above-mentioned low-melting aliphatic polyesters almost have a glass transition temperature below ordinary temperature, and many of them have a glass transition temperature of not more than 0° C., but polylactic acid peculiarly has a glass transition temperature as high as 58° C. Therefore, as to an aliphatic polyester having a melting point of 40 to 120° C., especially 60 to 120° C., its homopolymer is preferable as the core component (C), and a mixture and/or copolymer (random and/or block copolymers) thereof with a small amount of other components (high-melting component and the like) are also preferable.

The molecular weight of the core component (C) is not particularly limited, but preferably it is at least 50,000, especially from 80,000 to 300,000, more especially from 100,000 to 250,000.

The polymers (A4) and (C) contain an aliphatic polyester as a main component, but may contain as a secondary component (at most 50% by weight, especially at most 30% by weight) other components such as aromatic component, polyether component, polycarbonate component, polyurethane component, polyamide component, polyorganosiloxane component and others.

The conjugated fiber (X) can be prepared by a usual multi-filament fiber spinning method as mentioned above. The conjugation ratio (sectional area ratio) is not particularly limited, but the sheath/core ratio is usually from 5/95 to 80/20, preferably 10/90 to 70/30, more preferably 15/85 to 60/40. When the proportion of the sheath is as very low as 2 to 10%, the sheath becomes very thin and the shrinkability is very high, so the sheath shows an uneven appearance like a bellows of camera after the core has strongly shrinked to give a unique dry (low in friction coefficient) feeling, thus useful for special knitted and woven fabrics.

The shrinkage percentage of the conjugated fiber (X) can be arbitrarily changed within a wide range by means of polymer used, conjugated ratio, degree of orientation (drawing ratio), heat treatment and the like. In order to obtain a high shrinkability, the heat treatment after drawing is not conducted or is conducted at a relatively low temperature. It is preferable that the shrinkage percentage of the conjugated fiber (X) when treated in boiling water for 10 minutes under unloaded condition is at least 15%, especially at least 20%, more especially from about 25 to about 70%.

The conjugated fiber (X) can be formed into any form such as continuous multifilament, continuous monofilament, staple or the like, and it is optionally blended with other fibers by various means and is used in yarn, knitted fabric, woven fabric, non-woven fabric, felt, composite with paper or film, and other analogous fibrous bulk materials, namely fiber structures.

The other fiber to be blended with the conjugated fiber (X) is not particularly limited so long as it is spontaneously degradable, but a fiber having a low heat shrinkability, for example, having a shrinkability in boiling water of less than 15%, especially at most 12%, more especially at most 10% (including those extendable by heating) is preferred. Cotton, hemp or the like, wool and silk are preferable among natural fibers, and regenerated cellulose fiber and aliphatic polyester fiber are preferable among synthetic fibers. For example, a particularly preferable example is a mixture of a conjugated fiber (X) composed of a sheath of a polyester composed mainly of polylactic acid (polymer A4) and a core of a block copolymer of a low-melting aliphatic polyester having a melting point of about 100° C. and about 20 to about 80% by weight of polylactic acid with a polyester fiber (Y) made of polylactic acid as a main component. The mixing manner and the structure are not particularly limited, but typical examples are combinations of filament/filament, filament/staple and staple/staple, and preferable examples of embodiments of the present invention are so-called spinning blending, drawing blending, yarn doubling, doubling and twisting, false twisting and blending, mixed fiber web, mixed fiber spinning, core spun yarn, and mixed fiber woven, knitted and non-woven fabrics using them. The larger the difference in heat shrinkage percentage between the conjugated fiber (X) and the other fiber (Y) to be added, the more excellent in bulkiness and softness of the obtained textile goods. Preferably the difference in shrinkage percentage is from about 5 to about 70%, especially about 10 to about 50%, more especially about 15 to about 40%.

As mentioned above, in case of subjecting fiber structures prepared from a combination of conjugated fiber (X) and other fiber (Y) to an alkali weight reduction processing, it is preferable that the alkali resistance of the sheath polymer of the conjugated fiber (X) is approximately identical (1/2 to 2/1) with or higher than that of the other fiber (Y). When it is planned to conduct an alkali weight reduction processing, the conjugation proportion of the sheath is at least 10%, preferably at least 20%, more preferably from 30 to 50%, since usually the weight loss by alkali treatment is from 5 to 30%, especially about 10 to about 25%.

To heating for shrinking the conjugated fiber (X) to thereby impart bulkiness and softness to the fibrous bulk materials are applicable dry heating, wet heating, infrared rays and other methods.

It is possible to control or adjust the crimping by changing the heating temperature, temperature elevation rate, heating time or degree of tension (such as tensile force). The heat shrinking can be conducted in the state of filament, tow, staple, cotton, yarn, knitted fabric, woven fabric, non-woven fabric, web and other suitable forms. In many cases, the crimping is conducted by heating yarn, tow, cotton, web, knitted fabric, woven fabric, non-woven fabric or the like under no tension or low tension to produce a difference in length between both fibers of at least 3%, especially at least 5%, often about 7 to about 50%, thereby revealing a bulkiness and a softness. In case of clothes, the shrinking treatment is often conducted before or during a finishing step such as scouring or dyeing.

Figure 5A:
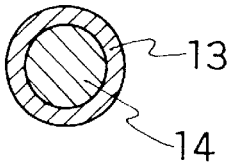
FIG. 5A shows a concentric type core-sheath conjugated fiber.
Figure 5B:
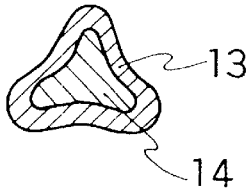
FIG. 5B shows a non-circular concentric type core-sheath conjugated fiber.
Figure 5C:
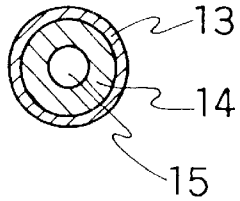
FIG. 5C shows a hollow concentric type core-sheath conjugated fiber.

Examples of the cross sections of the conjugated fiber (X) used in the present invention are shown in FIGS. 5A to 5C, wherein 13 is a sheath and 14 is a core. FIG. 5A shows a concentric circular type conjugated fiber, FIG. 5B shows a non-circular type (triangular) conjugated fiber, and FIG. 5C shows a concentric type hollow conjugated fiber. In FIG. 5C, 15 is a hollow portion, and in the hollow portion may be disposed a third polymer or the same polymer as that of the sheath. The concentric type wherein the center of gravity of the sheath nearly (substantially) coincides with that of the core, is preferable since multi-filament fiber spinning is easy. Besides those shown in FIGS. 5A to 5C, there are various concentric core-sheath types, e.g., a combination of a circular fiber and a non-circular core, a combination of a non-circular fiber and a circular core and a concentric disposition of a plurality of cores, and they are applicable to the present invention. A structure wherein the core and the sheath are eccentrically disposed is also applicable to the present invention, but the concentric type is particularly preferred from the viewpoints of alkali weight reduction processing and easiness of multi-filament fiber spinning. By the way, the sheath occupies the whole surface area of the fiber and the core is not exposed to the surface.

Figure 6A:
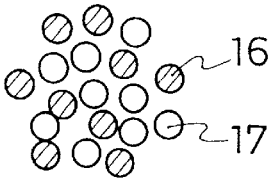
FIG. 6A shows a composite yarn in which a conjugated fiber 4 and other fiber 5 are uniformly mixed.
Figure 6B:
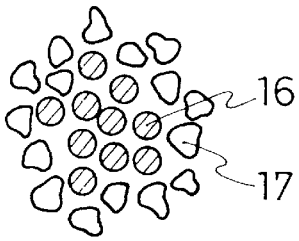
FIG. 6B shows a composite yarn in which both fibers are mixed in a core-sheath type.
Figure 6C:
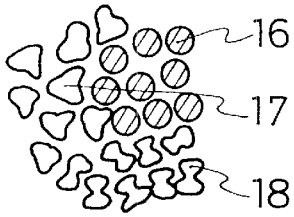
FIG. 6C shows a composite yarn in which a conjugated fiber 4 and two kinds of other fibers 5 and 6, namely three kinds of fibers in total, are mixed in a parallel fashion.

FIGS. 6A to 6C are cross sectional views of a yarn (composite yarn) comprising a mixture of a conjugated fiber (X) and other fiber (Y), which illustrate embodiments of the present invention. In the figures, is a conjugated fiber (X), 17 is other fiber (Y), and 18 is another fiber. FIG. 6A shows a composite yarn wherein nine filaments of a conjugated fiber (X) having a circular cross section are almost uniformly blended with nine filaments of other fiber (Y) having a circular cross section. FIG. 6B shows a core-sheath type composite yarn wherein a conjugated fiber (X) having a circular cross section is disposed in the center portion and other fiber (Y) having a non-circular cross section is disposed around the fiber (X). FIG. 6C shows a composite yarn wherein a conjugated fiber (X) having a circular cross section and two kinds of other fibers (Y) having a non-circular cross section are blended in parallel relationship.

The blending ratio of the conjugated fiber (X) and the other fiber (Y) is not particularly limited, but usually the X/Y ratio is selected from 5/95 to 95/5 (by weight), especially 10/90 to 90/10, more especially 20/80 to 80/20.

The sectional shapes of the conjugated fiber (X) and the other fiber (Y) are not particularly limited, and can be circular, non-circular, polygonal, multi-blade and hollow shapes and the like. The finenesses of the conjugated fiber (X) and the other fiber (Y) are suitably selected according to the purposes. In case of the fibers for usual clothes, the fineness of a filament is from about 0.1 to about 50 d, preferably from 0.5 to 30 d, and is widely used within the range of 1 to 20 d. The thinner or thicker fibers are adaptable for non-woven fabrics, leathers and materials. The conjugated fiber (X) may be mechanically provided with a crimp by a false twisting method or a thrusting method, as occasion demands. It is desired that sticking of fibers is not caused by the heating in a crimping step, and from this point of view, the conjugated fiber (X) protected by a high-melting sheath used in the present invention is preferable because of causing sticking with difficulty.

The respective fibers and conjugated fibers which constitute the composite yarn of the present invention can contain various kinds of pigment, dye, colorant, water repellent, water absorbent, flame retarder, stabilizer, antioxidant, ultraviolet absorber, metallic particles, inorganic compound particles, nucleating agent, lubricant, plasticizer, fungicide, perfume, and other additives.

The composite yarns and conjugated fibers of the present invention can be used alone or in combination with other fibers for the preparation of yarn, braid, rope, knitted fabric, woven fabric, non-woven fabric, paper, composite materials and other structures. In case of using with other fibers, natural organic fibers such as cotton, wool or silk and spontaneously degradable fibers such as aliphatic polyester fiber are particularly preferable as other fibers, since fully spontaneously degradable articles are obtained.

The fibers of the present invention are spontaneously degradable and scarcely pollute environment and, moreover, they can provide articles having excellent softness, bulkiness, elasticity, heat resistance and stretchability such as knitted fabrics, woven fabrics and non-woven fabrics and can be suitably utilized in various clothes, industrial materials, household goods and the like. The fibers of the present invention are superior in preparation efficiency and are inexpensive, since the melt spinning is easy. Further, the self-crimpable fibers have the advantages that they are easy to use and the range of application is very wide, since crimping of various strengths can be achieved. Also, the self-adhesive fibers have the advantages that the adhesion is possible with a desired strength in a wide temperature range and, therefore, the fibers are easy to use and the range of application is very wide and, moreover, the articles subjected to adhesion have a high heat resistance. Further, the dividable fibers of the present invention can be easily divided and can provide spontaneously degradable, very soft, high performance textile goods. In general, aliphatic polyester fibers are not only degradable under natural environment, but also are small in heat generation amount in burning as compared with conventionally used synthetic fibers and, therefore, incineration is easy. Especially polylactic acid does not cause an increase of carbon dioxide gas in air, because the raw material lactic acid is obtained from agricultural products by a fermentation method or the like and polylactic acid is put into a cycle of matter in nature. Thus, aliphatic polyesters containing polylactic acid as a main component are the most preferable from the viewpoint of environmental protection.

The present invention is then explained on the basis of examples, but it is to be understood that the present invention is not limited to these examples. In the examples, % and parts are by weight unless otherwise noted.

In the present invention, the molecular weight of aliphatic polyesters indicates a weight average molecular weight of a polymer component excepting a component having a molecular weight of not more than 1,000, measured by GPC analysis of a 0.1% solution of a sample in chloroform.

The crimp elongation of conjugated fibers is obtained by forming sample filaments to a tow having a thickness of about 1,000 (950 to 1,050) deniers and a length of 50 cm, treating it in boiling water for 10 minutes under unloaded condition, dehydrating by centrifugation, air-drying in a room of 23° C. and a humidity of 65% for at least 24 hours under unloaded condition, measuring a length L1 of the sample 1 minute after applying a load of 0.5 g, then measuring a length L2 of the sample 1 minute after applying a load of 500 g, and calculating according to the equation: $[(L2-L1)/L1]\times 100$ (%).

The heat shrinkage percentage of fibers is obtained by forming sample filaments to a tow having a thickness of about 1,000 deniers and a length of 50 cm, treating it in boiling water for 10 minutes under unloaded condition, air-drying in a room of 22° C. and a humidity of 65% for 24 hours, and calculating from the length L3 of the sample before the treatment and the length L4 of the sample treated and dried according to the equation of [(L3−L4)/L3]×100 (%). The length of a fiber is measured 1 minute after applying a load of 10 mg per denier.

EXAMPLE 1

Three parts of polyethylene glycol (PEG) having a molecular weight of 8000 and containing hydroxyl groups at the both molecular ends, 98 parts of L-lactide, 100 ppm of tin octylate and 0.1 part of Irganox 1010, i.e. an antioxidant produced by Ciba Geigy Corp. were mixed, and then polymerized by melting and stirring in a nitrogen atmosphere at 190° C. for 12 minutes by a twin-screw extruder. Then after cooling and forming into chips, the chips were treated (solid phase polymerization) in a nitrogen atmosphere at 140° C. for four hours to give a block copolymer P1 of polylactic acid and PEG. The polymer P1 had a molecular weight of 153000, a content of a PEG component of about 3%, a melting point of 174° C. and had a heat of fusion of 55 J/g when sufficiently orientated and crystallized. Further a polymer P2 was obtained in the same manner as in the polymer P1 except that a mixture of 95.5 parts of L-lactide and 2.5 parts of D-lactide was used as the lactide. The polymer P2 had a molecular weight of 158000, a melting point of 163° C. and a heat of fusion of 27 J/g.

The polymers P1 and P2 were melted separately by a screw extruder of 220° C., and supplied to two polymer feed parts of a spinneret for production of conjugated yarn. The both polymers were conjugated in a parallel type (conjugation ratio 1/1) as shown in FIG. 1A and spun out through an orifice of 225° C. having a diameter of 0.25 mm. While cooling in air and oiling, the spun filament was wound at a speed of 1500 m/min and then drawn at 80° C. in a drawing ratio of 4.5 to give a drawn yarn F1 of 70 deniers/24 filaments. The drawn yarn F1 was excellent one having a tenacity of 4.6 g/d and an elongation of 29% and showing a crimp elongation of 226% after revelation of the crimp.

For comparison, a polylactic acid homopolymer P3 was prepared in the same manner as in the polymer P1 except that PEG was not used. The polymer P3 had a molecular weight of 162000, a melting point of 175° C. and a heat of fusion of 55 J/g. Further a polymer P4 was prepared in the same manner as in the polymer P1 except that 6 parts of PEG and 95 parts of L-lactide were used. The polymer P4 was one having a molecular weight of 155000, a melting point of 173° C. and a heat of fusion of 55 J/g though PEG was contained as a copolymerizing component in an amount of about 6%. By using the polymers P3 and P4, a drawn yarn F2 (Comparative Example) was produced in the same manner as in the drawn yarn F1. The drawn yarn F2 had a strength of 4.8 g/d and an elongation of 31% and showing a crimp elongation of 19% after revelation of the crimp, and was very low in crimpability.

EXAMPLE 2

A polymer P5 was prepared in the same manner as in the preparation of the polymer P1 of Example 1 except that instead of the PEG, 30 parts of polybutylene succinate having a molecular weight of 127000 and containing hydroxyl group at the molecular end was used. The polymer P5 had a molecular weight of 129000, a melting point of 162° C. and a heat of fusion of 35 J/g.

A polymer P6 was prepared in the same manner as in the polymer P1 except that instead of the PEG, 10 parts of polybutylene succinate having a molecular weight of 127000 and containing hydroxyl group at the molecular end and instead of the L-lactide, 88.5 parts of L-lactide and 2.52 parts of D-lactide were used. The polymer P6 had a molecular weight of 134000, a melting point of 151° C. and a heat of fusion of 26 J/g.

A drawn yarn F3 was produced in the same manner as in the drawn yarn F1 of Example 1 by using the polymers P1 and P5. The drawn yarn F3 had a tenacity of 4.7 g/d, an elongation of 28% and a crimp elongation of 223%, and thus was excellent in crimpability.

Similarly a drawn yarn F4 was produced in the same manner as in the drawn yarn F1 of Example 1 by using the polymers P1 and P6. The drawn yarn F4 had a tenacity of 4.6 g/d, an elongation of 29% and a crimp elongation of 236%, and thus was excellent in crimpability.

EXAMPLE 3

The block copolymer P1 of polylactic acid and PEG was prepared in the same manner as in Example 1. The polymer P1 was melted by a screw extruder of 230° C., and spun out through an orifice of 225° C. having a diameter of 0.2 mm. With cooling in air and oiling, the spun filament was wound at a speed of 1500 m/min, drawn at 80° C. in a drawing ratio of 4.5 and heat-treated at 110° C. under a tension to give a drawn yarn A1 of 40 deniers/12 filaments. The drawn yarn A1 had a tenacity of 4.5 g/d, an elongation of 29% and a shrinkage of 12% in boiling water.

Further the polymer P2 was prepared in the same manner as in Example 1. The polymer P2 was melted by a screw extruder of 220° C., and spun out through an orifice of 225° C. having a 0.2 mm diameter. With cooling in air and oiling, the spun filament was wound at a speed of 1500 m/min, drawn at 80° C. in a drawing ratio of 4.5 to give a drawn yarn B1 of 60 deniers/12 filaments without heat-treating. The drawn yarn B1 had a tenacity of 4.4 g/d, an elongation of 33% and a shrinkage of 27% in boiling water.

Each one of the drawn yarns A1 and B1 was mixed by means of an air nozzle to give a combined filament yam MY1 having the both drawn yarns uniformly mixed in its section. A twill fabric was produced by using a yarn obtained by twisting the combined filament yarn at 600 T/m as a warp and a twisted yarn of 30 T/m as a weft in a ratio of 2/1. The obtained twill fabric was, after scouring, heat-treated at 120° C. for 15 minutes by dry heating under relaxation and further was subjected to treatment (decrease in weight) at 80° C. for 10 minutes with a 0.5% aqueous solution of caustic soda, followed by washing, adding 0.2% of a soft-finishing agent and then heat-treating at 135° C. under a tension to give a woven fabric MF1.

For comparing purpose, a polylactic acid homopolymer P3 having a melting point of 175° C. and a heat of fusion of 55 J/g and a polylactic acid/PEG block copolymer P4 having a melting point of 174° C. and a heat of fusion of 55 J/g were prepared in the same manner as in Example 1. By using the polymer P3, a drawn yarn A2 of 40 deniers/12 filaments was produced in the same manner as in the drawn yarn A1. The drawn yarn A2 had a tenacity of 4.6 g/d, an elongation of 30% and a shrinkage of 12% in boiling water. By using the polymer P4, a drawn yarn B2 of 60 deniers/12 filaments was produced in the same manner as in the drawn yarn A1. The drawn yarn B2 had a tenacity of 4.5 g/d, an elongation of 29% and a shrinkage of 15% in boiling water. Each one of the drawn yarns A2 and B2 was blended uniformly by means of an air nozzle to give a combined filament yarn MY2. A woven fabric MF2 was produced in the same manner as in the woven fabric MF1 except that the process for weight reduction by alkali treatment was carried out with a 0.6% of caustic soda for 30 minutes by using the combined filament yarn MY2. Characteristics of the woven fabrics MF1 and MF2 are shown in Table 1.

TABLE 1

| Woven fabric | Softness | Bulkiness | Feeling | Remarks |
|---|---|---|---|---|
| MF1 | Good | Good | Good | Present Invention |
| MF2 | Not good slightly | Not good slightly | Not good slightly | Comparative Example |

EXAMPLE 4

Polylactic acid/polybutylene succinate block copolymers P5 and P6 were prepared in the same manner as in Example 2.

By using the polymer P5, a drawn yarn B3 was obtained in the same manner as in the drawn yarn B1 of Example 3 except that a one-step method for spinning and drawing continuously was employed, a spinning speed was 4000 m/min, a drawing temperature was 80° C., a drawing ratio was 1.6 and heat-treatment was not carried out. The drawn yarn B3 had a tenacity of 4.7 g/d, an elongation of 33% and a shrinkage of 38% in boiling water.

A drawn yarn A3 was produced in the same manner as in the drawn yarn B3 except that the polymer P1 of Example 3 was used and after the drawing, heat-treatment was carried out at 120° C. The drawn yarn A3 had a tenacity of 4.9 g/d, an elongation of 29% and a shrinkage of 13% in boiling water.

A drawn yarn B4 was produced in the same manner as in the drawn yarn B3 except that the polymer P6 was used. The drawn yarn B4 had a tenacity of 4.6 g/d, an elongation of 29% and a shrinkage of 35% in boiling water.

The drawn yarns A3 and B3 were blended by an air nozzle, and a woven fabric MF3 was produced in the same manner as in the woven fabric MF1 of Example 3. Softness, bulkiness and feeling of the woven fabric MF3 were all excellent. Similarly softness, bulkiness and feeling of the woven fabric MF4 obtained from the combined filament yarn comprising the drawn yarns B4 and A3 were excellent.

EXAMPLE 5

Three parts of a polyethylene glycol (PEG) having a molecular weight of 8000 and containing hydroxyl groups at the both molecular ends, 98 parts of L-lactide, 100 ppm of tin octylate and 0.1 part of Irganox 1010, i.e. an antioxidant produced by Ciba Geigy Corp. were mixed, and then polymerized by melting and stirring in a nitrogen atmosphere at 188° C. for 12 minutes in a twin-screw extruder. Then after cooling and forming into chips, the chips were treated (solid phase polymerization) in a nitrogen atmosphere at 140° C. for four hours to give a block copolymer P1 of polylactic acid and PEG. The polymer P1 had a molecular weight of 155000, a content of a PEG component of about 3% and a melting point of 175° C., and a heat of fusion of a fiber when sufficiently oriented and crystallized was 55 J/g. The polymer P1 was melted by a screw extruder of 230° C., and spun out through an orifice of 225° C. having a 0.2 mm diameter. With cooling in air and oiling, the spun filament was wound at a speed of 1500 m/min, drawn at 80° C. in a drawing ratio of 4.5 and heat-treated at 110° C. under a tension to give a drawn yarn A1 of 40 deniers/12 filaments. The drawn yarn A1 had a tenacity of 4.5 g/d, an elongation of 29% and a shrinkage of 12% in boiling water.

Thirty parts of a random copolymer comprising a polybutylene succinate (PBS) and polybutylene adipate (PBA) in a ratio of 4/1 (mole ratio) and having a molecular weight of 125000, a melting point of 92° C. and a heat of fusion of 57 J/g, 71 parts of L-lactide, 0.1 part of the above-mentioned Irganox and 100 ppm of tin octylate were mixed, and then a block copolymer BP1 was prepared in the same manner as in the polymer P1. A molecular weight of the BP1 was 147000. In the BP1, there were two major melting points of 166° C. and 85° C., and heat of fusion thereof were 32 J/g and 12 J/g, respectively. It is presumed that each melting point corresponds to crystals of a poly-L-lactic acid segment (block) and crystals of a PBS/PBA copolymer segment, respectively.

The copolymer BP1 was melted by a screw extruder of 220° C., and spun out through an orifice of 225° C. having a 0.2 mm diameter. With cooling in air and oiling, the spun filament was wound at a speed of 1500 m/min, drawn at 80° C. in a drawing ratio of 4.5 to give a drawn yarn B5 of 40 deniers/12 filaments without heat-treating. The drawn yarn B5 had a tenacity of 4.3 g/d, an elongation of 35% and a shrinkage of 36% in boiling water.

Each one of the drawn yarns A1 and B5 was blended by means of an air nozzle to give a combined filament yarn MY3 having the both yarns uniformly blended in its section. A twill fabric was produced by using a yarn obtained by twisting the combined filament yarn MY3 at 600 T/m as a warp and a twisted yarn of 30 T/m as a weft in a ratio of 2/1. The obtained twill fabric was treated under relaxation for 15 minutes in water of 98° C. containing a scouring agent and further was subjected to treatment (process for weight reduction) at 60° C. for 10 minutes in a 2.5% aqueous solution of sodium carbonate, followed by washing, adding 0.2% of a soft-finishing agent and then heat-treating at 120° C. under a tension to give a woven fabric MF5.

For comparison, a woven fabric MF6 was produced in the same manner as in the MF5 by using a yarn obtained by blending and twisting two drawn yarns A1. Characteristics of the woven fabrics MF5 and MF6 are shown in Table 2.

TABLE 2

| Woven fabric | Softness | Bulkiness | Feeling | Remark |
|---|---|---|---|---|
| MF5 | Good | Good | Good | Present Invention |
| MF6 | Not good slightly | Not good slightly | Not good | Comparative Example |

EXAMPLE 6

Thirty parts of pellets of the PBS/PBA copolymer of Example 5, 10 parts of pellets of the copolymer PB1 (for improving affinity) and 70 parts of pellets of the polymer P1 were mixed, melt-mixed at 225° C. by a twin-screw extruder and spun out through a spinneret of 225° C. Then a drawn yarn B6 was produced in the same manner as in the drawn yarn B5 of Example 5. The drawn yarn B6 had a tenacity of 4.3 g/d, an elongation of 33% and a shrinkage of 33% in boiling water, and a melting point and a heat of fusion thereof were 172° C., 31 J/g, 88° C. and 17 J/g. A combined filament yarn MY4 was produced in the same manner as in the combined filament yarn MY3 of Example 5 by using each of the drawn yarn A1 of Example 5 and the drawn yarn B6. Then the woven fabric MF7 was produced in the same manner as in the woven fabric MF5 of Example 5 by using the combined filament yarn MY4. Softness, bulkiness, feeling and the like of the woven fabric MF7 were nearly the same as those of MF5 of Example 5 and far excellent as compared with MF6 of Comparative Example. Thus an effect of blending the fibers could be recognized sufficiently.

EXAMPLE 7

Three parts of a polyethylene glycol (PEG) having a molecular weight of 8000 and containing hydroxyl groups at the both molecular ends, 98 parts of L-lactide, 100 ppm of tin octylate and 0.1 part of Irganox 1010, i.e. an antioxidant produced by Ciba Geigy Corp. were mixed, and then polymerized by melting and stirring in a nitrogen atmosphere at 188° C. for 12 minutes in a twin-screw extruder. Then after cooling and forming into chips, the chips were treated (solid phase polymerization) in a nitrogen atmosphere at 140° C. for four hours to give a block copolymer P1 of polylactic acid and PEG. The polymer P1 had a molecular weight of 155000, a content of a PEG component of about 3% and a melting point of 175° C. and a heat of fusion of a fiber sufficiently oriented and crystallized was 55 J/g.

Thirty parts of a polybutylene succinate (PBS) having a molecular weight of 125000, a melting point of 114° C. and a heat of fusion of 68 J/g, 71 parts of L-lactide, 0.1 part of the above-mentioned Irganox and 100 ppm of tin octylate were mixed and then polymerized in the same manner as in the polymer P1 to give a block copolymer BP2. A molecular weight of BP2 was 137000, and there were two main melting points of 165° C. and 103° C. and the respective heat of fusion thereof were 28 J/g and 27 J/g. It is presumed that those two melting points correspond to crystals of a poly-L-lactic acid segment (block) and crystals of a PBS segment.

The polymer P1 and copolymer BP2 were melted separately in a screw extruder of 220° C., weighed, and fed by a geared pump to a spinneret for production of conjugated yarn to conjugate the both polymers in a ratio of 1/1 (volume ratio) in a parallel type as shown in FIG. 1A, followed by spinning out through an orifice of 225° C. having a diameter of 0.2 mm. Then with cooling in air and oiling, the spun out filament was wound at a speed of 1500 m/min and drawn at 70° C. in a drawing ratio of 4.1 to give a drawn yam Y1 of 150 deniers/48 filaments. The drawn yarn Y1 had a tenacity of 4.1 g/denier, an elongation of 27% and an excellent crimp elongation of 231% when the crimp was revealed in water of 100° C.

For comparison, the polymer P1 was melted and spun out alone through an orifice of 225° C. having a diameter of 0.2 mm, and then a drawn yarn R1 was produced in the same manner as in the drawn yarn Y1. Similarly a drawn yarn R2 was obtained from the copolymer BP2. Heat shrinkages of R1 and R2 were 11.4% and 37.4%, respectively.

EXAMPLE 8

Pellets of the PBS of Example 7 and pellets of the polymer P1 were mixed in a ratio of 2/3 (weight ratio), melted by a screw extruder of 220° C., passed through a Kenix static mixer having 30 elements and supplied to a spinneret for production of conjugated yarn to be conjugated with the separately melted polymer P1 in a parallel type as shown in FIG. 1A. Then a drawn yarn Y2 was obtained in the same manner as in the drawn yarn Y1 of Example 7. The drawn yarn Y2 had a tenacity of 4.1 g/d, an elongation of 27% and an excellent crimp elongation of 202% when the crimp was revealed in water of 100° C. For comparison, a drawn yarn R3 was produced from a polymer mixture of the above-mentioned PBS and P1. A shrinkage of the drawn yarn R3 was 29.6% and melting points thereof according to a DSC analysis were 174° C. and 110° C. Heat of fusion for the respective melting points were 26.3 J/g and 25.5 J/g.

EXAMPLE 9

A block copolymer P1 of a poly-L-lactic acid and PEG and a block copolymer BP2 of a poly-L-lactic acid and polybutylene succinate (PBS) were prepared in the same manner as in Example 7.

The polymer P1 and copolymer BP2 were melted separately by a screw extruder of 220° C., weighed, and fed by a geared pump to a spinneret for production of conjugated yarn to conjugate the polymer BP2 as a sheath with the polymer P1 as a core in a ratio of 2/1 (volume ratio) into a concentric type as shown in FIG. 4A. Then the conjugated polymer was spun out through an orifice of 225° C. having a diameter of 0.2 mm, and with cooling in air and oiling, wound at a speed of 1500 m/min. Then the obtained filaments were gathered to give a tow which was then drawn at 70° C. in a drawing ratio of 3.9, and thus a tow T1 was obtained. A fineness of a single filament was 3 deniers.

The polymer P1 was melted at 220° C. and spun out alone through an orifice of 225° C. having a diameter of 0.2 mm. Then a tow T2 was produced in the same manner as in the tow T1 except that a drawing temperature was adjusted to 80° C. The tows T1 and T2 were blended in a ratio of 1/3 (weight ratio) and a crimp was formed at 65° C. by a thrusting method, followed by cutting into a length of 50 mm to give a blended staple BS1. By using the blended staple BS1, a non-woven fabric W1 having a unit weight of 200 g/m$^2$ was produced by a carding method. The five non-woven fabrics were laid on each other and pressed, followed by treating at 130° C. for 15 minutes in a drying machine to give a heat-bonded non-woven fabric SW1. The non-woven fabric SW1 had a structure of fibers being adhered strongly with each other and thus was suitable as a material for a cushion. The non-woven fabric W1 is self-adherable at a wide heat-treating temperature range of 90° to 160° C., and naturally adheres strongly at a higher temperature.

For comparison purpose, a trial was made to conjugate a sheath of the PBS and a core of the polymer P1 and spin a conjugated polymers in the same manner as in the tow T1, but a wound fiber could not be unwound due to sticking of the PBS.

EXAMPLE 10

Pellets of the PBS of Example 9 and pellets of the polymer P1 were mixed in a ratio of 2/3 (weight ratio), melted in a screw extruder of 220° C., passed through a Kenix static mixer having 30 elements and fed to a spinneret for production of conjugated yarn. Then the separately melted polymer P1 as a core and the above-mentioned polymer mixture as a sheath were conjugated in a ratio of 1/2 (volume ratio) into a concentric sheath-core type. Then an adhered non-woven fabric SW2 was produced in the same manner as in the non-woven fabric SW1 of Example 9. The SW2 had fibers adhered strongly with each other, and was suitable for a cushion, etc. The above-mentioned polymer mixture had melting points of 173° C. and 111° C., and heat of fusion were 33 J/g and 21 J/g, respectively. It is presumed that forming into a block polymer due to a mutual reaction scarcely occurred. In case where a melt-mixing time is long (for example, not less than 15 minutes, particularly not less than 20 minutes), a part of or a considerable part of the polymers is copolymerized but when crystallinity of each polymer is maintained and separate melting points are recognized by a DSC analysis, it is useful for the present invention.

EXAMPLE 11

Three parts of a polyethylene glycol (PEG) having a molecular weight of 8000 and containing hydroxyl groups at the both molecular ends, 98 parts of L-lactide, 100 ppm of tin octylate and 0.05 part of Irganox 1010, i.e. an antioxidant produced by Ciba Geigy Corp. were mixed, and then polymerized by melting and stirring in a nitrogen atmosphere at 188° C. for 15 minutes in a twin-screw extruder. Then after extruding through a spinneret, cooling and forming into chips, the chips were treated (solid phase polymerization) at 140° C. in a nitrogen atmosphere for four hours and washed with acetone containing hydrochloric acid in an amount of 0.1%. Then after washing with acetone five times and drying, a block copolymer P1 of polylactic acid and PEG was obtained. The polymer P1 had a molecular weight of 148000, a content of a PEG component of about 3% and a melting point of 174° C. and had a heat of fusion of 5 J/g when sufficiently orientated and crystallized. The melting point, crystallinity and the like were nearly the same as in a polylactic acid homopolymer, but flowability at melting and stretchability were excellent and conjugation at melting and spinning were easy. In many cases a shrinkage of a drawn yarn in boiling water is from about 10% to about 15%.

Twenty-five parts of a random copolymer of polybutylene succinate and polybutylene adipate in a mole ratio of 4/1 which contained hydroxyl groups at the both molecular ends and had a molecular weight of 125000 and a melting point of 93° C., 76 parts of L-lactide and 80 ppm of tin octylate were mixed, and then polymerization was carried out in the same manner as in the polymer P1 to give a block copolymer BP3 comprising polylactic acid and polybutylene succinate/adipate in a ratio of about 3/1. The polymer BP3 had a molecular weight of 117000, and according to a DSC analysis, there were two peaks of heat of fusion. A melting point and a heat of fusion at the both peaks were 168° C. (36 J/g) and 86° C. (6.5 J/g). It is presumed that the both melting points correspond to a polylactic acid segment and a polybutylene succinate/adipate copolymer segment, respectively. A melting point (represented value) of this polymer is assumed to be 168° C. In many cases a shrinkage in boiling water of a drawn yarn obtained from the polymer BP3 is from about 30% to about 70%.

An octyl alcohol of 1/50 mole based on 1 mole of L-lactide and 100 ppm of tin octylate were mixed and then polymerized in the same manner as in the polymer P1 to give a polylactic acid having a molecular weight of 6700 and containing hydroxyl group at one molecular end. To the polylactic acid melted at 180° C. was mixed an equimolar hexanediisocyanate, followed by reaction. Then to the obtained prepolymer having an isocyanate group at its molecular end was mixed an equimolar polydimethylsiloxane having a molecular weight of 5500 and containing hydroxyl group at its one molecular end, followed by melt-mixing in a twin-screw extruder of 180° C. While being passed through a static mixer having 120 elements, the mixture was reacted for 30 minutes to give a block copolymer BP4 of polylactic acid/polydimethyl siloxane in a ratio of about 55/45 (weight ratio).

The polymer BP3 was melted at 220° C., mixed with 3% of the polymer BP4 melted at 220° C. while being fed and further mixed in a Kenix static mixer having 60 elements. A mixture was then supplied to a spinneret for production of conjugated yarn by means of a weighing pump. On the other hand, the polymer P1 was melted at 220° C. in a screw extruder and supplied to the spinneret by means of the weighing pump. The polymer P1 as a component 7 in FIG. 3B and the mixture of the polymers BP3 and BP4 as a component 8 in FIG. 3B were conjugated in a ratio of 4/1 (volume ratio) and formed into a radial type structure shown in FIG. 3B. The conjugated polymers were spun out through an orifice having a diameter of 0.20 mm, and with cooling in air and oiling, wound at a speed of 1500 m/min and then drawn at 80° C. in a drawing ratio of 3.9 and heat-treated at 100° C. under a tension to give a drawn yarn D1 of 75 deniers/25 filaments.

For comparison, a drawn yarn D2 (Comparative Example) comprising conjugated fibers was produced in the same manner as in the drawn yarn D1 by using the polymers P1 and BP3 (without using the block copolymer BP4 containing a polydimethylsilosane).

A circular knitted fabric was produced by using the drawn yarn D1 and poured into boiling water. After boiled for 15 minutes, the fabric was taken out, dried and brought into contact with a rotation roll wound with a sand paper to give a raised knitted fabric K1. Most of raised fibers in the knitted fabric K1 obtained from the fibers of the present invention were divided and therefore the knitted fabric had very soft feeling. Similarly a knitted fabric obtained from the drawn yarn D2 of Comparative Example was boiled, dried and raised, but most of the raised fibers in the obtained raised knitted fabric K2 were not divided and feeling of the knitted fabric K2 was hard.

EXAMPLE 12

A block copolymer BP5 of polylactic acid and polycaprolactone in a ratio of about 3/1 (weight ratio) was prepared in the same manner as in the preparation of the polymer BP3 of Example 11 except that 76 parts of L-lactide was reacted with 25 parts of a polycaprolactone having a molecular weight of 128000 and a melting point of 60° C. and containing hydroxyl group at its molecular end. The polymer BP5 had a molecular weight of 103000 and a melting point and a heat of fusion of 166° C. (35 J/g) and 52° C. (6.6 J/g). A melting point (represented value) was 166° C. A shrinkage in boiling water of a drawn yarn obtained from the polymer BP5 is in many cases from about 30% to about 70%.

A conjugated fiber D3 was produced in the same manner as in the conjugated fiber D1 of Example 11 except that the polymer BP5 was used instead of the polymer BP3. By using the conjugated fiber D3, a raised knitted fabric K3 was produced in the same manner as in Example 11. The raised knitted fabric K3 according to the present invention comprises fibers having raised fine fibers divided and has very soft feeling.

EXAMPLE 13

Three parts of a polyethylene glycol (PEG) having a molecular weight of 8000 and containing hydroxyl groups at the both molecular ends, 98 parts of L-lactide, 100 ppm of tin octylate and 0.05 part of Irganox 1010, i.e. an antioxidant produced by Ciba Geigy Corp. were mixed, and then polymerized by melting and stirring in a nitrogen atmosphere at 188° C. for 15 minutes in a twin-screw extruder. Then after extruding through a spinneret, cooling and forming into chips, the chips were treated (solid phase polymerization) at 140° C. in a nitrogen atmosphere for four hours and washed with acetone containing hydrochloric acid in an amount of 0.1%. Then after washing with acetone five times and drying, a block copolymer P1 of polylactic acid and PEG was obtained.

A block copolymer BP6 of a polylactic acid and PBS/PBA copolymer in a ratio of about 9/1 (weight ratio) was obtained in the same manner as in the preparation of the polymer P1 by using 10 parts of a random copolymer of polybutylene succinate (PBS) and polybutylene adipate (PBA) in a mole ratio of 4/1 containing hydroxyl groups at the both molecular ends and having a molecular weight of 125000 and a melting point of 93° C., 91 parts of L-lactide and 90 ppm of tin octylate. The polymer BP6 had a molecular weight of 135000, and a melting point of 174° C. and a heat of fusion of 45 J/g according to a DSC analysis. A polylactic acid was modified slightly, but its affinity with the PBS/PBA copolymer was considerably improved. A shrinkage in boiling water of a drawn yarn obtained from a mixture of the polymer BP6 and the PBS/PBA copolymer in a ratio of 2/1 (weight ratio) is usually from about 30% to about 70%.

A block copolymer BP4 of a polylactic acid/polydimethyl siloxane in a ratio of about 55/45 (weight ratio) was prepared in the same manner as in Example 11.

Pellets of the polymer BP2 and pellets of the PBS/PBA copolymer were mixed in a ratio of 2/1 (weight ratio) and melted by a screw extruder of 220° C. The melted mixture was mixed with 3% of the polymer BP4 melted at 220° C. while being fed, and further mixed in a Kenix static mixer having 60 elements. The mixture was then supplied to a spinneret for production of conjugated yarn by means of a weighing pump. On the other hand, the polymer P1 was melted at 220° C. in a screw extruder and supplied to the spinneret by means of the weighing pump. The polymer P1 as a component 7 in FIG. 3B and a mixture of the polymers BP6, PBS/PBA copolymer and polymer BP4 as a component 8 in FIG. 3B were conjugated in a ratio of 4/1 (volume ratio) and formed into the radial type structure shown in FIG. 3B. The conjugated polymers were spun out through an orifice having a diameter of 0.20 mm, and with cooling in air and oiling, wound at a speed of 1500 m/min and then drawn at 80° C. in a drawing ratio of 3.9 and heat-treated at 100° C. under a tension to give a drawn yarn D4 of 75 deniers/25 filaments. For comparison purpose, a drawn yarn D5 (Comparative Example) was produced similarly except that the silicon-containing polymer BP4 was not used.

A circular knitted fabric was produced by using the drawn yarn D4 and poured into boiling water. After boiled for 15 minutes, the fabric was taken out, dried and brought into contact with a rotation roll wound with a sand paper to give a raised knitted fabric K4. Most of raised fibers in the knitted fabric K4 obtained from the fibers of the present invention were divided and therefore the knitted fabric had very soft feeling. Similarly a knitted fabric obtained from the drawn yarn D5 of Comparative Example was boiled, dried and raised to give a raised knitted fabric K5, but most of the raised fibers in the obtained raised knitted fabric K5 were not divided and feeling of the fabric K5 was hard.

EXAMPLE 14

A block copolymer BP7 of polylactic acid and polycaprolactone (PCL) in a ratio of about 9/1 (weight ratio) was prepared in the same manner as in Example 13 by reacting 10 parts of PCL having a molecular weight of 128000 and a melting point of 60° C. and containing hydroxyl group at its molecular end with 91 parts of L-lactide. The polymer BP7 had a molecular weight of 112000, and a melting point of 169° C. and a heat of fusion of 45 J/g according to a DSC method. A shrinkage in boiling water of a drawn yarn obtained from a mixture of the polymer BP7 and the above-mentioned PCL in a ratio of 3/1 (weight ratio) is in many cases from about 30% to about 50%.

A conjugated fiber D6 was produced in the same manner as in the conjugated fiber D4 of Example 13 except that the polymer BP7 was used instead of the polymer BP6. By using the conjugated fiber D6, a raised knitted fabric K6 was produced in the same manner as in Example 13. The raised knitted fabric K6 according to the present invention comprised fibers having raised fine fibers divided and had very soft feeling.

EXAMPLE 15

Three parts of a polyethylene glycol (PEG) having a molecular weight of 8000 and containing hydroxyl groups at the both molecular ends, 98 parts of L-lactide, 100 ppm of tin octylate and 0.1 part of Irganox 1010, i.e. an antioxidant produced by Ciba Geigy Corp. were mixed, and then polymerized by melting and stirring in a nitrogen atmosphere at 188° C. for 15 minutes in a twin-screw extruder. Then after extruding through a spinneret, cooling and forming into chips, the chips were treated (solid phase polymerization) at 140° C. in a nitrogen atmosphere for four hours and washed with acetone containing hydrochloric acid in an amount of 0.1%. Then after washing with acetone five times and drying, a block copolymer P1 of polylactic acid and PEG was obtained. The polymer P1 had a molecular weight of 151000, a content of a PEG component of about 3% and a melting point of 174° C. and had a heat of fusion of 55 J/g when sufficiently orientated and crystallized.

Fifteen parts of a condensated polyester of 2,2-dimethylpropanediol and sebatic acid having a molecular weight of 127000 and containing hydroxyl groups at the both molecular ends, 15 parts of a condensated polyester of butanediol and adipic acid having a molecular weight of 122000 and containing hydroxyl groups at the both molecular ends, 71 parts of L-lactide and 80 ppm of tin octylate were mixed, and then a polymer BP8 was prepared in the same manner as in the polymer P1. The polymer BP8 is a block copolymer comprising a crystalline polylactic acid as a hard segment and a mixture of a polydimethylpropane sebacate (PDMPS) and polybutylene adipate (PBA) as a soft segment. The copolymer had a melting point of 164° C., a heat of fusion of 25.5 J/g and a molecular weight of 119000. A proportion of the hard segment component (polylactic acid) of the polymer BP8 was about 70%. In view of its melting point and heat of fusion, a proportion of the crystalline portion is assumed to be around 50%. Though the molecular weight of the polymer BP8 is lower than those of the PDMPS and PBA which are materials for the soft segment, it seems that this is because esterification reaction and decomposition occur partly. However according to a GPC analysis, a main molecular weight distribution exhibited a single peak and it was confirmed that a uniform block copolymer of polylactic acid/PDMPS/PBA was produced. In the DSC analysis, there were seen, at 35° C. and 80° C., two peaks of heat of fusion of not more than 2 J/g which were based on the soft segment. Those peaks were negligible and the soft segment is assumed to be non-crystalline substantially. A glass transition point of the copolymer was about −12° C.

The polymer P1 and the polymer BP8 were melted in separate screw extruders of 220° C. and supplied to two polymer feed parts of a spinneret for production of conjugated yarn. The both polymers were conjugated into the parallel type structure (conjugation ratio 1/1) as shown in FIG. 1A and spun out through an orifice of 225° C. having a diameter of 0.22 mm. With cooling in air and oiling, the spun filament was wound at a speed of 4000 m/min and drawn at 80° C. in a drawing ratio of 1.5 to give a drawn yarn FS1 of 70 deniers/24 filaments. The drawn yarn FS1 had a tenacity of 4.7 g/d and an elongation of 29% and had an excellent crimp elongation of 330% after revelation of the crimp.

For reference purpose, a polylactic acid/PBS block copolymer BP9 having a molecular weight of 118000 was produced in the same manner as in the preparation of the polymer BP8 by reacting 30 parts of a polybutylene succinate (melting point 114° C.) having a molecular weight of 125000 as the soft segment and 70 parts of L-lactide as the hard segment. According to the DSC analysis, the polymer BP9 exhibited two crystalline melting points. The respective melting points and heat of fusion were 103° C., 27 J/g, 166° C. and 29 J/g. A drawn yarn FS2 was produced in the same manner as in the drawn yarn FS1 by using the polymers P1 and BP9. The drawn yarn FS2 had a tenacity of 4.7 g/d and an elongation of 28% and had a crimp elongation of 121% after revelation of the crimp. The crimpability exhibited was very good, but was lower than that of the drawn yarn FS1.

EXAMPLE 16

Thirty parts of a random copolymer of a polybutylene sebacate and polydimethylpropane sebacate in a ratio of 1/1 (mole ratio), 71 parts of L-lactide and 80 ppm of tin octylate were mixed, and then a block copolymer BP10 was produced in the same manner as in the polymer BP8 of Example 15. The polymer BP10 had a single crystalline melting point of 164° C. and a heat of fusion of 25 J/g. The soft segment thereof was non-crystalline.

On the other hand, while 1 mole of a polyethylene adipate having a molecular weight of 12000 and containing hydroxyl groups at the both molecular ends and 1 mole of a polydimethylpropane adipate having a molecular weight of 8000 and containing hydroxyl groups at the both molecular ends were melted and stirred at 100° C. in a nitrogen gas stream, 4.5 mole of a diphenylmethanediisocyanate was slowly added dropwise, followed by reacting for three hours to give a prepolymer. With adding 1,4-butanediol in an amount of 2.5 mole based on the whole amount of the prepolymer, the mixture was supplied continuously to a twin-screw kneading extruder of 200° C. After reaction for seven minutes, the mixture was spun out into water through a spinneret, pelletized and dried to give a polymer BP11. The polymer BP11 comprises a hard segment having urethane bonds and a non-crystalline soft segment. The polymer BP11 had a melting point of 193° C. and a molecular weight of 49000.

A drawn yarn FS3 was produced in the same manner as in the drawn yarn FS1 of Example 15 by using the polymer P1 of Example 15 and the polymer BP10. The drawn yarn FS3 had a tenacity of 4.7 g/d, an elongation of 31% and a crimp elongation of 323%, and its crimpability was excellent.

Similarly a drawn yarn FS4 was produced in the same manner as in the drawn yarn FS1 of Example 15 by using the polymer P1 of Example 15 and the polymer BP11. The drawn yarn FS4 had a tenacity of 4.4 g/d, an elongation of 40% and a crimp elongation of 453%, and its crimpability was very excellent.

EXAMPLE 17

Three parts of a polyethylene glycol (PEG) having a molecular weight of 8000 and containing hydroxyl groups at the both molecular ends, 98 parts of L-lactide, 100 ppm of tin octylate and 0.1 part of Irganox 1010, i.e. an antioxidant produced by Ciba Geigy Corp. were mixed, and then polymerized by melting and stirring in a nitrogen atmosphere at 188° C. for 12 minutes in a twin-screw extruder. Then after cooling and forming into chips, the chips were treated (solid phase polymerization) at 140° C. in a nitrogen atmosphere for four hours to give a polylactic acid and PEG block copolymer P1. The polymer P1 had a molecular weight of 155000, a content of a PEG component of about 3% and a melting point of 175° C., and a heat of fusion of a fiber when sufficiently oriented and crystallized was 55 J/g. The polymer P1 was melted in a screw extruder of 230° C. and spun out through an orifice of 225° C. having a diameter of 0.2 mm. With cooling in air and oiling, the spun out filament was wound at a speed of 1500 m/min, drawn at 80° C. in a drawing ratio of 4.5 and heat-treated at 110° C. under a tension to give a drawn yarn A1 of 40 deniers/12 filaments. The drawn yarn A1 had a tenacity of 4.9 g/d, an elongation of 29% and a shrinkage of 12% in boiling water.

Thirty parts of an equimolar non-crystalline random copolymer of butanediol, propylene glycol, succinic acid and adipic acid having a molecular weight of 85000, 71 parts of L-lactide, 0.1 part of the above-mentioned Irganox and 100 ppm of tin octylate were mixed, and a block copolymer BP12 was prepared in the same manner as in the polymer P1. A molecular weight, melting point and heat of fusion of the polymer BP12 were 147000, 166° C. and 30 J/g, respectively. This is a melting point of crystals of a poly-L-lactic acid segment (block).

The copolymer BP12 was melted by a screw extruder of 220° C., spun out through an orifice of 225° C. having a diameter of 0.2 mm, and with cooling in air and oiling, was wound at a speed of 1500 m/min and drawn at 80° C. in a drawing ratio of 4.5, and thus a drawn yarn BS1 of 40 denier/12 filaments was obtained without heat-treating. The drawn yarn BS1 had a tenacity of 4.5 g/d, an elongation of 35% and a shrinkage of 35% in boiling water.

Each one of the drawn yarns A1 and BS1 was blended by means of an air nozzle to give a combined filament yarn MYS1 having the drawn yarns uniformly blended in its section. A twill fabric was produced by using a yarn obtained by twisting the combined filament yarn MYS1 at 600 T/m as a warp and a yarn obtained by twisting 30 T/m as a weft in a ratio of 2/1. The obtained twill fabric was, after scouring, heat-treated at 120° C. for 14 minutes by dry heating under relaxation and further was subjected to treatment (weight reduction) at 80° C. for 10 minutes with a 2.5% aqueous solution of sodium carbonate, followed by washing, adding 0.2% of a soft-finishing agent and then heat-treating at 135° C. under a tension to give a woven fabric MFS 1.

For comparison purpose, a woven fabric MF6 was produced in the same manner as in MFS1 by using a yarn obtained by twisting two drawn yarns A1. Characteristics of the woven fabrics MFS1 and MF6 are shown in Table 3.

TABLE 3

| Woven fabric | Softness | Bulkiness | Feeling | Remark |
|---|---|---|---|---|
| MFS1 | Good | Good | Good | Present Invention |
| MF6 | Not good slightly | Not good slightly | Not good | Comparative Example |

EXAMPLE 18

Fourteen parts of a polybutylene succinate/polybutylene adipate random copolymer in a mixing ratio of 4/1 (mole ratio) having a molecular weight of 125000 and a melting point of 92° C. and containing hydroxyl groups at the both molecular ends, 14 parts of a poly(2,2 -dimethylpropane adipate) homopolymer having a molecular weight of 81000 and a melting point of 37° C. and containing hydroxyl groups at the both molecular ends, 73 parts of L-lactide, 100 ppm of tin octylate and 0.1 part of Irganox were mixed and a reaction was carried out in the same manner as in Example 17 to give a block copolymer BP13. A molecular weight of the polymer BP13 was 147000 and a melting point thereof was 168° C. which was a melting point of the polylactic acid segment.

The polymer BP13 was melted at 220° C. and spun out through a spinneret of 225° C. for production of conjugated yarn, and then a drawn yarn BS2 was produced in the same manner as in Example 17. The drawn yarn BS2 had a tenacity of 4.6 g/d, an elongation of 33% and a shrinkage of 36% in boiling water. A combined filament yarn MYS2 was produced in the same manner as in Example 17 by using each of the drawn yarn A1 of Example 17 and the drawn yarn BS2. Then a combined filament yarn woven fabric MFS2 was produced in the same manner as in Example 17 by using the combined filament yarn MYS2. Softness, bulkiness and feeling of the fabric MFS2 were nearly the same as those of MFS1 of Example 17, and far excellent as compared with MF6 of Comparative Example. Thus an effect of blending fibers was recognized fully.

EXAMPLE 19

L-lactide was mixed with 0.05% of ethylene glycol, 0.1% of Irganox and 100 ppm of tin octylate, and then a reaction was carried out in the same manner as in Example 17 to give a polylactic acid PL1 having a molecular weight of 52000 and containing hydroxyl groups at the both molecular ends. One mole of a polyethylene adipate having a molecular weight of 12000 and containing hydroxyl groups at the both molecular ends and 1 mole of a polydimethylpropane adipate having a molecular weight of 8000 and containing hydroxyl groups at the both molecular ends were mixed and then with melting and stirring at 100° C. in a nitrogen gas stream, 4.02 mole of a phenylmethanediisocyanate was slowly added dropwise, followed by reacting for three hours to give a prepolymer PP1. With melting and stirring one part of the above-mentioned polylactic acid at 185° C. by a twin-screw extruder, thereto was mixed 0.4 part of the prepolymer PP1 and 2% of lauryl alcohol. After reacting for five minutes, the mixture was spun out through a spinneret, and cooled and cut in water to give a block copolymer BP14. The block copolymer BP14 comprises a hard segment having crystals of the polylactic acid and urethane bonds and a non-crystalline aliphatic polyester segment. The hard segment of the copolymer BP14 had a melting point of 172° C. and a molecular weight of 188000. The copolymer BP14 was melted by a screw extruder of 220° C. and spun out through 12 orifices of 230° C. having a diameter of 0.2 mm. While the spun out filament was mixed by air-blending with a fiber of the polymer P1 of Example 17 which was similarly melted and spun out, the blended fiber was wound at a speed of 1500 m/min, and drawn at 80° C. in a drawing ratio of 3.9 to give a combined filament yarn MYS3 of 80 d/24 f. A woven fabric was produced in the same manner as in Example 17 by using MYS3. The obtained woven fabric MFS3 had excellent bulkiness and softness like MFS1.

EXAMPLE 20

Three parts of a polyethylene glycol (PEG) having a molecular weight of 8000 and containing hydroxyl groups at the both molecular ends, 98 parts of L-lactide, 100 ppm of tin octylate and 0.1 part of Irganox 1010, i.e. an antioxidant produced by Ciba Geigy Corp were mixed and polymerized by melting and stirring at 188° C. for 12 minutes by a twin-screw extruder, and 0.1% of silicon oil (dimethylsiloxane) was mixed thereto lastly. Then after extruding through a spinneret, cooling and forming into chips, the chips were treated (solid phase polymerization) at 140° C. for four hours in a nitrogen atmosphere and washed with an acetone containing hydrochloric acid in an amount of 0.1%, followed by washing with the acetone five times and then cooling to give a polylactic acid/PEG block copolymer P1. The polymer P1 had a molecular weight of 122000, a content of a PEG component of about 3% and a melting point of 174° C. and had a heat of fusion of 55 J/g when sufficiently orientated and crystallized.

Eighty parts of a random copolymer of a polybutylene succinate (PBS) and polybutylene adipate (PBA) in a mole ratio of 4/1 containing hydroxyl groups at the both molecular ends and having a molecular weight of 125000 and a melting point of 93° C., 5 parts of PEG having a molecular weight of 20000, 20 parts of L-lactide, 30 ppm of tin octylate and 0.1 part of the above-mentioned Irganox were mixed. Then by polymerizing in the same manner as in the polymer P1, there was obtained MP1 having a melting point of 90° C. which was a mixture of a block copolymer of a PBS/PBA copolymer and polylactic acid (PBS/PBA/PLA) with a block copolymer of a polylactic acid and polyethylene glycol (PLA/PEG). Assuming that reactivity of hydroxyl groups at each end was the same and all lactides were reacted, it is presumed that a content of a PLA component in the PBS/PBA/PLA block copolymer was about 18% and a molecular weight thereof was about 150000 and that a content of a PLA component in the PLA/PEG block copolymer was about 52% and a molecular weight thereof was about 40000. Thus since the both polymers had a common component, i.e. PLA, they had a very high affinity with each other and were mixed uniformly.

To 80 parts of PEG having a molecular weight of 20000 were mixed 20 parts of L-lactide, 0.2 part of the above-mentioned Irganox and 20 ppm of tin octylate, followed by reacting at 180° C. for 30 minutes to give a PEG/PLA block copolymer having a molecular weight of 40000. Fifty parts of PEG having a molecular weight of 20000, 50 parts of sodium dodecylbenzene sulfonate and 0.3 part of the above-mentioned Irganox were mixed and then stirred at 180° C. at a pressure of 1 Torr for one hour and completely dehydrated. One part of the obtained dehydrated mixture and 4 parts of the PEG/PLA block copolymer were melted and mixed to give a mixture MP2. Further MP2 and MP1 were melted and mixed at 220° C. in a weight ratio of 7/93 to give a mixture MP3.

The PLA/PEG block copolymer P1 and the mixture MP3 were melted separately at 220° C., and while being weighed, supplied to a spinneret for production of conjugated yarn by a geared pump. Then P1 as a component 7 shown in FIG. 3B and MP3 as a component 8 shown in FIG. 3B were conjugated in the radial structure shown in FIG. 3B in a ratio of 4/1 (volume ratio) and spun out through an orifice of 220° C. having a diameter of 0.25 mm. With cooling in air and oiling, a spun filament was wound at a speed of 1500 m/min, drawn at 80° C. in a drawing ratio of 3.9 and then heat-treated at 100° C. under a tension to give a drawn yarn DF1 of 75 denier/25 filaments. For comparison, similarly to above, a drawn yarn DF2 (Comparative Example) was obtained by using P1 as the component 7 shown in FIG. 3B and a polybutylene succinate having a melting point of 116°

C. and a molecular weight of 125000 as a component 8 shown in FIG. 3B.

A circular knitted fabric was produced by using the drawn yarn DF1 and poured into a 3% aqueous solution of sodium carbonate of 98° C. After treated for 10 minutes, the fabric was taken out, dried and brought into contact with a rotation roll wound with a sand paper to give a raised knitted fabric DK1. Most of raised fibers in the knitted fabric DK1 obtained from the fibers of the present invention were divided and therefore the knitted fabric had very soft feeling. Similarly a knitted fabric obtained from the drawn yarn DF2 of Comparative Example was boiled, dried and raised, but most of the raised fibers in the obtained raised knitted fabric DK2 were not divided and feeling of the knitted fabric DK2 was hard.

EXAMPLE 21

A drawn yarn DF3 was obtained in the same manner as in Example 20 except that instead of the PBS/PBA random copolymer (melting point 93° C.), a polybutylene succinate (homopolymer) having a melting point of 116° C. and a molecular weight of 125000 was used. Then a raised knitted fabric DK3 was obtained similarly from the drawn yarn DF3. Raised fibers of the raised knitted fabric DK3 were divided completely like the raised knitted fabric DK1, and the fabric DK3 was excellent in softness.

EXAMPLE 22

Four parts of a polyethylene glycol (PEG) having a molecular weight of 8000 and containing hydroxyl groups at the both molecular ends, 97 parts of L-lactide, 100 ppm of tin octylate and 0.1 part of Irganox 1010, i.e. an antioxidant produced by Ciba Geigy Corp. were mixed, and then polymerized by melting and stirring in a nitrogen atmosphere at 188° C. for 12 minutes in a twin-screw extruder. Then after cooling and forming into chips, the chips were treated (solid phase polymerization) in a nitrogen atmosphere at 140° C. for four hours to give a block copolymer P1*a* of a polylactic acid and PEG. The polymer P1*a* had a molecular weight of 162000, a content of a PEG component of about 4% and a melting point of 175° C., and a heat of fusion when orientated and crystallized sufficiently was 55 J/g.

Thirty parts of a random copolymer comprising a polybutylene succinate (PBS) and polybutylene adipate (PBA) in a ratio of 4/1 (mole ratio) and having a molecular weight of 125000, a melting point of 92° C. and a heat of fusion of 57 J/g, 71 parts of L-lactide, 0.1 part of the above-mentioned Irganox and 100 ppm of tin octylate were mixed, and then a block copolymer BP1 was prepared by polymerizing in the same manner as above. A molecular weight of the BP1 was 137000. In the BP1, there were two main melting points of 165° C. and 85° C., and heat of fusion thereof were 32 J/g and 12 J/g, respectively. It is presumed that each melting point corresponds to crystals of a poly-L-lactic acid segment (block) and crystals of a PBS/PBA copolymer segment. The polymer BP1 contains the PBS/PBA copolymer component having a melting point of 92° C. in an amount of about 30%.

The polymers P1*a* and BP1 were melted separately by a screw extruder of 220° C., and while being weighed, supplied to a spinneret for production of conjugated yarn by a geared pump. The polymers were conjugated, as shown in FIG. 5A, in the concentric type structure having the polymer P1*a* as a sheath and the polymer BP1 as a core in a conjugation ratio of 1/4 (volume ratio) and then spun out through an orifice of 225° C. having a diameter of 0.2 mm. With cooling in air and oiling, the spun out filament was wound at a speed of 1500 m/min, drawn at 60° C. in a drawing ratio of 4/1 to give a drawn yarn Z1 of 70 deniers/24 filaments. The drawn yarn Z1 had a tenacity of 4.1 g/d, an elongation of 27% and a shrinkage of 29.3% in water of 100° C.

The polymer P1*a* was melted and spun out alone through an orifice of 220° C. having a diameter of 0.2 mm, and then a drawn yarn Z2 of 70 d/24 f was obtained in the same manner as in the drawn yarn Z1 except that after the drawing, heat-treating at 90° C. under a tension was conducted. The drawn yarn Z2 had a tenacity of 4.8 g/d, an elongation of 29% and a shrinkage of 12.6% in water of 100° C.

The drawn yarns Z1 and Z2 were passed through an air jet nozzle to be blended. Further a plain woven fabric was produced by using a warp obtained by twisting the combined filament yarn at 900 T/m and a weft obtained similarly by twisting at 200 T/m, and then treated for shrinking for 15 minutes under no tension in water of 100° C. containing a surfactant in an amount of 0.1% (detergent), followed by dyeing for 60 minutes in water of 100° C. containing 1% (owf) of a disperse dye, Miketon Polyester Blue 3 RT (produced by Mitsui Toatsu Co., Ltd.), 0.02% of acetic acid and 0.2% of a penetrant (activator). After washing, further 0.1% of a soft-finishing agent was added, followed by drying under a weak tension to give a woven fabric ZW1.

For comparison, two drawn yarns Z2 were blended and twisted, and then similarly shrinking, dyeing, soft-finishing and drying were conducted to give a woven fabric ZW2.

Bulkiness and softness of the woven fabrics ZW1 and ZW2 are shown in Table 4. As shown in Table 4, the woven fabric ZW1 according to the present invention has more excellent bulkiness and softness than ZW2 of Comparative Example.

TABLE 4

| Woven fabric | Bulkiness | Softness | Remark |
|---|---|---|---|
| ZW1 | Good | Good | Present Invention |
| ZW2 | Not good | Not good | Comparative Example |

EXAMPLE 23

The polymer P1*a* of Example 22 as a sheath and the PBS/PBA copolymer of Example 22 as a core were conjugated in the concentric type structure as shown in FIG. 5A in a ratio of 1/3 and then a drawn yarn Z3 was obtained in the same manner as in the drawn yarn Z1 of Example 22. The drawn yarn Z3 had a tenacity of 3.1 g/d, an elongation of 33% and a shrinkage of 27.1% in water of 100° C. The drawn yarn Z3 and the drawn yarn Z2 of Example 22 were blended. Then a woven fabric ZW3 was produced in the same manner as in the woven fabric of Example 22 by twisting, weaving, washing and treating for shrinking, and further conducting process for weight reduction by alkali treatment at 90° C. for 12 minutes with a 0.3% aqueous solution of sodium carbonate to degrade and remove about 11% of the polymer on a surface of a fiber and then washing, dyeing, soft-finishing and drying.

Pellets of the PBS/PBA copolymer of Example 22 and pellets of the polymer P1*a* were mixed in a ratio of 1/1 (weight ratio), melted in a screw extruder of 220° C., and after having passed through a Kenix static mixer having 30 elements, supplied to a spinneret for production of conjugated yarn. The obtained mixture as a core and the separately melted polymer P1*a* as a sheath were conjugated in the concentric core/sheath type structure as shown in FIG. 5A in a ratio of 1/3, and then a drawn yarn Z4 was obtained in the same manner as in the drawn yarn Z1 of Example 22. The drawn yarn Z4 had a tenacity of 3.4 g/d, an elongation of 32% and a shrinkage of 25.8% in water of 100° C. The drawn yarn Z4 and the drawn yarn Z2 of Example 22 were blended, and a woven fabric ZW4 was produced in the same manner as in the woven fabric ZW3. The woven fabrics ZW3 and ZW4 were very excellent in bulkiness and softness, which is greatly attributable to the process for weight reduction by alkali treatment. Without the alkali treatment, feeling of these woven fabrics is nearly the same as that of the woven fabric of Example 22.

What is claimed is:

1. A fiber comprising (A) a fiber component comprising a crystalline aliphatic polyester having a melting point of not less than 140° C. and a heat of fusion of at least 20 J/g, and (B) a fiber component comprising a block copolymer and/or a mixture of at least two aliphatic polyesters, the difference in melting point between which is at least 10° C., said block copolymer and/or mixture containing (H) 95 to 10% by weight of a high-melting component having a melting point of not less than 110° C. and a heat of fusion of at least 3 J/g and (S) 5 to 90% by weight of a low-melting component having a melting point of 40 to 120° C. and a heat of fusion of at least 3 J/g.

2. The fiber of claim 1, which is a composite yarn wherein a molecular-oriented fiber made of said fiber component (A) and a molecular-oriented fiber made of said fiber component (B) are blended.

3. The fiber of claim 1, wherein said fiber component (B) comprises a block copolymer and/or a mixture of at least two crystalline aliphatic polyesters, the difference in melting point between which is at least 20° C., said block copolymer and/or mixture containing (H) 90 to 10% by weight of a high-melting component having a melting point of not less than 130° C. and a heat of fusion of at least 3 J/g and (S) 10 to 90% by weight of a low-melting component having a melting point of 40 to 120° C. and a heat of fusion of at least 3 J/g, and said fiber components (A) and (B) are concentrically conjugated in a single filament to form a conjugated fiber wherein said fiber component (B) occupies at least partially the fiber surface.

4. The fiber of claim 1, wherein said fiber component (B) comprises a block copolymer and/or a mixture of at least two crystalline aliphatic polyesters, the difference in melting point between which is at least 20° C., said block copolymer and/or mixture containing (H) 90 to 10% by weight of a high-melting component having a melting point of not less than 130° C. and a heat of fusion of at least 3 J/g and (S) 10 to 90% by weight of a low-melting component having a melting point of 40 to 120° C. and a heat of fusion of at least 3 J/g, and said fiber components (A) and (B) are eccentrically conjugated in a single filament to form a conjugated fiber.

* * * * *